US011028549B2

(12) United States Patent
Kannegaard et al.

(10) Patent No.: US 11,028,549 B2
(45) Date of Patent: Jun. 8, 2021

(54) OFFSHORE DRILLING AND A CONFIGURABLE SUPPORT STRUCTURE FOR THE SAME

(71) Applicants: MAERSK DRILLING A/S, Kgs. Lyngby (DK); TOTAL E&P DANMARK A/S, København (DK)

(72) Inventors: Michael Kannegaard, Gentofte (DK); Hicham Chajai, Horbourg Wihr (FR); Zhanibek Yerkinovich Rakhmetov, Astana (KZ)

(73) Assignees: Maersk Drilling A/S, Kgs. Lyngby (DK); TOTAL E&P DANMARK, København (DK)

( * ) Notice: Subject to any disclaimer, the term of this patent is extended or adjusted under 35 U.S.C. 154(b) by 0 days.

(21) Appl. No.: 15/771,688

(22) PCT Filed: Oct. 6, 2016

(86) PCT No.: PCT/DK2016/000036
§ 371 (c)(1),
(2) Date: Apr. 27, 2018

(87) PCT Pub. No.: WO2017/071707
PCT Pub. Date: May 4, 2017

(65) Prior Publication Data

US 2018/0347135 A1 Dec. 6, 2018

(30) Foreign Application Priority Data

Oct. 29, 2015 (DK) ..... PA 2015 00668
Dec. 23, 2015 (GB) ..... 1522856
(Continued)

(51) Int. Cl.
*E02B 17/02* (2006.01)
*E21B 33/035* (2006.01)
(Continued)

(52) U.S. Cl.
CPC ..... *E02B 17/02* (2013.01); *E21B 19/002* (2013.01); *E21B 19/004* (2013.01);
(Continued)

(58) Field of Classification Search
CPC ..... E21B 17/02; E21B 19/002; E21B 19/004; E21B 33/035; E21B 33/043; E21B 33/143; E21B 41/08
See application file for complete search history.

(56) References Cited

U.S. PATENT DOCUMENTS 3,557,564 A * 1/1971 Hauber ..... F16L 3/245 405/169
4,227,831 A * 10/1980 Evans ..... E02B 17/021 405/196
(Continued)

OTHER PUBLICATIONS

International Search Report and Written Opinion for International Application No. PCT/DK2016/000036 dated Mar. 21, 2017.

*Primary Examiner* — Aaron L Lembo
(74) *Attorney, Agent, or Firm* — Carlson, Gaskey & Olds, P.C.

(57) ABSTRACT

Without limitation, embodiments of the present invention relates to an offshore wellhead platform (100), the offshore wellhead platform (100) comprising a configurable support structure (200) for supporting upper parts of a plurality of conductors (210) through which one or more well processing tasks can be performed, wherein the configurable support structure (200) further provides a first position (150) and a second position (160) for the conductors (210), and the offshore wellhead platform (100) allows movement of an upper part of a conductor (210) between its first (150) and second position (160). In this way, efficiency when processing a plurality of wells is provided since repositioning of the well center is not needed or needed significantly less. Effectively, the wells are brought to the well center so-to-
(Continued)

speak instead of the well center needing to be moved to each well.

27 Claims, 32 Drawing Sheets

(30) Foreign Application Priority Data

| | | |
|---|---|---|
| Dec. 23, 2015 | (GB) | 1522857 |
| Dec. 24, 2015 | (GB) | 1522858 |
| Jan. 21, 2016 | (GB) | 1601175 |
| Apr. 23, 2016 | (GB) | 1607101 |
| Apr. 23, 2016 | (GB) | 1607102 |
| Apr. 23, 2016 | (GB) | 1607103 |
| Apr. 23, 2016 | (GB) | 1607105 |
| Apr. 25, 2016 | (GB) | 1607180 |
| Apr. 25, 2016 | (GB) | 1607181 |
| Apr. 25, 2016 | (GB) | 1607182 |
| Apr. 25, 2016 | (GB) | 1607183 |

(51) Int. Cl.

| | |
|---|---|
| ***E21B 33/043*** | (2006.01) |
| ***E21B 33/14*** | (2006.01) |
| ***E21B 41/08*** | (2006.01) |
| ***E21B 19/00*** | (2006.01) |

(52) U.S. Cl.
CPC ..... *E21B 33/035* (2013.01); *E21B 33/043* (2013.01); *E21B 33/143* (2013.01); *E21B 41/08* (2013.01)

(56) References Cited

U.S. PATENT DOCUMENTS

| | | | | |
|---|---|---|---|---|
| 4,446,807 | A * | 5/1984 | Johnson | B63B 21/50 114/230.23 |
| 4,469,181 | A * | 9/1984 | Kellett | E21B 7/043 166/341 |
| 4,470,721 | A * | 9/1984 | Shotbolt | E21B 43/017 114/264 |
| 4,561,802 | A | 12/1985 | Campo | |
| 5,135,327 | A * | 8/1992 | White | E21B 7/128 114/265 |
| 5,330,293 | A * | 7/1994 | White | B63B 35/4413 166/339 |
| 8,522,880 | B2 * | 9/2013 | Roodenburg | B63B 35/4413 166/339 |
| 9,238,943 | B2 * | 1/2016 | Jordan | E21B 7/12 |
| 9,341,024 | B2 * | 5/2016 | Labrugere | E21B 15/003 |
| 9,976,364 | B2 * | 5/2018 | Shilling, III | B63B 21/20 |
| 2010/0147528 | A1 * | 6/2010 | Baugh | E21B 19/004 166/355 |

* cited by examiner

OFFSHORE DRILLING AND A CONFIGURABLE SUPPORT STRUCTURE FOR THE SAME

FIELD OF THE INVENTION

The invention relates generally to offshore wellhead platforms, to offshore well processing systems comprising or working in collaboration with such offshore wellhead platforms and to methods of using such an offshore wellhead platform.

BACKGROUND

Mobile offshore drilling units and offshore wellhead platforms are widely used in both the development and exploitation of reservoirs below the seafloor, seabed, etc. (forth only referred to as seabed).

For so-called moderate water depths, the various types of mobile offshore drilling units (often also referred to as rigs in the art) include so-called bottom-supported units, which rest on the seabed, and/or self-elevating units. Jack-up drilling units are typical examples of bottom-supported, self-elevating units; they comprise a hull and a number of legs adapted to be lowered towards the seabed. Bottom supported also includes indirect support by the seabed (e.g. by standing on or being attached to another structure on the seabed) or resting at a position in the seabed due to upper layers of the seabed being relatively soft. Such jack-up units may thus be sailed (towed, heavy-lifted, and/or self-propelled) to their desired off-shore location with the legs in a raised position. Once the unit is at its intended position, the legs are lowered and brought into contact with the seabed, often by driving them into the seabed to secure them in place. Further lowering of the legs relative to the hull causes the hull to be elevated out of the water. Many jack-up drilling units have the drill floor and well center positioned on a cantilever system that can be extended horizontally outwards relative to the hull of the jack-up unit, thus allowing the well center to be positioned outside the periphery of the unit defined by the hull of the unit.

Offshore production or wellhead platforms used for extracting hydrocarbons or other fluids or gasses from production wells are frequently fixedly installed for longer periods, also by resting on the seabed. Such platforms and others may be used for injection of water or other liquids or gasses into at least some of the wells (typically with the intent of increasing production from other wells, which can be on the same platform or on another platform). The platforms frequently support a plurality of wells and corresponding wellheads, which are typically installed on top of the conductor during or at the end of the drilling or well construction.

Wells in the present context are to be understood as so-called surface-wells where a part of a well (once established), i.e. at least the wellhead of a well, is located above the water level and typically substantially above expected wave height. Surface-wells are opposed to sub-sea wells with subsea trees (also referred to as wet trees, etc.). Referrals to a well or to wells throughout the present description and accompanying claims are to surface-wells unless expressly stated otherwise. A surface well may equally be referred to as an offshore surface well.

A wellhead platform or WHP is a structure or structures, which support(s) the upper end (opposite of the reservoir) of the well including any superstructures, one or more well processing stations, or similar. Such a wellhead platform is typically a structure (such as a jacket based or gravity based platform) resting on the seabed, ranging from very basic configurations to complex facilities. The decks of the wellhead platform are generally placed above the water and waves (e.g. above a 10.000 year wave). The wellhead platform may support one of more horizontal frames with support elements for conductors below the water level typically as part of a jacket. The offshore wellhead platform may comprise one or more well-processing stations. Alternatively, the offshore wellhead platform does not comprise any well-processing stations. In such cases, well-processing tasks such as drilling may be performed by a drilling unit placed next to the wellhead platform. The WHP typically fulfills one or more of the following functions in supporting a conductor: (i) shielding the conductor from accidental impacts from ships and vessels, (ii) keeping a completed surface well from otherwise tipping over by providing structural support typically via one or more guides (also referred to as conductor guides) fixedly attached to the platform, (iii) provide structure where pipes can be mounted for connecting to a valve assembly or production tree (e.g. also referred to as x-mas tree) mounted on each conductor and interfacing these pipes with various equipment or manifolds on and/or off the platform, such as pumps and storage tanks, (iv) supporting the x-mas trees so that they are substantially static relative to the platform (at least during production) as the platform and/or conductor is/are exposed to forces from current, wind and wave.

In some embodiments, the offshore wellhead platform may, after installation, be rigidly fixed to the seabed or in other ways be secured, piled, anchored, moored, connected, or the like to the seabed. The offshore wellhead platform is after installation partly above sea level.

Drilling may be performed by a drilling station (sometimes referred to as a "drilling rig" or "drilling system") having a well center and e.g. being installed on the wellhead platform (e.g. for relatively large platforms) or more typically being installed on a jack-up or other drilling unit placed next to the wellhead platform during drilling. A well center is sometimes also referred to as well processing center and is a position for which a well processing station is to be vertically aligned with a the upper end of a well in order to perform well processing tasks on this well. For a drilling station, a well center is typically defined by a hole in the drill floor at which various equipment (such as the hook of a hoisting system of typically 500 tons or more, diverter, rotary table, and top drive) is aligned to enable strings of tubulars and drilling tools to be lowered towards and drilling into the seabed and construction of a hydrocarbon well. The drilling station typically connects to the well through a high-pressure riser aligned with well center for mud return and a BOP for mud return. More generally, a well center of a well processing station is a position at which the well processing station is configured for providing tools and/or tubulars or tubing for performing a well processing task on the well.

A plurality of wells is typically processed at the same site, especially during development drilling, towards well-completion (involving drilling at least during certain stages) making the wells ready for extraction of hydrocarbon i.e. production, injection, or other functions where the well provides access to a hydrocarbon reservoir below the seabed.

The position of a well center and thereby the working or drilling center (as discussed below) may be changed by moving the derrick and drill floor (this operation is normally referred to as "skidding") containing at least a part of the equipment used for drilling. On some (typically larger) wellhead platforms, a drilling station (typically including a derrick and drill floor) may typically be arranged on rails or skids to allow a drilling station to traverse a deck of the platform and to be arranged over a well slot (i.e. the upper end of the well to be drilled) or over of an existing well (i.e. a previously completed well) for performing various well processing tasks. Similarly, on a jack-up, the derrick and drill floor may typically be arranged on a cantilever that can be moved forth (outwards from the hull or main body of the unit) to allow the drilling rig of the jack-up to reach well slots on the platform. The drilling station may be arranged on skids on the cantilever to allow transverse movement of the drilling station. In some designs, the cantilever and the drilling station are arranged so that the cantilever can pivot sideways or be moved sideways (relative to the hull or main body of the unit), the latter of which is typically referred to as an XY-cantilever, see e.g. U.S. Pat. No. 6,171,027.

As mentioned, usually a larger number of wells are processed for a given area, e.g. using a so-called well template located on the seabed.

When processing a number of wells, i.e. executing one or more well processing tasks, the well center needs to be repositioned using the rails, skids, cantilever, etc. to bring it over to the proper location for the next well when processing shifts from one well to the next. The time for repositioning increases proportionally with the number of wells to be processed. The repositioning time is effectively "non-productive time" in relation to direct well progression even though it of course is required to progress the wells.

When processing a number of wells, one well may be completed before moving on to the next. The well processing tasks may generally include certain sub-steps or sub-tasks, i.e. be formed of several tasks or steps carried out sequentially. Certain steps (overall or sub-tasks) may be denoted as "critical" or as being part of a "critical path", signifying that a next or later task or sub-task cannot be carried out until the critical task or sub-task has been carried out. A very simple example of a critical step is the drilling of a 16" hole before inserting a 13-⅜" casing into the drilled hole.

So-called batch drilling may be applied to increase the efficiency of drilling multiple wells without interruption compared to completing one well at a time. Batch drilling involves completing the same group of well processing tasks (one or more) on multiple wells before moving on to the next group of task(s). This avoids the need for changing equipment to carry out the next step as the same equipment is used for processing the specific task(s) of all the applicable wells. However, even though efficiency is increased by batch drilling, it is still necessary to reposition the well center for each individual well, which still causes non-productive time.

There is therefore a need for increasing the efficiency of constructing and/or processing multiple wells.

SUMMARY

It is an object of some embodiments of the invention to alleviate at least one or more of the above-mentioned drawbacks at least to an extent. It is, in some embodiments, an object to provide increased efficiency and/or convenience when processing a plurality of wells. In some embodiments of the invention, it is an object to facilitate more efficient parallel operations on multiple wells. In some embodiments, it is an object to provide an alternative to moving the well processing station at least for some wells and/or to increase the number of wells reachable by a well processing station or a well processing system.

In some embodiments, the invention relates to an offshore bottom supported wellhead platform comprising a configurable support structure for supporting at least respective upper parts of two or more conductors, the upper part of each conductor comprising an upper end through which one or more well processing tasks can be performed, wherein (i) the offshore bottom supported wellhead platform allows movement of the upper part of each of the two or more conductors between a first and a second position of each of the two or more conductors, the first and second positions of a conductor corresponding to first and second positions, respectively, of the upper end of said (or: of the corresponding) conductor, (ii) the configurable support structure supports the two or more conductors at least at said first position, and (iii) where the second positions of a plurality of said two or more conductors are a shared second position corresponding to a shared second position of the upper ends of the plurality of said two or more conductors, at which each of said plurality of conductors may be selectively placed, and (iv) the offshore bottom supported wellhead platform allows performance, by a well processing station, through a well center of said well processing station, without lateral displacement of the well processing station or its well center, of (a) a well processing task through the upper end of a conductor of said plurality of said two or more conductors, when positioned at said shared second position, and (b) a subsequent well processing task through the upper part of another conductor of said plurality of said two or more conductors, when subsequently positioned at said shared second position.

In some embodiments, the shared second position of the upper ends is located away from the wellhead platform (e.g. with a well processing station) from which the upper part of a conductor may be moved onto the wellhead platform for support at a first position. In most embodiments, the shared second position is provided on the wellhead platform, so that in some embodiments the configurable support structure provides said first position and second position for each of the two or more conductors, such as said configurable support structure supporting each conductor in the shared second position, such as said configurable support structure supporting an upper part of each conductor when moving between said first and said shared second position. The shared second position is then provided at a working center or within a working center zone. Accordingly, the wellhead platform is arranged to align with the well center of the well processing station placed on or over the wellhead platform.

In some embodiments, the invention relates to an offshore wellhead platform comprising a configurable support structure for supporting an upper part of each of a plurality of conductors, i.e. upper parts of a plurality of conductors, through which one or more well processing tasks can be performed, wherein the configurable support structure further provides a first position and a second position for the upper part of each of the conductors, and the offshore wellhead platform allows movement of the upper part (in particular the upper end) of the conductors between their first and second position. In some embodiments, the second position is shared.

In general, movement of an upper part of a conductor between a first and a second position involves horizontally moving the upper end of the conductor between a corresponding first and second position of the upper end. Unless otherwise specified, movement of a conductor, or a part thereof, refers, in the context of this specification, to movement of a part of the conductor extending above the seabed after the conductor has been installed in the seabed in the early part of establishing a well. Typically, the part of the conductor extending into the seabed is considered fixed after installation.

The support structure is the structure of the platform for supporting a plurality of conductors. The support structure of the wellhead platform is formed at least by elements of the wellhead platform accommodating or engaging with the conductors, such as one or more deck sections defining openings through the decks for the conductors to extend through the deck, fasteners, guides, locking, and/or securing mechanisms. In this context engaging is taken to mean guiding with the purpose of constraining horizontal (also referred to as lateral) movement (optionally with a tolerance to decouple vibrations (as discussed below)) or slidably or non slidably fasten or clamp the conductor to the support structure. A conductor may curve from the seabed to the upper end of the conductor in which case the curve is typically imposed on or maintained for the conductor by the wellhead platform via the support structure. A configurable support structure is configurable in the sense that it provides support for conductors at a number of respective positions of its upper part and allows for movement between them. Furthermore, the configurable support structure may comprise one or more mechanisms (or part thereof) for causing the upper part of the conductors to move between a first and second position. The support structure typically comprises support elements that are substantially static at or near the seabed and typically provide a fixed position of the conductor at one or more depths. In may be undesirable to cause vibrations in the conductor, wellhead and/or Christmas tree from the well under production to couple to the wellhead platform. Accordingly, it is often advantageous if the support of the conductor includes a spacing (e.g. between 1 cm and 10 cm) between the support element and the conductor, or other means for decoupling. Thermal expansion of the conductor may also be an issue. The gap may be filled with air or a material of suitable properties to dampen the vibrations e.g. made in the form of wedges or a sleeve.

In the context of the present invention the expression "at or near the seabed" shall be taken to mean a height over the seabed that is less than 30% of the water depth, such as less than 20% of the water depth (at mean water level), such as less than 10% of the water depth, such as less than 5% of the water depth, such as at the seabed. Alternatively, the expression may be taken to mean within 15 meters from the seabed, such as within 10 meters, such as within 5 meters, such as within 2 meters.

Basically, construction (at least partially) of one well may be carried out with the upper part of the conductor positioned at one position while production (and potentially certain other well processing tasks) may be done for the same well with the upper part of the conductor positioned at a different position.

In this way, efficiency when processing a plurality of wells is provided since repositioning of the well center of a well processing station and repositioning of the well processing station is not needed or needed significantly less. In effect, the wells are brought to the well center so-to-speak instead of the well center needing to be moved to each well.

In some embodiments, it is faster, simpler, and/or safer to move the upper part of a well or conductor from a first position to a second position than repositioning the well center by moving a cantilever. This saves valuable time and more wells may be processed in a shorter time. After processing, the upper part of the conductor is simply moved to a first position allowing the upper part of another conductor to be moved to the same or shared second position.

It should be noted that description of a movement from e.g. a first to a second position of an upper part of a conductor does not necessarily exclude movement of the upper part before being at the first and/or the second position and/or after being at the second and/or the first position, respectively. Neither is it necessarily required that movement proceeds directly from the first position to the second position or the other direction.

Furthermore, in some embodiments, less specialized equipment like skids, rails may be needed on the platform whereby such equipment may be omitted or be of simpler design.

Additionally, when the wells are completed and used for production, well intervention, production, etc. they may simply be 'parked' at an individual first position. Once maintenance, work-over, etc. or other intervention is needed, the conductor and its associated wellhead may simply be moved to the second position again to carry out the maintenance or work-over process(es). Alternatively, later intervention may take place directly at a first position.

In the present context and throughout the entire description and accompanying claims, a conductor is to be understood as a conductor pipe or conductor casing (forth only referred to as conductor) for a wellhead (once installed) located above the water level. A conductor extends from below the seabed to the wellhead platform being located above a water level. The conductor is typically set before any drilling operations are performed. It is usually set with a special pile driving or spudder rig but alternatively a drilling station may be used. The conductor provides structural support for the well, wellhead, and completion equipment, and often provides hole stability for initial drilling operations. For a surface well, a conductor performs the function of "transferring" the seabed to a position above water level so that the well may be constructed through the conductor at this position as opposed to on the seabed. A wellhead is installed at the upper end of the conductor and casing strings are installed through the conductor as drilling of the well progresses and the well is constructed. The wellhead is often installed so that it rests on the upper end of the conductor. However, a wellhead may also be installed on the upper end of a casing (often a surface casing) installed in the conductor pipe and extending up from the upper end of the conductor pipe (typically less than 2 meters). This section of casing is rarely relied upon to be engaged for structural support of the upper part of the well (x-mas tree and wellhead) but it will be appreciated that the configurable support structure may support the upper part of a conductor by engaging with a casing extending out from the upper end of the conductor. For typical wells, some of the casings installed through the conductor are hung off the wellhead whereas other casing strings may hang from lower levels of the well. The conductor typically has a diameter between 18" and 30" or even larger such as 42". Typically, one conductor is used for each well and when the well is completed, the conductor hosts a set of concentric casings strings. However, a split wellhead or similar may support more than one well for each conductor.

Conductor pipes used in relation to surface wells supported by bottom-supported wellhead platforms are commonly referred to as non-flexible conductors (even while being flexible to some extent). In some embodiments, the conductors are steel pipes, e.g. single layer relatively rigid steel pipe. Alternatively, the conductors may be plastic, e.g.

relatively rigid plastic, polymer, titanium, carbon fiber, aluminum, etc. conductors. In principle, any material with suitable properties may be used for the conductors. However, steel pipe has proven over many years to be very suitable. In some embodiments, the conductor is made from a single layer material in the longitudinal direction as opposed to e.g. a spiral wound pipe. In some embodiments, the conductor is made from multiple concentric layers. Such non-flexible conductors are opposed to, and very different from, so-called flexible pipes used with deep-water wells, sub-sea wells, etc., or even used with surface-wells located on a floating platform, i.e. a platform or unit that is not fixed to or supported by the seabed. Such flexible pipes are typically made from helically wound metallic armor wires or tapes combined with concentric layers of polymers, textiles, fabric strips, and lubricants.

In some embodiments, at least a part of the upper part of one or more conductors is flexible or comprises a part or segment made of a more flexible material such as more flexible material relative to the material of parts of the conductor lower than the upper part, e.g. at, near or in the seabed. In some embodiments, at least a part of the conductor above the seabed of one or more conductors is flexible or comprises a part or segment made of a more flexible material such as more flexible relative to parts of the conductor in the seabed. Alternatively or in combination with such a variation in material the thickness of the material may be varied to make such segments more flexible relative to a corresponding segment lower than the upper part or in the seabed.

A conductor is typically installed as the first component for a well to be drilled into the seabed towards a reservoir. After well completion, the conductor has a valve assembly or production tree (e.g. also referred to as Christmas tree, x-mas tree, etc.) mounted on the wellhead of the conductor, such that the valve assembly or production tree is located above the water level while being supported by a wellhead platform, drilling unit, or similar.

The configurable support structure may be configured to support one or more (further) conductors for which the possibility to move the upper part is not available. In other words, further conductors for which the first and a second position is coinciding, such as a conductor installed so that it has a first position and second position at a shared second position of one or more other conductors after the second position has been used for these conductors. This may allow better utilization of the deck space on the wellhead platform by utilizing the shared second position or the work center zone for further wells once the function of providing shared second positions for a set of conductors have been completed. The wellhead platform may further support one or more conductors installed in a conventional manner so that the upper end is fixed.

In some embodiments, the second position of at least some, e.g. all, of the plurality of conductors is the same, and the first position of at least some, e.g. all, of the plurality of conductors are different at least for some of the plurality of conductors. As the conductors (once installed and, in particular, subsequent to the drilling of a well through the respective conductors) will be fixed at or in the seabed at different positions (often in a template on the seabed and/or held by the wellhead platform) the curve of a conductor from the seabed to the upper end will not coincide along the whole length above the seabed with the curve of another conductor even if their respective upper ends would be at the same position. Accordingly, a reference throughout the present description to a same or shared position (in particular to same second positions or to shared second positions) of a plurality of conductors refers to at least the upper ends of these conductors being placeable (one at a time) in the same/shared position even though spatial positions of some parts—and in particular the lower parts—of the conductors will not coincide for the same position (see e.g. FIGS. 8*a* and 8*b*). In the present context and throughout the entire description and accompanying claims, a first and a second position of a conductor corresponds to a respective first and a second position of the upper end of the conductor and a shared second position of a plurality of conductors also corresponds to a shared position of the respective upper ends of the conductors. Due to the stiffness of the conductor, positions at horizontal planes lower than the upper end, such as at a wellhead access deck or cellar deck, will typically also coincide, so that a configurable support structure providing a shared second position may at least at such a plane engage with the conductor in the same position (within said plane) and thereby provide the same position of the upper end. In some embodiments, such overlap is present at a horizontal plane at the level of the highest elements of the wellhead platform arranged to provide support, i.e. support element, to at least one of the plurality of conductors.

In some embodiments, the first position of a conductor is at least one member selected from the group consisting of a parking, a storage, an injection, and/or a production position. Accordingly, in some embodiments, the first position for a conductor may be regarded as a state for which the wellhead platform is arranged to support the conductor when production is carried out from the reservoir. Accordingly, in some embodiments, the wellhead platform is arranged to support multiple conductors in respective first positions simultaneously, i.e. in the first positions of at least some of the upper ends are non-overlapping positions of the upper ends. It is noted that during production from a reservoir, individual wells may have different functions so that a well drilled through one conductor may produce while other wells perform other functions such as injecting gas or liquids during production from the reservoir.

The second position of the conductor is a well processing and/or drilling position. In the present context and throughout the entire description and accompanying claims, a second position of a conductor is in general a position where a well processing task may be performed through the upper end of the conductor. More specifically a second position is a well-processing and/or drilling position, where a well-processing position is a position where any suitable well-processing task may be performed.

It should be noted that a particular position may be one or more of the listed members as well as any possible combinations thereof.

The conductors may be guided at the seabed by a well template or similar structure located on or near the seabed and secured at the seabed.

In order to move the upper part of a conductor laterally, an applied force will generate bending stress at different levels along the conductor length. These stresses, combined with the existing stress from the environment and the weight of the conductor and equipment could potentially overstress the conductor thereby potentially causing too large strains that may lead to yielding and/or ultimately rupture of the conductor.

Movement of upper parts of conductors between first and second positions may also cause stress at various parts of the main structure of the wellhead platform and/or other parts of the platform such as decks.

It is therefore desirable to appropriately handle at least some of this stress and/or appropriately provide control of the movement (e.g. at other levels than near the upper part) of a conductor when the upper part of the conductor is being moved.

In one aspect of the present invention, a bottom supported offshore wellhead platform comprises:

a main structure for supporting an upper deck structure of the offshore wellhead platform, and a configurable support structure for supporting at least upper parts of a plurality of conductors through which one or more well processing tasks can be performed, wherein the offshore wellhead platform and/or the configurable support structure allows movement of an upper part of a conductor between a first and a second position, and wherein the main structure and/or the wellhead platform further comprises at least one support element adapted to at least partially relieve or alleviate the main structure and/or a conductor of stress caused by movement of the conductor between a first and a second position.

The upper deck structure is a structure generally performing the function of the topside in relation to a jacket based wellhead platform, so that in some embodiments the upper deck structure is the topside. Accordingly, in some embodiments the upper deck structure performs the functions of the wellhead platform during the production phase and supports the upper end of the well. However, one or more decks for access and support of equipment and/or for interfacing with the x-mas trees of the completed well in the production phase, potentially host a production module, and/or equipment for injecting fluid. The main structure of the wellhead platform may be a leg structure, e.g. in the form of a frame structure, a column, or the like, that rests on the seabed and extends upwards above the water level. The main structure supports the weight of the upper deck structure which is located above the water level and comprises one or more decks and which accommodate the most of the production equipment of the wellhead platform. In some embodiments the main structure may be embodied as a jacket or a column and the upper deck structure as a topside. In other embodiments, the main structure and the upper deck structure may be embodied as one integrated structure.

In some embodiments, the wellhead platform is adapted to apply one or more counter forces operable to reduce an impact of a movement force on the main structure, where the movement force is a force acting on a conductor when being moved between a first and a second position and, in particular, a force acting on a conductor for imparting a movement between a first and a second position.

In some embodiments, the configurable support structure is configured to provide a compensation position at least for some of the conductors; in particular, the configurable support structure may allow movement of the upper part of at least some of the conductors to a compensation position different from the first and second positions and, in particular, movement between the first position and the compensation position. The compensation position associated with a conductor may be located more distantly from a central second position associated with said conductor than a first position associated with said conductor. In some embodiments, the wellhead platform comprises at least one support element adapted to at least partially relieve or alleviate the main structure of stress when a first conductor is moved from its first position to a second position by moving at least one, preferably an even plurality of, other conductor(s) to its or their respective compensation position(s) when the first conductor is moved to its second position. In some embodiments, the at least one other conductor being moved to its or their third compensation position(s) is/are conductors being, e.g. the closest, neighboring conductors to the first conductor being moved from its first position to a second position.

In some embodiments, the wellhead platform comprises at least one support element. The support element may be directly or indirectly attached to a main structure of the wellhead platform. For example, the support element may be attached to the upper deck structure which in turn is attached to the main structure. The support element may be a part of the configurable support structure. For the purpose of the present description, the support elements that are part of the configurable support structure will also be referred to as elements of the configurable support structure.

In some embodiments, the support element comprises one or more conductor guides being secured to the main structure wherein each of the one or more conductor guides comprises a central through-going cavity and the offshore wellhead platform is adapted to receive a part of a conductor in the through-going cavity.

In some embodiments, at least one first conductor guide of the one or more conductor guides is elongated and comprises two opposing ends where each end is funnel shaped expanding outwards from a center of the at least one first conductor guide.

In some embodiments, the at least one support element comprises at least one conductor guide adapted to receive a part of a conductor wherein at least one conductor guide is attached to the main structure via a telescopic and/or resilient element.

In some embodiments, the at least one support element comprises at least one restriction element being attached to the main structure wherein at least one restriction element is adapted to allow movement of a contained conductor guide only along a single direction. In particular, in some embodiments, the at least one restriction element comprises a slit or slot being adapted to engage a contained conductor guide, e.g. an elongated guide having opposing funnel-shaped outwardly expanding ends, The restriction element may thus engage the elongated guide at a part between the two ends.

In some embodiments, the at least one support element comprises at least one restriction element being movably attached to the main structure where at least one restriction element is adapted to allow movement of a contained conductor guide only in a predetermined two-dimensional plane. In particular, in some embodiments, the restriction element comprises two piston elements each connected to both the main structure and the contained conductor guide via movable connectors.

In some embodiments, the at least one support element comprises at least one locking element or mechanism adapted to selectively fixate a movable conductor guide in the horizontal plane and in relation to the main structure where the movable conductor guide is adapted to receive a part of a conductor.

In some embodiments, the at least one support element comprises a positioning element adapted to position or follow a conductor contained within a first conductor guide where the positioning element is internal to the first conductor guide. In particular, in some embodiments, the positioning element comprise at least two, preferably three, piston elements secured internally in the first conductor guide where each piston element comprises a rotating abutment element at an end facing a conductor when comprised by the first conductor guide.

In some embodiments, the at least one support element comprises a cable anchoring system comprising a plurality of anchor points wherein the cable anchoring system is secured to a conductor being secured by a number of cables to at least three of the anchor points, where the at least three of the anchor points are arranged at a first side and at a generally opposing second side, and wherein the cable anchoring system is adapted to selectively move the secured conductor by controllably dragging or pulling one or more cables at the first side and controllably releasing one or more cables at the second side thereby providing controlled movement of the conductor in a predetermined movement plane. In particular, in some embodiments, the plurality of anchor points is divided into a first group and a second group wherein the first group and the second group are located at different height levels. The plurality of anchor points may be divided into a first group and a second group wherein the first group of anchor points is arranged in a first substantially oval or circular ring-like pattern and the second group of anchor point is arranged in a second substantially oval or circular ring-like pattern wherein the first substantially oval or circular ring-like pattern has a lesser diameter than the second substantially oval or circular ring-like pattern. Alternatively or additionally, the cable anchoring system may be adapted to selectively move by moving at least one, preferably an even plurality of, other conductor(s) to its or their compensation position(s) as described above, when another conductor is moved to its second position.

In some embodiments, the wellhead platform rests on a seabed, wherein the wellhead platform comprises a double-conductor guide comprising two or more conductor guides, e.g. as described above, where the two or more conductor guides are secured to the main structure and are positioned above each other.

In some embodiments, the wellhead platform comprises one or more conductor separation elements arranged to separate one or more conductors from one or more other conductors.

In some embodiments, the offshore wellhead platform comprises at least one mechanism for moving or deflecting an upper part of a conductor between its first position and its second position and wherein the at least one mechanism for moving or deflecting a conductor is adapted to move, e.g. in response to what certain predetermined criteria specify, conductors either

- within a first area near or at the configurable support structure wherein an extent of the first area is larger than an extent of a second area, the second area surrounding all the conductors at the seabed, or
- within a first area near or at the configurable support structure wherein an extent of the first area is smaller than an extent of a second area, the second area surrounding all the conductors at the seabed.

In some embodiments, one or more of the conductors have varying material properties and/or a varying cross section along the length of the conductor.

In some embodiments, the offshore wellhead platform comprises:

- a mechanism for moving a conductor between a first and a second position where the mechanism is rotatable or movable around the central second position, and/or
- a locking mechanism for securing and/or retaining a conductor at the second position where the locking mechanism is rotatable or movable around the central second position.

In some embodiments, the locking mechanism has a shape generally being a C-shape or U-shape.

Different positions of the upper part, and thereby the upper end, imply that the conductor takes a different curve from the seabed (where the conductor is fixed into after installation) to the upper end in each of these positions. This means that in many embodiments elements (e.g. guides) for engaging below the upper part (but above the seabed) may be required to accommodate or even control the shape of these curves besides the element of the configurable support structure. In U.S. Pat. No. 3,670,507 elements in the form of guides are applied to control the curve of the conductor over the seabed (see e.g. unit 28, 29, 31) albeit in this case during installation of the conductor.

The long-term integrity of a well may depend on the integrity of the various layers of casings and cement or other materials constituting the part of the well comprising the part of the conductor above the seabed. Particular waves may cause long-term fatigue. As moving of the upper part from the second to the first position after completion of a well may introduce weaknesses it may be important to control the curve of the conductor particularly during the well construction and at the same time or subsequently reduce harmonics. Accordingly, in some embodiments, the wellhead platform comprises a support structure comprising the configurable support structure wherein one or more, such as all support elements of the support structure are arranged to provide for two or more conductors, such as all conductors supported by the wellhead platform:

1. the curve of each of said supported conductors conductor above the seabed and below the upper end at said first and/or second position and optionally during movement of the upper part between said first and second position; and/or
2. dampening of harmonics of the part of the conductor above the seabed.

In some embodiments, the support structure comprises one or more support elements for each conductor below the water level (generally, water level is taken to be the mean sea level or the lowest astronomical tide), such as two or more, such as three or more, such as four or more, such as 5 or more, such as 6 or more, such as 7 or more, such as 10 or more.

In some embodiments the support structure comprises one or more support elements for each conductor above water level but below any cellar deck of the platform (within one third of the way from sea level to wellhead or between one third and two thirds or above two thirds of the way) and in some embodiments said one or more support elements are in within the wave height of at least the 10.000 year wave, such at least the 100 year wave. In some embodiments one or more of the support elements are configurable, such as part of the configurable support structure.

In some embodiments, the wellhead platform is arranged so that one or more, such as all, of said support elements have an operational capacity of 1 tons or more, such 5 tons or more, such as 10 tons or more, such as 15 tons or more.

In some embodiments, the support structure provides an curved shape of the supported conductor, such as an S-shaped curve (or another curve with at least two curvatures), in at least the shared second position; in particular, the support structure may cause the conductor to assume or maintain an S-shaped curve. This may be preferable to avoid an angle of the upper end of the conductor (and/or the wellhead mounted on the conductor), i.e. the upper most end of the conductor is substantially vertical and the opening at the upper end is substantially horizontal, which may otherwise weaken the connection to a well processing station such as a high-pressure riser of a drilling station.

One disadvantage of an s-curve is that the load capacity of the upper end of the conductor may be reduced. Accordingly, in one embodiment an arc is preferable. In either case, the load capacity of the conductor (or any equipment installed on the upper end) may be reduced in some embodiments. In some embodiments, the well processing station is arranged to carry at least of the load of components normally loading the upper end of the conductor, such as the BOP of a drilling station. In some embodiments, a BOP support is applied to reduce the load of the BOP on the upper end of the conductor at least partially, preferably by transferring a part of the load of the BOP to the well processing station/system and/or the wellhead platform. For example, active tensioners from a drilling station may be hooked up to the frame of the BOP and carry a part of its weight, such as a predetermined part of its weight. This entire load is normally carried by the conductor and supported by the drilling rig via a tension yoke or pad eyes welded to the conductor connected to tensioners on the rig.

The tension yoke is in some embodiments arranged to allow the upper end of the conductor to rotate which may be preferable to reduce stress induced in the part of the well comprising the conductor pipe above the seabed.

In some embodiments, the wall thickness of the conductor increased to improve the stability of the system. In some embodiments the wall thickness of the conductor are 1" (2.54 cm) or more, such as 1.25" (3.175 cm) or more, such as 1.5" (3.81 cm) or more, such as 1.75 (4.45 cm) inch or more.

In some embodiments, some or all of the elements of the configurable support structure (i) move with the upper part of the conductors (apart from openings in decks), (ii) allow the movement, (iii) work in pairs so that some elements hold the conductors when placed in its first position whereas other elements hold the conductors when placed in its second position, comprise or interact with the mechanism or mechanisms (see below) for moving of the upper parts or (iv) comprise a combination of such elements. Support elements with such mechanism are also referred to as active support elements as opposed to passive.

In some embodiments, some or all of the elements of the configurable support structure (i) move with the upper part of the conductors (apart from openings in decks), (ii) allow the movement, (iii) work in pairs so that some elements hold the conductors when placed in its first position whereas other elements hold the conductors when placed in its second position, comprise or interact with the mechanism or mechanisms (see below) for moving of the upper parts and (iv) comprise a combination of such elements.

To stabilize the x-mas tree (and/or upper end and/or wellhead) in relation to the wellhead platform the upper most support element of the configurable support structure engaging or otherwise supporting the conductor is typically placed relatively close to the upper end of the conductor, at least in the first position. For example, during the production phase where the conductor is typically supported in its first position and the corresponding well is used for its intended purpose for producing from reservoir. In this way, the horizontal position of the cross section of the conductor at this element will typically be relatively close to the horizontal position of the upper end thereby controlling at least partly the position of the upper end. However, depending on the shape of the curve of the conductor the positions may be misaligned to some degree but will typically overlap. Such misalignment is in some embodiments less than 2 meters, such as less than 1 meter, such as less than 75 cm, such as less than 50 cm, such as less than 30 cm.

In some embodiments, the upper most support element of the configurable support structure is a clamp or guide with at least 3 degrees of freedom in respect to rotation. In some embodiments it is a clamp or guide for the conductor may freely rotate. Providing such degrees of freedom may be beneficial to reduce stress induced in the conductor at the first and/or second positions.

For support in the shared second position, a relatively high position of the uppermost support element of the configurable support structure may allow the configurable support structure to control the position at the upper end and align it with the working center. In some embodiments the configurable support structure comprises support elements at two or more elevations which may work in collaboration to control the curve of the conductor and the position of the upper end.

In some embodiments, the configurable support structure comprises one or more elements for supporting, such as engaging with, each conductor within 10 meters of the upper end, such as within 5 meters of the upper end, such as within 3 meters, such as within 2 meters, such as within 1.5 meters, such as within 1 meter. In some embodiments, it is advantageous not to apply force to the conductor too close to the upper end as this may, for example, increase angular misalignment of the upper end relative to horizontal. Accordingly, in some embodiments, the uppermost support element of the configurable support structure is more than 0.5 meter from the upper end, such as more than 1 meter, such as more than 2 meter, such as more than 3 meter, such as more than 4 meter, such as more than 5 meter. As noted above, such elements may e.g. be a guide and/or a deck opening (i.e. a section of a deck defining an opening).

As discussed, a conductor will exhibit bending forces at the first and/or second position. A conductor will exhibit bending forces at the second position whereas the conductor may be in the minimum stress state at the first position. In some embodiments the minimum stress state changes position as casings are added to the well during construction as the second position.

In some embodiments, the bending stress is transferred to the well processing station during processing at the shared second position. In such embodiments, a relatively simple configurable support structure may be applied where the configurable support structure: (i) comprises one or more elements supporting each conductor at its first position, (ii) the configurable support structure allows the upper part to be moved at least from the shared second position to the first position for each conductor, and (iii) the wellhead platform and the configuration of the other conductor(s) defined by the support configuration of the wellhead platform allow such movement at least during establishing of the wells. In one such embodiment, the configurable support structure is formed by a section of a deck with an opening for the conductors to extend through and where the opening allows the respective movements of the upper parts and where each conductor is supported at least at their respective first positions. The support at the first positions is typically provided by a guide or other type of element for confining the conductor to the first position. Such a guide may be embedded in the deck or at an adjacent level and be suitable for either moving with the upper part, receiving the conductor as the upper part is moved to the first position or be installed in the configurable support structure when the conductor is brought to its first position. In some embodiments, the deck itself is omitted and the support elements for the first positions are, as an example, set up in one or more frames. In some embodiments the movement of the respective upper parts is allowed at least during construction of the wells in sequential order in which case a positioning of one well in its first position may be allowed to block a previously constructed well from moving its upper part from its first to the second position. However, as a well processing station is typically placed over the wellhead platform, it may impose a significant vertical force component on the conductor if its vertical tensioners (or other pulling device) is applied to hold a conductor in is second position e.g. by connecting to the conductor using a cable and/or a tension yoke. Particularly, in the early stages of the well construction where few (if any) components of the well are cemented into the ground, there a risk that this vertical force component may pull the conductor out of the ground. It may therefore be preferable to transfer the horizontal load via a support element on the wellhead platform.

In many embodiments, the forces due to bending of the conductor are preferably transferred to the wellhead platform in the first and/or second position of the conductor. Accordingly, the configurable support structure typically comprises one or more elements for engaging with each supported conductor and for transferring such forces to the structure and the wellhead platform and thereby locking the conductor in the respective position. In some embodiments, the conductor is in its minimum stress state at the first position and the configurable support structure may then support the conductor according to normal methods in the art such as with the typical tolerances used in the art for decoupling vibrations as discussed above. However, due to the well being constructed in the shared second position bending stress is often present at the first position. In some embodiments, support element that support the conductor in a bend state (e.g. in the first or second position) will in some embodiments experience a mean load (and is arranged to transfer this load to wellhead platform) due to bending stress in the order of 0.1 ton or more, such as 0.3 ton or more, such 0.5 tons or more, such as 1 ton or more, such as 5 tons or more, such as 10 tons or more, such as 15 tons or more, such as 20 tons or more, such as 35 tons or more, such as 50 tons or more.

As exemplified above, in some embodiments, at least some of the elements of the configurable support structure are placed in relation to one or more decks or other horizontal structure. This may be advantageous as the structure holding the elements may also provide structural strength to the wellhead platform. For example, in some embodiments the configurable support structure comprises a deck (or frame) comprising elements (for each conductor it supports) for engaging with a conductor below the upper end to lock (i.e. at least guide the conductor) the upper part in the first and/or second position of the conductor. The deck or frame also comprises an opening allowing the movement of the upper part. In some embodiments, the configurable support structure supports the conductor between first and second position. For example, where one or more elements supporting the conductor are movably attached to the rest of the configurable support structure. This may also be the case where the elements supporting the conductor are applied to cause the upper part to move.

In some embodiments the configurable support structure comprise several frames or decks (or sections thereof) with elements distributed vertically and working in collaboration to support one or more conductors with support elements at different elevations. In many embodiments, such frames or decks are arranged in relation to the topside of the wellhead platform but one is part of the leg structure or jacket. In some embodiment it is advantageous to apply force for moving of the upper part below the upper most support element of the configurable support structure. Accordingly, in some embodiments the configurable support structure comprises support elements at a first deck below the upper end (e.g. the wellhead deck or cellar deck) and further comprises a second deck below the first deck comprising at least part of a (such as the complete) mechanism for at least partly causing a movement of the upper part between a first and second position (also referred to as a movement mechanism) such as by causing a guide element to move and thereby pushing on the conductor. In one embodiment the first deck (and/or one or more further decks below the second deck) comprises such a mechanism or part thereof as well. Here the part of the mechanism may e.g. be sheaves and/or pulleys for allowing an external or portable device (e.g. a winch) to provide the necessary force. Once in position the conductor may be locked at the position.

In some embodiments mechanisms (or parts thereof) for moving a conductor between its first and second position (such as all such mechanisms or parts thereof) are arranged at one level, such as the level (e.g. in or on the same deck) of the upper most support element of the configurable support structure for that conductor, such as at a wellhead deck or cellar deck. In such embodiments it may be preferable to find a suitable compromise between supporting the wellhead and x-mas tree by providing support close to the upper end and not applying force too close to the upper end. Accordingly, this level is in some embodiments more than 1 meter below the upper end, such as more than 2 meters, such as more than 3 meters but less than 15 meters, such as less than 10 meters, such as less than 9, meters, such as less than 8 meters, such as less than 7 meters.

In some embodiments, there is a deck or mezzanine deck provided between any movement mechanism and the wellhead. This allows safe access to operate the wellhead while shielding the wellhead from operations of the movement mechanisms.

The provision of mechanisms (e.g. as mentioned above) at multiple levels allows control of the shape of the curve of the conductor at the first and second positions and/or provide redundancy. Generally, discussions referring to arrangement of the wellhead platform in relation to support of a single conductor may be expanded so that wellhead platform supports to two or more, such as all, conductors supported by the configurable support structure in this way.

The vertically distributed elements may also be arranged to support different conductors or different groups at each elevation. The configurable support structure may for example comprise one or more mezzanine decks (e.g. for access to a wellhead installed on the conductor) with an opening that allows the movement of the upper part, just below the upper end of the conductors, extending through this deck. The configurable support structure may then further comprise elements in a frame or deck (such as at the cellar deck of a topside of the wellhead platform) below the mezzanine deck, for locking (i.e. holding the bent conductor) and/or causing the upper part to move.

The provision of support elements at multiple levels may allow (i) control of the shape of the curve of the conductor at the first and second positions, (ii) load sharing and/or (iii) redundancy. Preferably, the failure of one guide will not cause the conductor to move unintentionally.

Since the wellhead and x-mas tree may each be several meters high and require access at various heights, the wellhead platform may further comprise one or more decks for providing access at such heights and/or support equipment connected to the wellhead or x-mas tree. As the wellhead or x-mas tree (or another component installed on the conductor) may extend through such decks and moves with the upper part of the conductor, such a deck(s) is in some embodiments configured to allow the movement of the upper part of the conductors. For example, a tree access mezzanine deck may be aligned with the upper end of the wellhead and this deck is in some embodiments arranged to provide an opening to allow movement of the wellhead (and the x-mas tree above) as he upper part of the conductor is moved between the first and second position. As mentioned below, deck plates or the like may be installed to allow people to work on safely on such decks and/or any deck of the configurable support structure. In some embodiments, the conductor is intended to remain in the first position. Accordingly, such access decks may be installed subsequent to completion and movement of the upper part to a first position in which case such openings as described above may not be required.

In some embodiments, one or more of such mezzanine decks are installed after completion of the wells in which case the movement may be restricted by the deck. In the event that movement of the upper part of the well is again required, the deck may for example be removed to allow the movement again.

It is noted that the configurable support structure may also be formed by elements distributed vertically without relation to specific deck structures or frame but otherwise connected to the wellhead platform.

In the present context, the configurable support structure is mainly discussed in relation to embodiments having an opening in a deck and further support elements supporting the conductor in the deck or adjacent this deck. As noted above, the configurable support structure preferably comprises a guide or locking device or similar constraining element relatively close to the upper end. The configurable support structure may also comprise deck inserts so that a convenient deck is provided when one or more parts of an opening in a deck is/are not in use. Such elements also act as part of a support element and form part of a guide or locking mechanism. While the elements described and shown in respect of various embodiments may form the entire configurable support structure it is to be understood that they are in many embodiments only a part of the configurable support structure as this often comprises further elements above and/or below the deck described or shown.

The configurable support structure is generally a part of the wellhead platform suitable for supporting conductors. Accordingly, when a configurable support structure is said to comprise a conductor at a particular position this refers to a situation after installation of the conductor where the configurable support structure is suitable for supporting the conductor in that position. For wellhead platforms which are generally divided into a topside and leg structure (e.g. a jacket or column) the configurable support structure may be part of the topside, leg structure or both.

In some embodiments, the offshore wellhead platform comprises at least one mechanism for moving (also referred to as a moving mechanism) the upper part of conductor between its first position and its, e.g. shared, second position. The mechanism(s) may form part an of active support elements of the configurable support structure. This mechanism could e.g. be mechanical or hydraulic push or pull, a rack and pinion drive, winch-wire, or any other suitable mechanisms moving an upper part of the conductor between the first and second position. In some embodiments the mechanism is simply a wire or chain based system where winches or similar machines for pulling are brought to cause an upper part of a conductor to move e.g. via one or more sheaves installed on the wellhead platform. In some embodiment the mechanism requires the well processing station to provide the force (e.g. from a winch or hoisting system) and cable and sheaves on the platform are arranged to translate this force into a move of the upper part of a conductor. Such systems may provide a cost effective way of implementing the invention as the machines for moving the upper part can be used on the several wellhead platforms.

In some embodiments, a substantially minimum bending stress state of a conductor is at a predetermined position for the conductor that is

- located between the first and the second position of the conductor (e.g. closer towards the second position or substantially midway),
- located substantially at the second position of the conductor, or
- located substantially at the first position of the conductor.

In the present context and throughout the description and accompanying claims, a cluster is a grouping of a plurality of first positions for which the configurable support structure supports and enables or facilitates moving an upper part of a conductor between each of the first positions of the cluster and one or more shared second positions where each of the shared second positions is shared by all first positions of the cluster. In some embodiments, one or more first positions are reachable by two or more, such as all, conductors in a cluster so that the upper end may be placed in any of the reachable first positions of the cluster. I.e. a conductor may be moved between all (reachable) first positions in a cluster and a conductor can be moved to the shared second position(s) of the cluster from all (reachable) first positions of the cluster. In some embodiments, a cluster is to be understood as being associated with at least one shared second position or working center zone. A first position may e.g. be part of more than one cluster. A conductor of a cluster at a first position may e.g. be movable to a shared second position or working center zone of another cluster.

Accordingly, in some embodiments, the plurality of conductors are arranged or organized in at least a first cluster by two of more conductors sharing a shared second position. In some embodiments, the wellhead platform supports a second cluster by being arranged to support (at least in their respective first positions) a plurality of conductors having a another shared second position thereby forming a second cluster for which the wellhead platform allows moving an upper part of a conductor from each of a plurality of first positions of the upper ends of the two or more conductors of the cluster to the another shared second position. Typically, the wellhead platform will also support the conductors of the second cluster in their shared second position. The plurality of conductors having the another shared second position may comprise one or more conductors that may also be moved to and/or from the shared second position of the first cluster. However, in some embodiments none of the conductors, having the another shared second position of the second cluster are movable to or from the shared second position of the first cluster.

In some embodiments, the plurality of conductors are arranged or organized in at least two clusters, wherein each cluster comprises at least one (e.g. a plurality) first position and at least one (e.g. a plurality of) shared second position. There is a movement path between each first position of a cluster to the shared second position of the cluster, i.e. a conductor can be moved between the shared second position of a cluster and any of the first positions of said cluster. In some embodiments, each cluster (at least when performing a well processing task) is associated with its own at least one well center of an offshore drilling rig.

Multiple clusters, each with an associated shared second position at a working center or working center zone, allows for effective parallel operation where multiple well processing stations may be brought to work on each well in the cluster (by moving the upper end of the corresponding conductor to the shared second position of the cluster) with little or no dependence on which well that is worked on by the other well processing station. Accordingly, in some embodiments the two or more conductors are four or more conductors arranged in a first and a second cluster wherein the wellhead platform is arranged so that the first cluster may be associated with a first well processing station of an offshore well processing system and the second cluster may be associated with a second well processing station, such as the first and second well processing stations of the same offshore well processing system.

In some embodiments, two or more clusters are connected to allow at least one conductor to be moved between a number of clusters, such as between the first and second cluster mentioned above.

In some embodiments, at least some of the plurality of conductors are arranged or organized in at least one cluster comprising at least two-second positions.

In some embodiments, a plurality of first positions and one or more second positions are arranged or organized in a pattern or arrangement with at least one shared second position of the conductors (and thereby also of their respective upper ends) being located substantially (within certain tolerances) centrally relative to the respective first positions and where the first positions are located around the shared second position(s) in a substantially circular or oval pattern, i.e. horizontally encircling the shared second position of the upper ends in a substantially circular or oval pattern.

In some embodiments, the first positions of the upper ends are provided according to an arrangement so that each first position of the upper ends has a substantially same distance to its immediate neighbors. In embodiments where the first position is a production position, this may mean that the wellheads are laid out in a grid. In alternative embodiments, this may mean that the conductors are equidistantly located around one or more central (shared) second positions in a substantially circular pattern.

In some embodiments, the first positions and the shared second position of upper ends are provided according to an arrangement where the shared second position is provided substantially centrally and the first positions are divided into two parallel lines on different or opposing sides of the shared second position.

In some embodiments, the plurality of conductors are arranged or organized in at least one cluster with at least one shared second position of the conductors, and thereby also of their respective upper ends, being located substantially centrally in relation to their respective first positions and having at least one first position for the upper ends being located at a first side of the second position and at least one other first position for the upper ends being located at a second side of the second position where the first and second sides are different and e.g. opposing. A shared second position of the upper ends of conductors arranged in a cluster is referred to as the second position of the cluster.

In some embodiments, the plurality of conductors are arranged or organized in at least one cluster with at least one shared second position of their respective upper ends located substantially centrally from their respective first positions wherein a first part of the plurality of first positions of the upper ends of the conductors has a substantially same first distance to the shared second position and wherein a second part of the plurality of first positions of the upper ends of the conductors has a substantially same second distance to the shared second position where the first distance is different to the second distance.

In some embodiments, the offshore wellhead platform comprises a plurality of clusters of conductors as described above, e.g. a plurality of clusters where conductors of each cluster are arranged in one of the arrangements described above. In some embodiments, all clusters have the same geometric arrangement while, in other embodiments, the geometric arrangement may vary from cluster to cluster.

In some embodiments, the configurable support structure supports one shared second position and four, six, eight, nine, ten, or twelve first positions. In particular, the configurable support structure may support one shared second position for four, six, eight, nine, ten, or twelve conductors each having a first position.

In some embodiments, the offshore wellhead platform further comprises one or more blow-out-preventer components or units to which one or more wells may be connected.

In some embodiments, the configurable support structure provides a single first position and a single second position.

In some embodiments, the configurable support structure for supporting an upper part of a plurality of conductors may be movable and/or rotatable.

According to another aspect, disclosed herein are embodiments of a method of constructing and/or processing one or more offshore surface wells, the method comprising constructing and/or processing multiple offshore surface wells from a single work center position by moving a conductor to and from the single work center position.

In some embodiments, the method comprises progressing a plurality of surface wells towards completion by

- moving a conductor from a first position to a second position and carrying out one or more well constructing and/or processing tasks to complete the surface well of the conductor,
- moving the conductor to a first position after completion, and
- repeating these steps for one or more additional conductors.

In some embodiments, the method further comprises applying one or more counter forces by at least one support element when moving a conductor from a first position to a second position, the one or more counter forces reducing the impact of a movement force on the main structure, where the movement force is a force acting on the conductor due to the conductor being moved between a first and a second position.

In some embodiments, the method comprises applying one or more counter forces by moving at least one, preferably an even plurality of, other conductor(s) to one or more compensation position(s) when the conductor is moved to its second position.

According to another aspect, disclosed herein are embodiments of a method of constructing and/or processing one or more offshore surface-wells, the method comprising constructing and/or processing an offshore surface-well through a well center of a well processing station, the surface-well comprising a conductor having an upper part including an upper end, and said method comprising the steps of 1. constructing and/or processing the surface-well through the upper end of the conductor at a second position,
2. moving the upper end of the conductor to a first position of the conductor, and 3. producing from or injecting into the surface-well through the upper end of the conductor at the first position.

This moves the upper end of a well to the well center and subsequently to a first position instead of moving the well center and well processing station, thus saving valuable time. Other advantages include the use of the method to overcome restrictions in reach of the well processing station and the potential for efficient parallel operation.

One or more further wells may be constructed or otherwise processed via respective conductors, for which the second position is a shared second position and without lateral displacement of the well processing station or its well center, by performing step 1 (after having moved the preceding conductor away from the second position, e.g. performing step 2 for the previous conductor). Subsequently that conductor may be moved to its respective first position (step 3). This enables processing multiple wells without re-positioning the well center and the well processing station.

In some embodiments, the invention relates to a method of constructing and/or processing one or more offshore surface-wells. The method comprises constructing and/or processing an offshore surface-well from a working center position, said method comprising the steps of 1. at least partially constructing and/or processing the surface-well through a conductor at the working center position,
2. moving (after the at least partial construction and/or processing has been executed) the conductor to a first position, and
3. producing from or injecting into the surface-well through the conductor at the first position.

In some embodiments, the method comprises using at least one offshore wellhead platform as disclosed herein and wherein the second position of one or more conductors in a plane (such as at the upper end) coincide with the work center position.

In some embodiments, the working center position coincides with the second position of the upper end and wherein the second position of the upper end of at least some, e.g. all, of a plurality of conductors of a plurality of surface-wells is the same and wherein the first position of the upper end of at least some, e.g. all, of the plurality of conductors of surface-wells are different at least from some of the plurality of conductors.

In some embodiments, the method comprises progressing a plurality of surface-wells towards completion by optionally moving a conductor from a first position to a second position, carrying out one or more well processing tasks to complete the surface-well of the conductor, moving an upper part of the conductor to a first position after completion, and repeating these steps for one or more additional conductors.

In some embodiments, the invention relates to a method comprising progressing a plurality of surface-wells towards completion by optionally moving an upper part and thereby the upper end, of a selected one conductor of a surface-well, from a first position to a shared second position of the upper end and carrying out one or more well constructing and/or well processing tasks through the upper end of the selected one conductor to at least partly complete the surface-well of the selected one conductor, moving the upper end of the selected one conductor from the shared second position of the upper end to a first position of the upper end after at least partly completing the surface-well, and repeating these steps for one or more additional conductors.

In some embodiments, the method comprises progressing a plurality of surface-wells towards completion by optionally, moving a conductor from a first position to a second position, carrying out at least one well constructing and/or processing task and/or sub-task at the second position of a conductor, moving an upper part of the conductor from the second position to a first position after completion of the at least one well constructing and/or processing task and/or sub-task, repeating these steps for a desired number of conductors, and when the at least one well constructing and/or processing task and/or sub-task has been completed for all the desired number of conductors then repeating these steps for at least one next well constructing and/or processing task and/or sub-task until all desired constructing and/or processing tasks and/or sub-tasks have been carried out for all desired conductors.

In this way, efficiency is increased (due to moving an upper part of the conductors instead of moving the well center and well processing station) for batch drilling or batch processing of a plurality of wells carrying out a group of one or more tasks and/or sub-tasks at a time on all the relevant conductors. The conductors need not necessarily be completed or progressed to the same extent, although they often will be.

In some embodiments, the method comprises progressing a plurality of surface-wells towards completion by moving an upper part of a selected one conductor of a surface-well from a first position of the upper end to a shared second position of the upper end and carrying out at least one well processing task, moving the upper end of the selected one conductor from the shared second position of the upper end to a first position of the upper end after completing the at least one well processing task, repeating these steps for a number of conductors, and when the at least one well processing task have been completed for the number of conductors then repeating the steps again for at least one subsequent well processing task. This readily provides improved (due to moving conductors instead of moving the well center and well processing station) batch drilling.

In some embodiments, the method comprises performing concurrent or parallel drilling or one or more well processing tasks on at least two wells located at separate second positions of the upper ends (e.g. in the same or different cluster). In other words, the method comprises performing concurrent or parallel drilling or well processing through the upper end of the conductor of at least two surface-wells located at separate second positions or at separate shared second positions.

In some embodiments, the method comprises performing drilling or well processing on a well located at a first shared second position, followed by moving the upper part of the conductor and wellhead to a second shared second position and performing drilling or well processing on the well when located at the second shared second position. This facilitates a 'factory line' or serial well processing procedure.

In some embodiments, the method comprises constructing and/or processing at least one well through a well center and then displacing the well center (e.g. using a cantilever of a drilling unit) and subsequently constructing and/or processing at least one well through the displaced well center. This allows even more wells to be processed by displacing the well center (and e.g. the well processing station) but still provides time savings.

In some embodiments, the method comprises constructing and/or processing at least one well at at least one second position at a working center zone and, after a number of wells have been completed and/or processed and moved to respective first positions (then e.g. denoted regular first positions) outside the working center zone, then constructing and/or processing at least one well at first positions (then e.g. denoted additional) in the working center zone at or near the at least one second position. Similarly, in some embodiments, the method comprises performing at least one well processing task through at least one conductor at at least one shared second position in a working center zone and after the at least one well processing task have been performed through a number of conductors and the number of conductors have been moved to respective first positions outside the working center zone then performing at least one well processing task through at least one additional conductor in the working center zone at or near the at least one shared second position.

Generally, upon installation of the conductors at the various embodiments of the wellhead platform described herein, the conductor guides or other support elements of the configurable support structure are brought into engagement with the conductors. This may be done in a variety of ways.

In some embodiments of the installation process, the conductors are installed at their respective first positions. In some embodiments, a drilling station or other well processing station or a crane that can be repositioned to operate above the respective first positions may be utilized for installation of the conductors. Alternatively or additionally, the installation of at least parts of the conductors may be done after installation of at least a part of the top side. In this case, the installation of conductors, or of parts thereof, may be performed through hatches in the top side over the first position. The installation of at least parts of the conductors into the configurable support structure may e.g. be performed prior to installation of the top-side of the wellhead platform, such as a section of a conductor installed and of sufficient length so that the configurable support structure may align the upper end of the pre installed section with the second position of the upper end and/or the drilling center position. This allows the well-processing system, such as a jack-up rig, to continue the installation process once the platform is installed by making up further section(s) of the conductor to the pre-installed section and progreesing this assembly into the seabed e.g. by hammering. The pre-installed section and the wellhead platform is preferably arranged so that when the well processing station progresses the conductor assembly its lowermost end will be guided by lowest support element of the platform (e.g. a template at or near the seabed). Preferably, the pre-installed section is long enough so that it is pre-installed into these support element or at least aligned with them. This means that the conductor will be installed while the configurable support structure imposes a curve in the conductor (e.g. in an s-curve) as opposed to a straight pipe which is the conventional situation.

In other embodiments, the conductors may be installed at the second position and the installed conductor may then be moved to its first position so as to make room for the installation of a subsequent conductor at the second position. In particular, when the conductor is installed via the second position, the conductor may be guided to the intended lower support element at or near the seabed using the configurable support structure.

In some embodiments, the installation may be performed at the offshore site, i.e. after at least a portion of the wellhead platform has been positioned at the offshore site, e.g. after the legs and/or subsea support structure of the wellhead platform has been installed.

In other embodiments, the installation of the conductors may be partly performed prior to positioning the wellhead platform at the offshore site and partially at the offshore site, i.e. after at least a portion of the wellhead platform has been positioned at the offshore site, e.g. after the legs and/or subsea support structure of the wellhead platform has been installed.

In particular, in some embodiments, the lowermost sections of the conductors may be pre-installed prior to installing the wellhead platform at the offshore site. For example, this pre-installation may be performed at the yard building the platform. During this pre-installation, the lowermost sections of the conductors may conveniently be coupled to at least some of the various conductor guides or other support elements of the configurable support structure of the wellhead platform. The lowermost sections that may be pre-installed in this manner may have a length corresponding to the height of the platform above the seabed.

Once the wellhead platform (or at least a part of the wellhead platform) is positioned at the offshore site, the remaining upper sections of the conductors may be installed, either at the first positions or at the second positions as described in connection with the previous embodiments.

For example, an upper end of a pre-installed conductor section may be moved to the second position from which a drilling station or other well processing station may connect further conductor sections and drive the conductor into the seabed.

In some embodiments, the invention relates to an offshore well processing system for performing one or more well processing tasks on a plurality of surface-wells of one or more off-shore reservoirs located below a seabed wherein the offshore well processing system comprises or works together with an offshore wellhead platform according to one or more of the embodiments described herein and comprises at least one or more well processing stations (such as a drilling station).

In some embodiments, the offshore well processing system comprises at least one mechanism for moving an upper part of a conductor between a first position and a second position.

In some embodiments, the offshore well processing system further comprises one or more blow-out-preventer components or units to which one or more wells may be connected, typically by connection to the wellhead of a conductor as a part of constructing a well through the conductor or as a part of performing other well processing tasks on the well.

In some embodiments, the offshore well processing system comprises at least two well processing stations, wherein the well processing stations are adapted to operate fully independently of each other. This independence may then be used to operate with the processing stations each working on a shared second position, such as a first shared second position and a second shared second position for the case with two well processing stations.

In some embodiments, the well processing system is adapted to move an upper part of a conductor into a second position to vertically align its upper end with a well center of a well processing station of the well processing system. In this way, the mechanism for moving an upper part of a conductor may be at least partly placed off of the wellhead platform thereby allowing for a simpler platform design.

In some embodiments, each of the at least two well processing stations comprises its own fluid system and well control system. Typical examples of fluid systems for well processing tasks includes mud and brine systems suitable for well control and well completions.

According to another aspect, there is provided a use of an offshore wellhead platform as described throughout the present description to perform batch drilling.

A second position may be used—e.g. after one or more wells have been completed at the second position—to complete one or more additional wells, e.g. such additional wells will have first positions overlapping fully or partly with the second position(s) in question or a zone or area around the second position(s). In this way, the working center zone providing shared second positions for a number of conductors is blocked (after completion of their respective wells) by installing one or more conductors. This has the advantage that the wellhead platform may support more wells. Intervention or other well processing tasks performed after completion of the well may e.g. be carried out on wells at respective first positions (as well as wells at respective second positions).

In the present context and throughout the entire description and accompanying claims, an offshore wellhead platform is to be understood as a structure or structures configured for supporting a plurality of conductors (once installed with the wellhead platform) and a plurality of surface-wells, i.e. typically the respective x-mas tree mounted on the conductor (once established). More particularly, the offshore wellhead platform is configured for supporting at least the wellhead and the upper parts of a number of conductors (one upper part and typically one wellhead for one conductor). While it is preferable that the x-mas tree is substantially fixed during production it may be advantageous to allow some relative motions of the upper end, wellhead, and/or x-mas tree when an external well processing system engages with the conductor or wellhead due to potential relative motions between the well processing system and the wellhead platform.

Typically, a wellhead platform mainly provides horizontal support, in the sense that it may absorb or transfer horizontal forces or otherwise limit the relative motion between the conductor and wellhead platform, whereas the conductor supports all or most of its vertical weight. In some embodiments the support element, the configurable support structure and wellhead platform is arrange to withstand a horizontal force from the conductor corresponding to 1 ton or more, such as 5 ton or more, such as 10 ton or more, such as 20 ton or more, such as 30 ton or more, such as 40 ton or more, such as 50 ton but will typically not see loads of more than 120 tons, such as less than 100 tons, such as 75 tons. Due to the relatively high stiffness of a conductor and a wellhead, an x-mas tree is typically sufficiently supported by the wellhead platform engaging with/or guiding the conductor at one or more locations below the upper end of the conductor without engaging with the x-mas tree directly to transfer horizontal forces. The same is true of the wellhead, upper part, and upper end. The offshore wellhead platform may be configured for engaging with or guide the conductors at a number of appropriate (lengthwise) locations and may support the conductors in one or more suitable ways, such as (i) the conductors leaning or resting against a part of the offshore wellhead platform, (ii) the offshore wellhead platform providing horizontal support for the conductors, and (iii) any combinations thereof.

Throughout the description and accompanying claims, unless expressly stated otherwise, movement of a conductor is to be taken as moving the wellhead (and thereby the upper end) and/or the upper end (without a wellhead attached). A conductor in this context is (once installed) substantially fixed at or near the seabed. Typically, movement of the conductor is limited to movement of the part of the conductor that is located above the seabed or even limited to movement of the upper part of the conductor where the position of the conductor at the seabed remains fixed. Upper part (such as the upper end) of the conductor is to mean the part of the conductor where a well processing station or drilling station (see e.g. 410 in FIGS. 3 and 8) will connect to the conductor (when performing one or more well processing tasks) and where a production tree (also referred to as x-mas tree) and wellhead are installed or to be installed. The upper part of a conductor refers to a portion of the conductor above the seabed that includes the upper end and that may extend from the upper end downwards.

The upper part of a conductor may include a part of the conductor that is received by or extends through one or more decks immediately below the upper end such as (depending on the configuration of the platform) a wellhead deck, wellhead access deck and/or cellar deck of the wellhead platform. Depending on platform configuration wellhead deck may also be referred to as wellhead platform deck, cellar deck. The upper part of a conductor may in addition or alternatively include a part of the conductor that is received by a deck (when present) being located beneath the wellhead deck, such e.g. a cellar deck.

The upper part moves as the conductor is moved between a first and a second position of the conductor. The upper part is supported by the platform via one or more support elements (e.g. guides or locking elements) of the support structure either engaging with the conductor or otherwise limiting the range of motion of the conductor. The one or more support elements of the support structure may engage with the conductor at the upper part or at one or more points below the upper part. In some embodiments, the upper part is the upper (most) end where the opening of the conductor for receiving components for the well (such as a wellhead) is located. In some embodiments, the upper part extends below the upper end, such as the part of the conductor below the upper end where the shape of conductor remains substantially constant as the conductor is moved between positions. In some embodiment the upper part, extend below the upper end of the lowest element of the support structure that is configurable. In some embodiments the upper part extends below the upper end and extends to and includes the portion supported by the uppermost element (such as a guide e.g. through a deck such as a wellhead deck or cellar deck) for supporting the conductor at the first position. Such element is typically placed relatively close to the upper end in order to provide sufficient support for the wellhead and x-mas tree. In some embodiments, the upper part further extends to and includes the elevation of the lowest mechanism for causing (either solely or alone) a movement of the conductor between a first and second position and/or to the elevation of the lowest configurable support element.

In some embodiments, the upper part extends 50 meters below the upper end or less, such as 40 meters or less, such as 30 meters or less, such as 20 meters or less, such as 10 meters or less, such as 5 meters of less, such as 2 meters of less, such as 1 meter or less, such as 50 cm.

The upper end and the upper part for movement purposes as described throughout is to be regarded as the present upper end and upper part, respectively, when movement takes place. So if an upper part of a conductor e.g. is cut away during operation, the resulting new upper end and new upper part will be regarded as the upper end and upper part, respectively, in relation to subsequent movement. In some embodiments the upper end and part corresponds to the upper end/part during the production phase. However, in some embodiments the upper end is regarded as the position at which the conductor receives a wellhead.

Accordingly, movement of and upper part of a conductor may involve moving the present upper part and upper end followed by cutting away a part of the conductor whereby subsequent movement of the conductor will involve movement, as described, for the new upper part and new upper end of the conductor. It is to be noted, that the old upper part may, and typically will, overlap with the new upper part whereas the new and old upper end will be different.

Moving the upper part of the conductor will typically also move a part of the conductor being lower than the upper part (but above seabed level) but to a lesser degree as the conductor (once installed) typically is fixed at or near the seabed (see e.g. FIG. 1 for a schematic illustration) typically via one or more of the lowermost support elements. While the conductor will typically not move below the seabed, the upper most layers of seabed may in some instances be soft and allow slight movement. Typically, a conductor will be guided by a template or guides of the wellhead platform close to the seabed, which will restrict movement below it.

In the present context and throughout the description and accompanying claims, movement of a part of conductor is to be understood to include movement of any well components installed in the conductor such as such as casings or tubulars (even when/if cemented.

In the present context and throughout the entire description and accompanying claims, a well processing task is to be understood as one or more tasks for construction, manipulating, production, maintaining, and/or data gathering of or for at least one surface well being performed on or for the well(s) and/or through or for one or more conductors. In some embodiments, a well processing task comprises lowering one or more tools into the conductor, such as into a casing string enclosed by the conductor. Examples of such tools comprise drilling equipment such as a drill bit, drill string, cementing tools and wire line tools. In some embodiments, a well processing task comprises lowering components of the well to be installed such as a casing sleeve or coiled tubing. In some embodiments, lowering refers to lowering to the bottom of the well or at least into a reservoir of hydrocarbons.

Examples of relevant well processing tasks include one or more selected from the group of drilling, extraction e.g. of gas or oil, production, injection, well-intervention, workover, progressing a well at least partly towards completion, constructing a well and/or any other suitable construction, manipulation, producing from the well, maintenance, data gathering tasks, and any combinations thereof.

A well processing task may e.g. be or include one or more well processing sub-tasks or sub-steps.

In the present context and throughout the entire description and accompanying claims, constructing a well is to be understood as the process of performing one or more well processing tasks for establishing a well. Typically this means progressing a surface well at least from having a conductor being installed into the seabed to a state where the conductor comprises a valve assembly or production tree and a wellhead being located above the water level and where the conductor is supported by a wellhead platform.

In the present context and throughout the entire description and accompanying claims, processing a well is to be understood as performing one or more well processing task on or for the well.

In the present context and throughout the description and accompanying claims, a well processing station is understood as any equipment or system placed on or over the platform adapted to perform at least one well processing task on one or more surface-wells (one at a time). An example of a well processing station is a drilling station (also referred to as a drilling rig or drilling system) such as a drilling derrick including the equipment for handling tubulars, well control, and rotating the drilling string, such as the drilling station including a well center placed over the platform on the cantilever of a drilling unit. Typically, a drilling station comprises a lifting system for lifting tubulars in and out of the well center with a capacity of 250 tons or more than 250 tons, such 500 tons or more, such as 750 tons or more, such as 1000 tons or more. Another example of a well processing station is a system for running coiled tubing into the well.

In the present context and throughout the description and accompanying claims, an offshore well processing system (or simply well processing system) is to be understood as a system comprising one or more, e.g. two, well processing stations. In some embodiments, the offshore well processing system provides support systems for the well processing station(s) such as marine systems and floatation. Examples of an offshore well processing system include a mobile offshore drilling unit, a jack-up drilling unit (also referred to simply as jack-up unit), etc. In some embodiments, an offshore well processing system is to be taken as a system for constructing, manipulating, maintaining, and/or data gathering of or for a well such as a well construction system, plug-and-abandonment system, work-over system, intervention system. In some embodiments, a well processing system may comprise a wellhead platform as disclosed herein, e.g. as a platform structurally coupled to a mobile offshore drilling unit or as a wellhead platform that is positioned next to and cooperates with a mobile offshore drilling unit.

In the present context and throughout the entire description and accompanying claims, working center position, work center position, or simply work(ing) center, of the wellhead platform is to be understood as a position for which the wellhead platform is arranged so that the well center of a well processing station may be placed over or on the wellhead platform to perform well processing tasks through an upper end of one or more conductors (supported by the wellhead platform). For a cluster of conductors (see below) arranged in relation to a (shared) second position (or a zone of (shared) second positions), the upper end of the conductors are arranged to be aligned with a well center when the conductor is in its second (shared) position thus defining a working center position for the wellhead platform. In some embodiments, the working center position is the vertical projection of the well center of a well processing station. The working center position may also be referred to as work center position or simply work center. Moreover, in particular in the context of drilling, a working center position may also be referred to as drill(ing) center position or drill(ing) center.

In the present context and throughout the description and accompanying claims, an offset zone refers to the function of a working center position extended into an area (defined in a horizontal plane) where the wellhead platform is arranged so that a position (typically any or substantially any position) within the offset zone may be applied as a working center position. Accordingly, in some embodiments the configurable support structure is configured such that the shared second position may be selectively located/chosen within a predetermined offset zone, in particular within a horizontal offset zone having a width and a length. In particular, the configurable support structure may be adapted to allow or even cause a conductor to be selectively positioned at a plurality of shared second positions, the plurality of shared second positions defining an offset zone. In this way, the upper end of a conductor may be moved from a first position to any position within the predetermined offset zone to allow alignment of the upper end with a well center of a well processing system. This flexibility is in many embodiments required due to the limited accuracy with which a drilling unit or other well processing unit may be placed next to the wellhead platform. In some embodiments, the offset zone is defined by the configurable support structure defining a range of shared second positions for the upper ends of the conductors in a cluster so that the upper end of each conductor can be provided at any position within this zone. In some embodiments, the offset zone defines possible shared second positions of the upper ends of conductors in a cluster and further defines a corresponding zone of second positions of upper parts in a horizontal plane below the upper end, such as at a wellhead deck, wellhead access deck or cellar deck. Typically, this corresponding zone of second positions of upper parts corresponds substantially with the offset zone. Often such units provide flexibility in how far a cantilever is extended so that the offset zone is required to be larger in one direction to accommodate the sideways precision in placing the unit.

In some embodiments it is possible to place a well processing unit sufficiently accurately, or sufficient flexibility is provided by the unit (e.g. via a slidable well center) so that an extended offset zone is not needed. In these cases, the offset zone is the same as the working center position. This may also be the case when the well processing system is placed on the wellhead platform in a way so that it can be positioned with sufficient accuracy. In general, the configurable support structure is arranged in respect of planned positions of well centers. Accordingly, the position of a well processing station is in general equivalent to the well center.

During the performance of a well processing task, the conductor may be influenced by the motions of the well processing unit. The platform and well processing unit may be subject to different motions due to wind, waves and currents. Accordingly, this may impose relative motions between the conductor and the wellhead platform. To allow for such motions, the offset zone is in many embodiments surrounded by an additional safety zone so that a conductor, when operated at a second position with the upper end aligned with a well center, will not clash with the wellhead platform or other conductors. The combination of offset zone and safety zone is referred to as the working center zone. Hence, in some embodiments, the offshore bottom supported wellhead platform defines a working center zone, where the working center zone comprises an offset zone to accommodate for tolerances when positioning an offshore well processing system to perform one or more well processing tasks through an upper end of at least a selected one of the two or more conductors supported by the configurable support structure, e.g. where the working center zone further comprises an additional safety zone to safely accommodate any effects of weather on equipment during well construction. In the absences of a safety zone, the working center zone corresponds to the offset zone. In some embodiments, the configurable support structure is configured such that the shared second position may be selectively located/chosen within a predetermined working center zone. In some embodiments, the configurable support structure is configured such that the shared second position may be selectively located/chosen only within a predetermined offset zone within a larger working center zone. Once the upper end of a conductor is positioned within the offset zone, the configurable support structure may allow the upper end to also move into a safety zone surrounding the offset zone, e.g. in response to lateral motions of the well processing unit. In this way, the upper end of a conductor may be moved from a first position to any position within the predetermined working center zone to allow alignment of the upper end with a well center of a well processing system and to allow the upper end to remain aligned with the well center even when the well center moves relative to the wellhead platform. A work(ing) center zone may e.g. also be referred to as drill(ing) center zone.

Generally, the angular deviation or bending of a conductor needed will depend on the specific design of the wellhead platform or the configurable support structure (i.e. the maximum amount that an upper part of a conductor should be required to move between its first and second position) and the length of the conductors.

Consider the example of a wellhead platform and the horizontal section of the configurable support structure (e.g. at the level of the wellhead deck) comprising one centrally located shared second position for the upper ends and six adjacent first positions (see e.g. FIGS. 2, 4*d*, 4*e*, and 4*h*) with a maximum distance (e.g. center-to-center distance) between the second and each individual first position being about 1.3 meters, then the smallest angular deviation needed may e.g. be about 0.8° for a water depth of about 70 meters (or corresponding length of the conductor above the seabed often being the water depth plus the length from the water level to the location (e.g. at the level of the wellhead deck) of the wellhead platform/configurable support structure) and e.g. be about 1.0° for a water depth of about 60 meters, e.g. be about 1.1° for a water depth of about 50 meters (with the only varying parameter being the water depth).

In some embodiments, the distance between an upper end located at its first position and at its second position, i.e. the center to center distance between the two positions is equal to the diameter of the conductor or longer, such 18" (45.7 cm) or longer, such as 30" (76.2 cm) or more, such as 1 meter or more, such as 2 meters or more, such as 3 meters or more, such as 4 meters or more, such as 5 meters or more, such as 6 meters or more, such as 7 meters or more, such as 8 meters or more.

In some embodiments, the length of a moving part of a conductor when the upper part of the conductor is moved (also sometimes simple described as moving the conductor) between its first and second position is more than 10 meters, such as more than 20 meters, such as more than 30 meters, such as more than 40 meters, such as more than 50 meters, such as more than 60 meters, such as more than 70 meters, such as more than 80 meters, such as more than 90 meters, such as more than 100 meters. This distance is typically limited by the seabed, one or more guides, or locking mechanism engaging with the conductor to fix its position typically located under water.

All headings and sub-headings are used herein for convenience only and should not be constructed as limiting the invention in any way.

The use of all examples, or exemplary language provided herein, is intended merely to better illuminate the invention and does not pose a limitation on the scope of the invention unless otherwise claimed. No language in the description should be construed as indicating any non-claimed element as essential to the practice of the invention.

This invention includes all modifications and equivalents of the subject matter recited in the claims appended hereto as permitted by applicable law.

BRIEF DESCRIPTION OF THE DRAWINGS

as illustrated in FIG. 9;

DETAILED DESCRIPTION

Various aspects and embodiments of offshore wellhead platforms, methods of constructing and/or processing one or more offshore surface-wells, offshore well processing systems for performing one or more well processing tasks on a plurality of surface-wells, and support elements for such offshore well processing systems as disclosed herein will now be described with reference to the figures.

In the following, the invention is exemplified in relation to various configurations of first and second positions of conductors in relation to a plane such as a wellhead deck, cellar deck or wellhead access deck (see e.g. FIGS. 2, 4-7, and 8*a*). As explained above, the first and second positions of a conductor correspond to respective positions of the upper end of the conductor, which are relevant in relation to i) aligning with a well center, ii) sharing a second position, and iii) relative positions in a cluster. Accordingly, unless otherwise clear, the first and second positions shown in the plane may be taken to refer to i) the respective upper ends or ii) a cross section of the upper part of respective conductors in that plane. A coinciding position of two or more conductors also provides a coinciding position of the respective upper ends of the two or more conductors. In some embodiments, this plane is the wellhead deck, cellar deck or a well access platform deck or a plane relatively close to the upper ends of the conductors. In some embodiments, a cross section taken at two or more decks showing the cross section of the conductors extending through these decks and/the opening(s) for supporting the conductors and the movement of their upper parts will be substantially identical when the decks are e.g. a cellar deck and a wellhead access deck or wellhead deck.

It is noted that, in general, a conductor said to have a position or a configurable support structure comprising a position, corresponds to the configurable support structure being arranged to support a conductor in this position and/or the wellhead platform (and configurable support structure) being arranged to allow movement between that position and another position.

The shown figures are schematic representations for which reason the configuration of the different structures as well as their relative dimensions are intended to serve illustrative purposes only.

Some of the different components are only disclosed in relation to a single embodiment of the invention, but is meant to be included in the other embodiments without further explanation.

Figure 1:
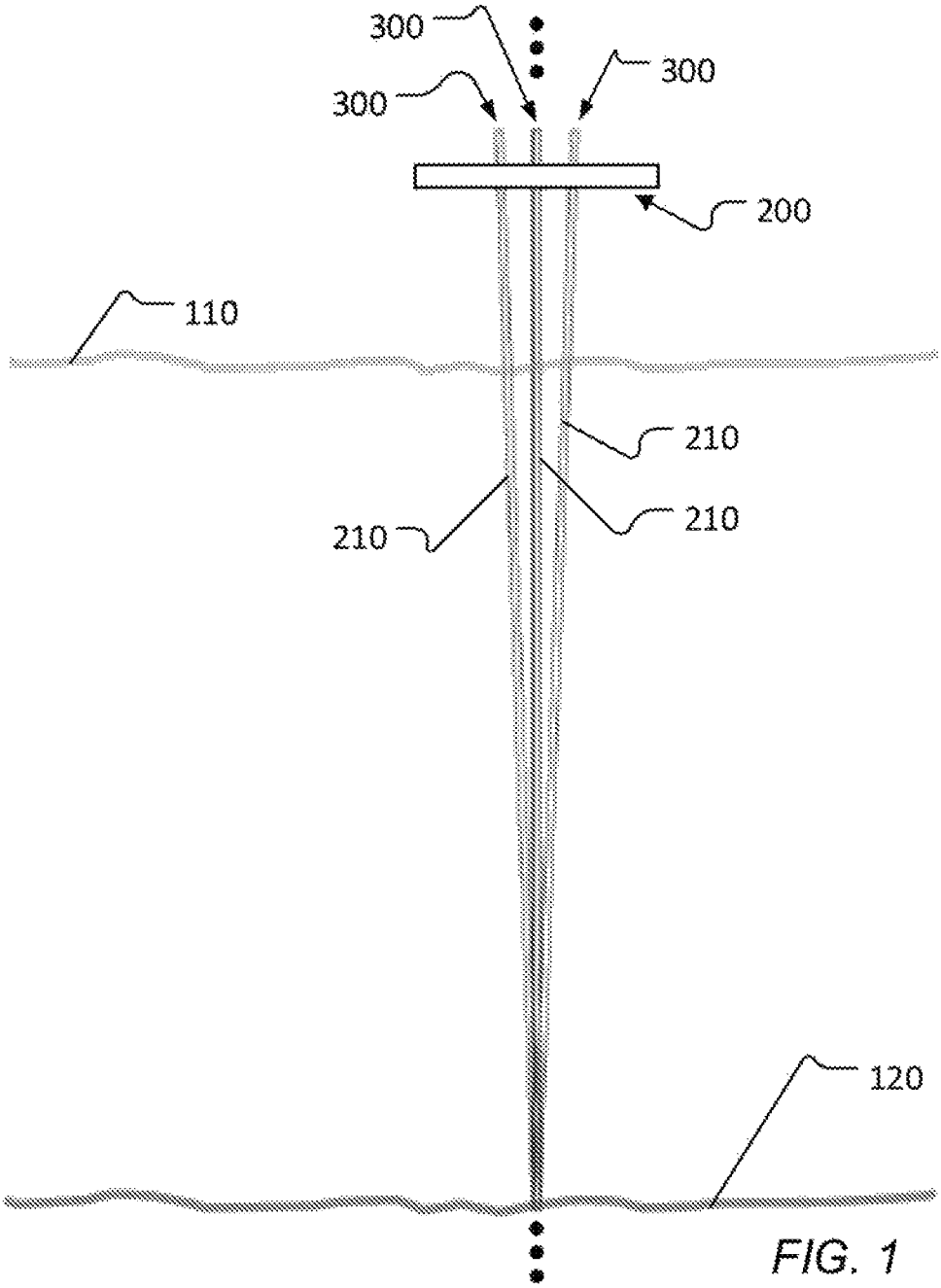
FIG. 1 schematically illustrates a part of an embodiment of an offshore wellhead platform according to the present invention together with a surface-well.

FIG. 1 schematically illustrates a part of an embodiment of an offshore wellhead platform according to the present invention together with a surface-well.

Shown is a part of an offshore wellhead platform, e.g. a part of a deck forming part of a configurable support structure e.g. a wellhead deck or cellar deck, being located above a given water level 110 and receiving and/or supporting an upper part of a plurality of surface-wells 300, e.g. receiving or/and supporting at least the surface-well wellheads.

By surface-well is to be understood that the wellhead of a well is located above the water level 110. Surface-wells are opposed to sub-sea wells, subsea trees, wet trees, etc. It is noted, that only a single well 300 is shown in FIG. 1 (in three different positions as will be explained further in the following) but practically a plurality of surface-wells 300 will typically be supported by a wellhead platform.

In some embodiments, the offshore wellhead platform may be part of an offshore facility or be used in connection with such one, e.g. with facilities to extract and process hydrocarbons or other liquids and/or gasses, inject liquid(s) or gas(ses) in one or more wells, and e.g. to temporarily store product until it can be brought to shore.

The surface-wells 300 are connected to one or more offshore reservoirs (not shown) located below a seabed 120.

The offshore wellhead platform comprises a configurable support structure 200 for supporting at least an upper part of a plurality of conductors 210 (one conductor having one upper part) where an upper part comprises an upper end through which one or more well processing tasks can be performed. A conductor 210 forms part of a surface-well 300.

The conductors 210—when in place—extend from below the seabed 120 to the offshore wellhead platform above the water level 110. As generally know in the art of contstructing hydrocarbon well, inside the conductors 210, one or more conduits (typically casings) of decreasing size (see e.g. 210, 215, and 220 in FIG. 2) is/are located when a well is completed; typically the conduits in turn extending further and sometimes the smallest used or necessary (often referred to as a productions liner or the like) even connects into an off-shore reservoir.

One or more well processing tasks, such as drilling, extraction of gas or oil, injection, well intervention, etc. may be performed through one or more of the conductors 210.

Traditionally, such conductors are considered rigid (at least along a substantial part of their length but often along their entire length) and once in place in the seabed 120 they are typically substantially static that during well processing tasks including eventually extraction, production, injection, well-intervention, etc. Traditionally, such conductors are often regular steel pipes or similar. As explained earlier, such conductors are commonly referred to as non-flexible conductors (even though they are flexible to a certain extent) as opposed to so-called flexible pipes that often are used in connection with deep-water or sub-sea wells or surface-wells located on a platform not being fixed to the seabed.

Traditionally, the conductors may e.g. be arranged in a grid of wells or similar.

Once a well is completed, it will typically have installed a production tree (also referred to as Christmas or x-mas tree) or similar on the wellhead making it ready for e.g. hydrocarbon extraction or production, injection, well intervention, or other.

According to the present invention and aspects thereof, the configurable support structure 200 further provides a first position and a second position (see e.g. 150 and 160, respectively, e.g. in FIG. 2) for at least some, but e.g. all, of the plurality of conductors 210 where the offshore wellhead platform and/or the configurable support structure 200 allows movement of an upper part of a conductor 210 between its first (or a first) and its (or a) second position. The first (and second) positions may e.g. also be referred to as slots or the like.

In some embodiments, and as will be explained further, the upper parts of some conductors 210 may share a number of first positions in the sense that at least the positions of the upper ends coincide, where sharing is in the sense that several conductors 210 may use a first position but one at a time, not in the sense that the upper part of several conductors 210 will be at the same first position at the same time. In some embodiments, as also will be explained further, some conductors 210 may share at least at the upper end—as more often will be the case—a second position (or share several second positions) again in the sense that a plurality of conductors 210 will not occupy one second position at the same time.

The positions (first and second) may generally only have room for one conductor (and e.g. some additional space as needed allowing for safe movement).

Preferably and as mentioned, the first position of a given conductor 210 is at least one member selected from the group of a parking, a storage, etc. position (that also may be used for production and/or injection and/or well-intervention and even installation of the christmas tree etc.) and the second position of the given conductor 210 is a well processing and/or drilling and/or completion and/or other intervention, etc. position. In many embodiments it will be preferable to perform drilling and general well construction in the second position while intervention may preferably be performed in the first position so that the welhead platform preferably supports access for well intervention tools to well with the upper end in the first position e.g. via hatches in one or more decks above the upper end in the first position.

This enables moving an upper part of a conductor 210 from the first (parking, storage, etc.) position to a second (well processing, drilling, etc.) position when the conductor 210 is to be used as part of a well processing or drilling process and back again (or e.g. to another first position) after use giving a number of advantages as explained further throughout this description. In general the conductors are not required to start in the first position (i.e. be moved from a first position) but may e.g. begin in the second position, a position in between the first and second position or in a different first position. After a conductor 210 has been used and moved to its first position, another conductor 210 may begin at or be moved to its second position (in some embodiments being the same, i.e. shared, position for the upper ends and in other alternative embodiments being a different position for the upper end than the second position of the earlier conductor) for use. In some embodiments, a conductor 210 may—after use—be moved to another first position instead of the first position it arrived from.

Shown in FIG. 1 is a surface well 300 with its upper part being at respective three different positions. The middle position (in the Figure) may e.g. be a second position of the upper ends 160 while the two other positions may e.g. be two different first positions 150.

Even for embodiments, where the conductors 210 are considered relatively rigid, such as a steel pipes or the like, they are sufficiently flexible to allow for some movement of their upper parts and end, even after the well has been established through the conductor especially due to their typical length from the seabed and up. Generally, the longer the conductors are above the seabed, the less angular deviation from vertical is generally needed.

In some embodiments, it is faster (and simpler) to move an upper part of well (by moving the upper part of its conductor), e.g. wellhead, casings inside this part of the conductor and x-mas tree installed on the wellhead, between a first position and a second position than repositioning the well center by skidding, moving a cantilever, etc.

The time saving is applicable to processing multiple wells both in a more traditional manner (completing one well at a time) and as batch-drilling (completing the same task(s) and/or sub-task(s) for all or at least some or several wells in turn before moving to the next task(s) and/or sub-task(s)).

Furthermore, as specialized equipment like skids, rails, cantilever are not needed or needed less they may be omitted or be of simpler design or used for other purposes.

Additionally, when the wells are completed and used for production or injection or well-intervention or other they may simply be 'parked' at an individual first position.

Once maintenance, work-over, etc. or other intervention is needed, the conductor and its associated well may simply be moved to the second position again to carry out the maintenance or work-over process(es).

As another examples of a specific design of a wellhead platform and the horizontal section of the configurable support structure (e.g. at the level of the wellhead deck) comprising one centrally located shared second position and eight adjacent first positions (see e.g. FIG. 4*b*) with a maximum distance (e.g. center-to-center distance) between the second and each individual first position being about 2.0 meters, the smallest angular deviation needed may e.g. be about 1.3°, about 1.5°, and about 1.7° for water depths of about 70 meters, about 60 meters, and about 50 meters (or corresponding lengths of the conductors), respectively (with the only varying parameter being the water depth).

Generally, for a specific design, the smallest angular deviation needed will increase with increasing maximum distance between a second and each individual first position and increase with decreasing water depth (length of the conductor).

At least one suitable mechanism is provided for moving an upper part of a conductor between its first position and its second position, such as a shared second position. In general, the at least one mechanism for moving the upper part of a conductors may e.g. be located on the offshore wellhead platform or could be located externally from the wellhead platform, such as on an offshore well processing system (see e.g. 400 in FIGS. 3 and 8). The mechanism may be any suitable mechanism capable of moving (the upper part) of a conductor e.g. by pulling, pushing, etc. For example, the mechanism may be mechanical or hydraulic push or pull, a rack and pinion drive, winch-wire, or any other suitable mechanism for moving, shifting, etc. the conductor between the first and second position. The described mechanisms may be suitable for moving upper parts of two or more conductors, such as four or more, such as six or more, such as all conductors supported by the configurable support structure. Examples of suitable moving mechanisms or systems will be described in greater detail below e.g. with reference to FIGS. 17, 18, and 24 (see the conductor moving system 550).

In some embodiments, the configurable support structure is arranged to support conductors forming at least one cluster (see e.g. 600 in FIGS. 4*d*-4*h* and 4*k*-4*m*), e.g. in two (see e.g. FIGS. 4*d*, 4*f*), four (see e.g. FIGS. 4*e*, 4*g*), six (see e.g. FIG. 4*h*), and so on. The number of groups or clusters may also be an odd number.

The wellhead platform and the configurable support structure may e.g. support two (or more) second positions for use with two (or more) well centers/drilling stations that may belong to a single (same) cluster or alternatively to different clusters.

In some embodiments, one or more blow-out-preventer (BOP) components or units is provided—e.g. by the wellhead platform and/or an offshore well processing system (see e.g. 400 in FIGS. 3 and 8) e.g. located on (typically inside) a cantilever (see e.g. 405 in FIG. 8)—to which one or more wells may be connected.

In this way, the possibility to connect one or more wells—during well progression—to a BOP is readily provided, e.g. as an intermediate step while another well is being worked at. In some embodiments, a substantially minimum bending stress state of a conductor is at a predetermined position for the conductor that is located between the first and the second position of the upper end of the conductor (e.g. closer towards the second position or alternatively substantially midway), or located substantially at the second position of the conductor, located substantially at the first position of the conductor.

An advantage of the embodiments where the substantially minimum bending stress state of a conductor is at a predetermined position for the given conductor that is located substantially at or closer to a first position in relation to production or injection or well-intervention, etc. is that the wells will be in the first positions for a much longer time unless something unexpected happens thereby requiring maintenance or work-over or other intervention.

An advantage of the embodiments where the substantially minimum bending stress state of a conductor is at a position for the conductor that is located substantially at or closer towards the second position of the upper end of the conductor is that the conductor likely will be deflected the least or less at that position thereby facilitating drilling or well processing tasks to be performed through the upper part of the conductor. Furthermore, it will comparatively require less applied force to move the upper part of the conductor to a second position but then comparatively require more applied force to move an upper part of the conductor to a first position.

An advantage of the embodiments where the substantially minimum bending stress state of a conductor is at a position for the conductor that is located substantially midway between the first and the second position of the upper end of the conductor is that an overall maximum reach for a bending stress level is obtained. I.e. the distance between the first and the second position may be greater for the bending stress level compared to other states with the minimum bending stress state being closer to either the first or the second position of the upper end.

As mentioned above, the positions of the minimum bending stress may change as the well is constructed and the above consideration may be for the conductor and alone and/or for the conductor with the casings and other components of the well installed.

The conductors may e.g. be secured below the water level to the structure of the offshore wellhead platform as generally known and e.g. as described in U.S. Pat. No. 3,670,507.

In certain embodiments, the respective upper part of the conductors comprises a part or segment made of a more flexible material (than what the rest of the conductor primarily is made of, e.g. steel) and/or being flexible in another manner. Flexibility may e.g. be provided by varying the properties and/or geometry of the conductor at certain parts. This may reduce the extent of moving the upper part of a conductor.

In some embodiments, the conductors are used at water depths e.g. being selected from about 30 meters to about 300 meters or from about 30 meters to about 150 meters. Various aspects and embodiments of a method of processing or drilling one or more offshore surface-wells using a configurable support structure 200 and embodiments thereof as just described are explained in connection with FIG. 2.

Figure 2:
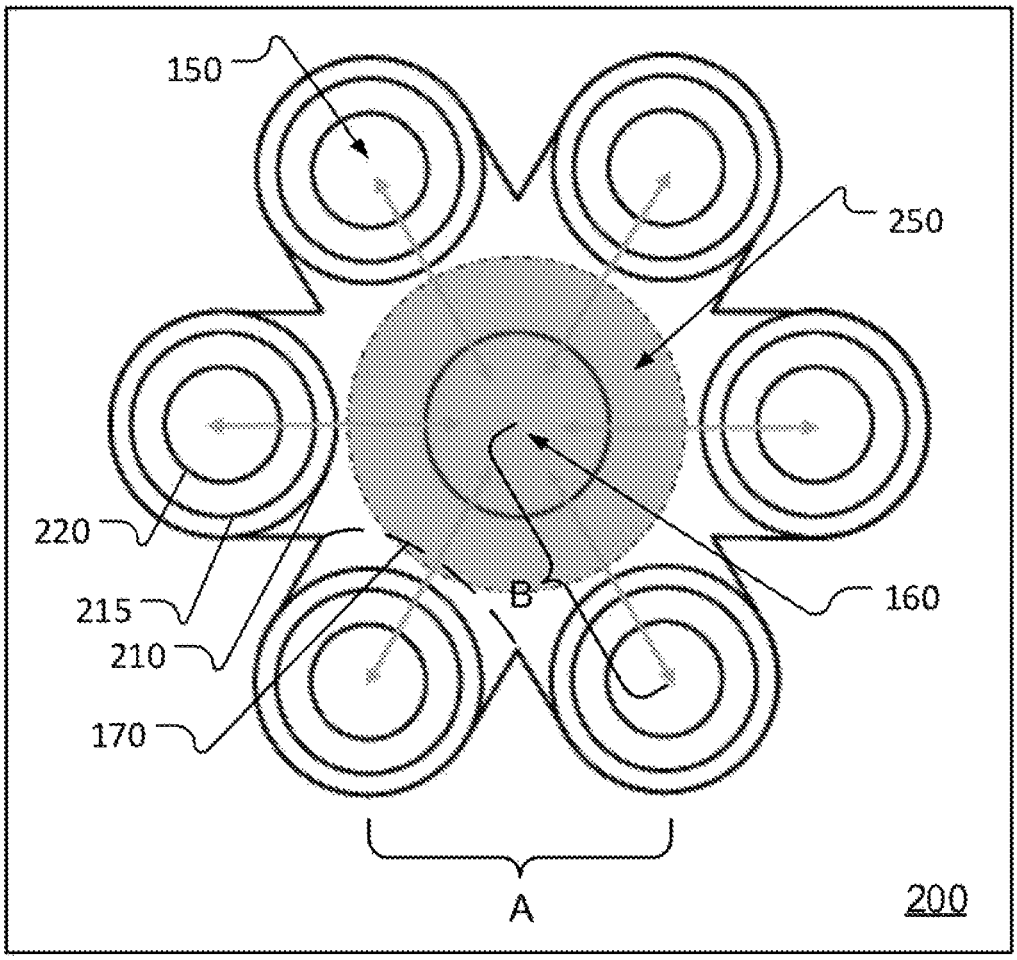
FIG. 2 schematically illustrates a top view of an exemplary embodiment of at least a part of a configurable support structure.

FIG. 2 schematically illustrates a top view of an exemplary embodiment of a part of a configurable support structure.

Shown from above or below is at least a part of a configurable support structure such as the ones shown and explained in connection with FIG. 1 and throughout the present description.

The configurable support structure 200 (only the relevant horizontal section is shown) provides a number, here as an example six, of first positions 150 and a number, here as an example one, of second positions 160.

In each first position or slot 150 is shown one conductor 210. The conductors 210 may each comprise a smaller diameter conduit 215 and an even smaller diameter conduit 220, e.g. the production liner, as generally known. There may be an air-gap or space present at each first position or slot 150 for providing room between the conductors 210 and the configurable support structure 200. Also shown and indicated by 'A' is a center-to-center distance between two neighboring conductors 210 each in a first position.

Further shown and indicated by 'B' is a center-to-center distance between a center of the second position of the upper end 160 and a center of each of the first positions of the upper ends 150. In some embodiments (and as shown), B will be substantially the same to all first positions or at least have a minimum distance for all associated first positions. However, it may also be different for at least some first positions (see e.g. FIGS. **4*i*-4*m*, 5, 6*a*-6*b*, and 7**).

In some embodiments, A is selected from about 0.25 meters to about 10 meters. In some embodiments, A is selected from about 0.8 meters to about 5 meters. In some embodiments, A is selected from about 1 meter to about 2.5 meters. In some embodiments, A is selected from about 0.8 meters to about 2 meters. In some embodiments, A is selected from about 1.2 meters to about 1.9 meters.

In some embodiments, B is selected from about 0.25 meters to about 25 meters. In some embodiments, B is selected from about 0.5 meters to about 15 meters. In some embodiments, B is selected from about 1.5 meters to about 10 meters. In some embodiments, B is selected from about 1 meter to about 4 meters. In some embodiments, B is a value being larger than about 0.1 meters. In some embodiments, B is a value being larger than about 0.25 meters. In some embodiments, B is a value being larger than about 0.5 meters. In some embodiments, B is a value being larger than about 0.75 meters. In some embodiments, B is a value being larger than about 1 meter. In some embodiments, B is a value being larger than about 1.25 meters. In some embodiments, B is a value being larger than about 1.5 meters. In some embodiments, B is a value being larger than about 2 meters. In some embodiments, B is a value being larger than about 2.5 meters. In some embodiments, B is a value being larger than about 3 meters. In some embodiments, B is a value being larger than about 3.5 meters. In some embodiments, B is a value being larger than about 4 meters. In some embodiments, B is a value being larger than about 5 meters. In some embodiments, B is a value being larger than about 6 meters. Finally, a working center zone 250 is indicated by a central darker dashed circle. It is noted that the working center zone 250 does not form part of the configurable support structure 200 but rather is projected thereon to better illustrate its position in relation to the shared second position when used.

The offshore wellhead platform comprising the configurable support structure may comprise an opening at its upper structure (e.g. at the weather deck, also sometimes called main deck, of the offshore wellhead platform) above the one or more shared second positions that more or less coincide or at least overlap with the working center zone during well construction of a well or wells at a shared second position or positions, respectively. See also FIGS. 5, **6*a*-6*b*, and 7** for examples of parts of a configurable support structure together with an appropriate working center zone.

The configurable support structure may e.g. be or comprise parts that are part of a wellhead deck (also sometimes referred to as wellhead platform deck, cellar deck, etc.) of an offshore wellhead platform (see e.g. FIG. 26). As a note, production trees of completed wells may be located at a deck (sometimes referred to as the Christmas tree deck or other) located between the weather deck and the wellhead deck.

As indicated by double arrows, the respective conductors 210 are movable between the first and second positions 150, 160 as explained in connection with FIG. 1 and throughout the present description.

The configurable support structure may be used to carry out aspects of a method of processing or drilling one or more offshore surface-wells (see e.g. 300 in FIG. 1). In some embodiments, the method comprises constructing and/or processing multiple offshore surface-wells from a single well center by moving the upper parts of one or more conductors to and from the single working center.

In some embodiments, the method comprises using at least one offshore wellhead platform as described elsewhere wherein the single working position is a shared second position.

In some embodiments, the method comprises progressing a plurality of surface-wells towards completion by moving the upper part of a conductor from either (i) from a first position to a second position (ii) installing the conductor at least with the upper part in its second position or (iii) installing the conductor away from either its first or second position and moving its upper part to its second position, carrying out one or more well constructing and/or processing tasks (e.g. including sub-tasks) to complete the surface-well of the conductor and subsequently moving the upper part of the conductor to the first position of the conductor. After the well has been completed (or at least progressed towards completion as desired), the conductor is moved to a first position (e.g. the first position it came from or to another first position). Completion (at least partially) for one well may be done at one position while production (and potentially other well processing tasks) may be done for the same well at a different position. Then another conductor is moved from its first position to the shared second position and completed (or progressed as desired) and moved back to a first position (original or different). This is repeated until the desired conductors have been completed.

In this way, efficiency is increased for drilling or processing a plurality of wells since repositioning of the well center is not needed or needed significantly less when completing or progressing them as desired one at a time. The conductors need not necessarily be completed or progressed to the same extent, although they often will be.

It should be noted that the method and embodiments thereof may be carried out, e.g. overlapping in time, at two (or more) second positions. The specific steps, tasks, etc. and their timing carried out at different second positions may and often will be different—although they may be the same.

In some alternative embodiments, the method comprises progressing a plurality of surface-wells towards completion by, at a second position of the conductor, carrying out at least one well constructing and/or processing task and/or sub-task. After the task(s) and/or sub-task(s) has/have been completed, the given conductor is moved to a first position. Then a next conductor is moved from its first position to the second position and the task(s) and/or sub-task(s) are carried out on or for the next conductor after which it is moved to a first position (original or different). This is repeated until the relevant task(s) and/or sub-task(s) has/have been carried out on the desired conductors. Once that is the case, the next task(s) and/or sub-task(s) is/are carried out on all the desired conductors. The next task(s) and/or sub-task(s) need not—but may do so—start with the same conductor as was started with for the previous task and/or sub-task. This is repeated until all desired tasks and/or sub-tasks have been carried out for all desired conductors.

Again, the process and variations thereof may be carried out, e.g. overlapping in time, at two (or more) second positions (then by two or more well processing stations). The specific steps, tasks, etc. and their timing carried out at different second positions may and often will be different—although they may be the same.

In this way, efficiency is increased for batch drilling or batch processing of a plurality of wells carrying out a group of one or more tasks and/or sub-tasks at a time on all the relevant conductors. The conductors need not necessarily be completed or progressed to the same extent, although they often will be.

After completion (by either method or embodiments thereof), the conductors may be secured at a number of first positions for well intervention, or production phase.

The configurable support structure (both the one shown in FIG. 2 and the ones shown in the other figures) may comprise one or more locking or securing mechanisms or elements (not shown; forth only referred to as securing elements).

In some embodiments, at least one securing element provides securing of one or more conductors at first positions that, e.g. permanently, may lock at least one conductor in place at respective first positions, e.g. when the conductor is ready for production, injection, well-intervention, or similar. Examples of such securing elements are latches, clamps, wedges, or other securing elements.

In some embodiments (e.g. in combination with one or more of the embodiments given above), at least one securing element is provided at each second position for securely maintaining a conductor in place at a respective second position during well processing, drilling, etc. Such securing elements may e.g. allow some degree of movement. Examples of such securing elements are mechanical or hydraulic push or pull, a rack and pinion drive, winch-wire, or any other suitable mechanisms for retaining, moving, shifting, etc. In some embodiments, the second position securing element may be combined with the least one mechanism for moving the upper end of a conductor between its first position and its second position.

In some embodiments (e.g. in combination with one or more of the embodiments given above), the offshore wellhead platform or the configurable support structure 200 comprises a number of collision prevention or separation elements 170 e.g. one for each first position 150 where the collision prevention or separation element forms a barrier or similar between the second position(s) 160 and the first positions 150 e.g. as indicated by the dashed line 170. Preferably, the collision prevention or separation elements will shield each first position 150 from the second position(s) 160, e.g. one collision prevention or separation element for each first position 150 or one collision prevention or separation element covering more or all first positions 150. Examples of such collision prevention elements are structural elements, beams, cushion or dampening elements, etc. One or more collision prevention or separation elements may e.g. be combined with one or more second position securing elements and/or the one securing element(s) providing securing of one or more conductors at first positions.

Such configurable support structures and methods as described above function particularly well together with embodiments of an offshore well processing system (see e.g. 400 in FIGS. 3 and 8) comprising at least two well processing stations such as drilling stations, wherein the well processing stations are capable of operating independently of each other. In some embodiments, the well processing stations are each capable of constructing a well simultaneously. When operational, the distance between the two well processing stations may be fixed. Each of the at least two well processing stations may comprise their own mud supply, well control system, and mud return systems.

A shared second position for a number of conductors (or a zone or area around it; see e.g. FIGS. 6*a* and 6*b*) may be used—e.g. after one or more wells have been completed at the second position—to complete one or more additional wells, e.g. those additional wells will have first positions of the upper ends located overlapping fully or partly with the second position(s) in question or a zone or area around the shared second position(s). In this way, the wellhead platform may support a higher number of conductors and wells.

When moving upper parts of conductors as disclosed, it should preferably be ensured that no well collisions or even near-collisions occur at/near the surface and/or near the seabed well template (and in-between).

The spacing between conductors at the seabed well template will have an influence on the risk of well collision and a certain minimum conductor to conductor distance (at the well template) is preferred. In some embodiments (assuming grid or array arrangement or similar), the spacing between conductors in a first direction is about 1.1 to about 1.4 meters and about 1.8 to about 2.0 meters in a second direction (perpendicular to the first direction). In some embodiments, the spacing in a first direction is about 1.3 and about 1.9 in a second direction (perpendicular to the first direction).

According to one aspect, the upper parts of the conductors are moved in a certain way in response to what certain predetermined criteria specify. The criteria may involve how the conductors (and e.g. their production trees, etc.) are arranged including their individual location and spacing at the wellhead platform (which depends on an actual design) and how the conductors are arranged at the seabed level. Often there will be a difference between the layout of the conductors at the wellhead deck level and at the seabed level.

In some embodiments, the conductors are moved, in response to what the certain predetermined criteria specify, either a) within a first area near or at the configurable support structure (e.g. at or near, e.g. below, wellhead deck level) wherein an extent of the first area is larger than an extent of a second area, the second area surrounding the relevant conductors at seabed, or b) within a first area near or at the configurable support structure (e.g. at or near, e.g. below, wellhead deck level) wherein an extent of the first area is smaller than an extent of a second area, the second area surrounding the relevant conductors at seabed.

The first possibility a) gives sort of a 'flower bouquet' area encompassing the conductors from the seabed to the wellhead deck while the second possibility b) gives sort of a 'birdcage' area encompassing the conductors from the seabed to the wellhead deck.

Figure 11A:
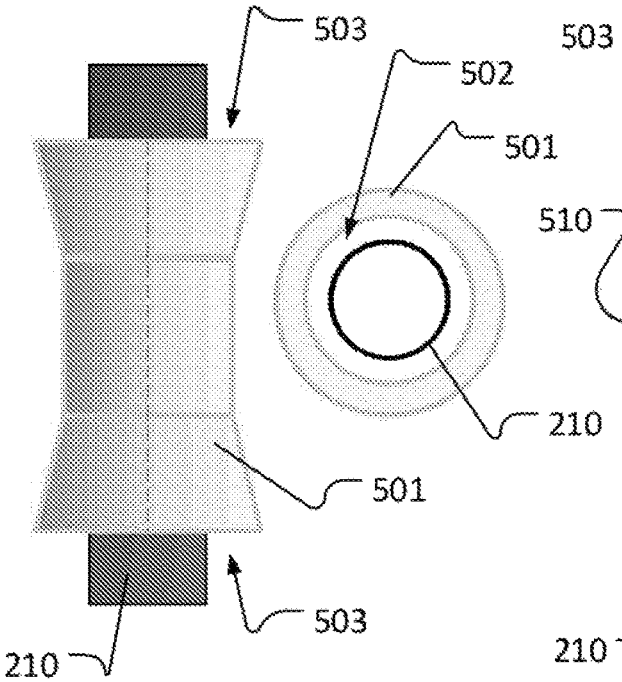
FIGS. 11*a* and 11*b* schematically illustrate side and top (or bottom) views of an exemplary conductor guide according to one aspect of the present invention.

Rigid guidance is preferred at seabed or close to seabed. One or more conductor guides, e.g. as shown in FIGS. 11*a*, 11 *b*, 12*a*, 12*b*, 13*a*-13*c*, 14, and 16, secured to the main structure of the wellhead platform will enable this (see e.g. FIG. 21), especially if the conductors are driven or installed after main structure installation.

In some embodiments, the configurable support structure 200 may provide a number of third compensation positions e.g. as shown in FIGS. 9, 10, and 17-18.

Note that the shown position of the second position(s) of the upper end(s) is shown somewhat idealized in FIG. 2 (and FIGS. 4*a*-4*m*, 10, 17 and 18). Due to tolerances the one or more shared second positions may have a position within the working center zone 250 (see e.g. also 250 in FIGS. 5, 6*a*-6*b*, 7 and 24).

Figure 3:
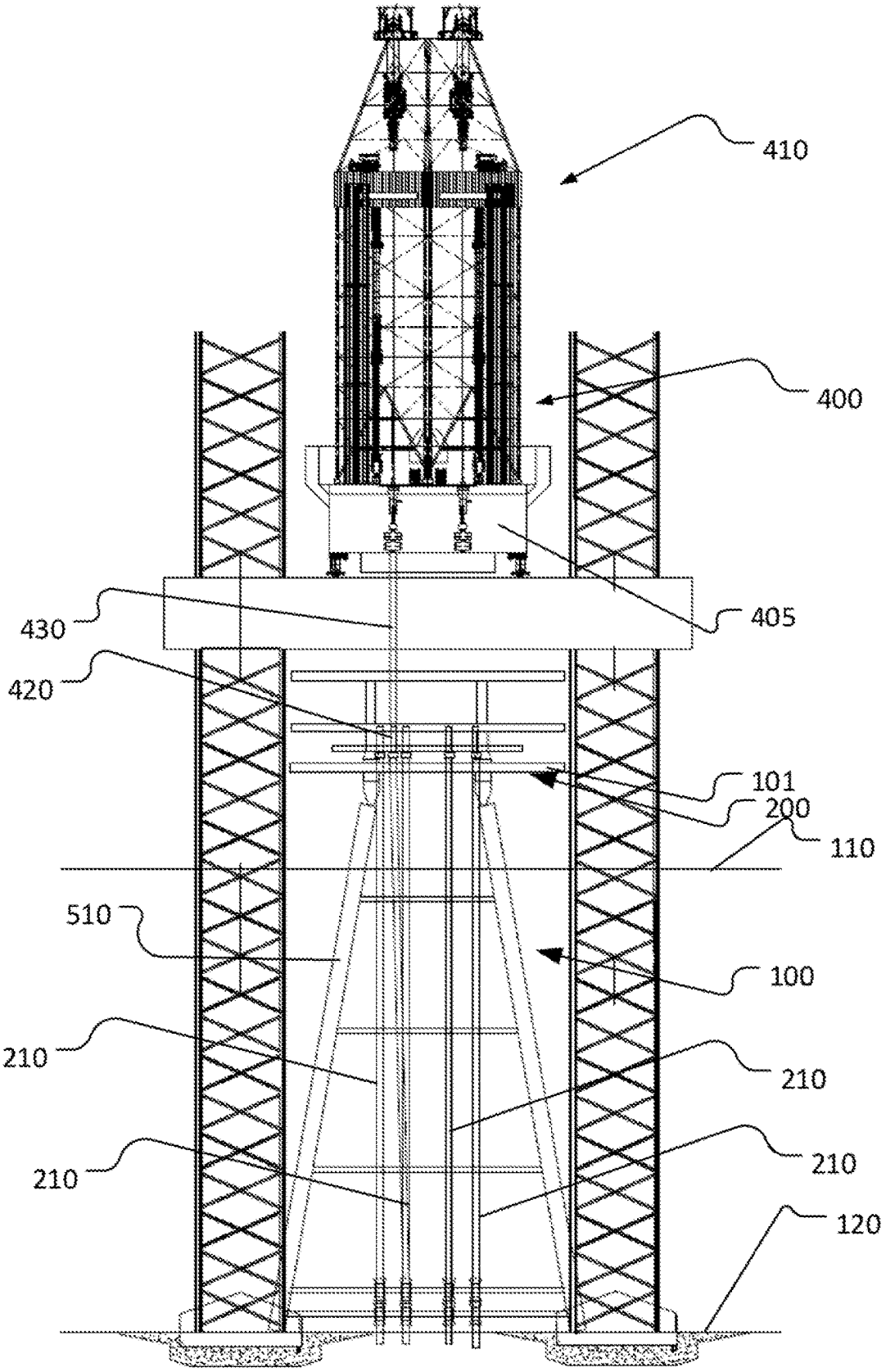
FIG. 3 schematically illustrates a front view of an exemplary embodiment of an offshore wellhead platform and an offshore well processing system.

FIG. 3 schematically illustrates a perspective view of an exemplary embodiment of an offshore wellhead platform and an offshore well processing system.

Shown is a wellhead platform 100 comprising a configurable support structure 200 such as the ones shown and explained in connection with FIGS. 1 and 2 and throughout the present description. The wellhead platform 100 may e.g. also comprise a wellhead deck and cellar deck 101 or similar, in this example comprising or at least partly coinciding with the configurable support structure 200.

Shown are also a number of conductors 210 as described earlier after well completion where a production tree 420 or the like is located on a wellhead of the well.

Further shown is an offshore well processing system 400 comprising at least one (here as an example two, but it could be more than two) well processing station 410 such as a drilling station. In case of multiple well processing stations or multiple drilling stations 410, they may be similar or alternatively be different.

The offshore well processing system 400 will typically comprise a drill floor defining a well processing center also referred to as a well center. When performing one or more well processing tasks, the well center will be located above the upper end of a second position and a riser or the like 430 will extend from the well processing station(s) or drilling stations 410 to the well at a second position being worked upon on the wellhead platform 100.

At least one suitable mechanism is provided on the offshore wellhead platform 100 and/or on the offshore well processing system 400 for moving the upper end of a conductor 210 between a first position and a second position as already explained.

In embodiments comprising two (or more) well processing stations or drilling stations 410, the well processing stations or drilling stations 410 may work fully independently or alternatively also be able to cooperate at least for some functions.

In some embodiments, the offshore well processing system 400 comprises at least 2 well processing stations or drilling station 410, wherein the well processing stations or drilling stations 410 are capable of operating independently of each other but where e.g. one may assist the other. When operational, the distance between the two well processing stations or drilling stations 410 may be fixed. In further particular embodiments, each of the at least two well processing stations or drilling stations 410 comprises its own fluid system and well control system.

FIGS. 4*a*-4*m* schematically illustrate a number of different exemplary configurations of first and second positions in a plane or at deck.

Shown in FIG. 4*a*-4*m* are exemplary embodiments of a configurable support structure 200 (only the relevant horizontal section is shown) or part thereof, such as the ones shown and explained in connection with FIGS. 1-3 and throughout the present description, comprising a number of first and second positions 150, 160 according to a given layout, arrangement, etc.

Figure 4A:
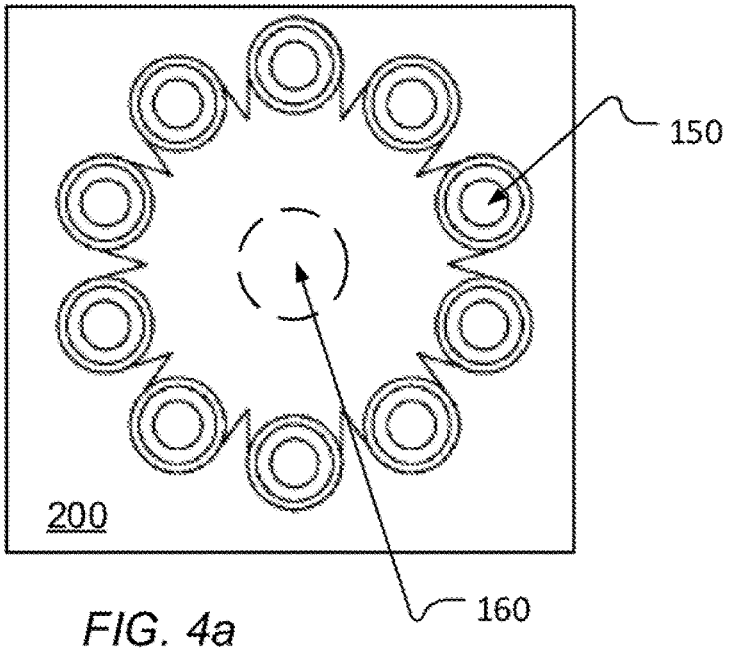
FIGS. 4*a*-4*m* schematically illustrates a number of different exemplary configurations of first and second positions in a plane or at deck.

Shown in FIG. 4*a* is an arrangement corresponding except as otherwise noted to the embodiment of FIG. 2 that comprises one centrally located shared second position 160 with a number, here ten, first positions 150 being located around the central shared second position 160 in a substantially circular pattern. In the particular shown embodiment, a center-to-center distance from the shared second position 160 to each of the first positions 150 in the plane shown is substantially equal, although it does not need to be (see e.g. FIG. 4*i*).

This particular arrangement provides increased flexibility as it may support a greater number of conductors (and thereby wells) than e.g. the arrangement shown in FIG. 2 due to a greater number of first positions 150.

Figure 4B:
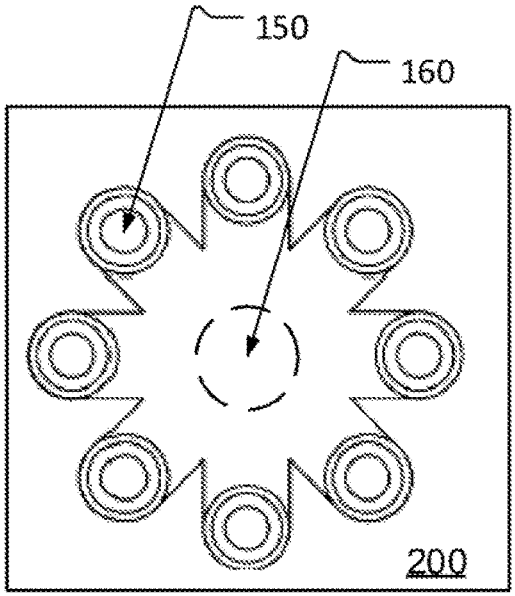
Figure 4C:
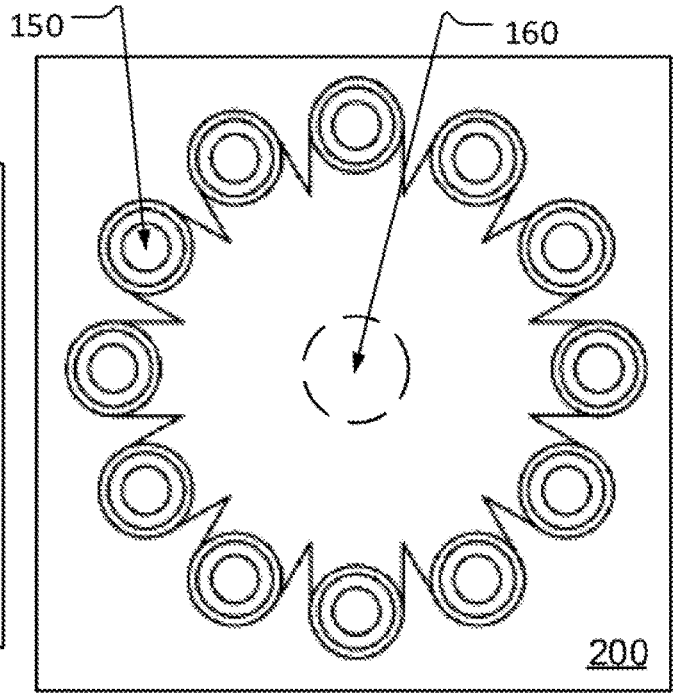
Figure 4D:
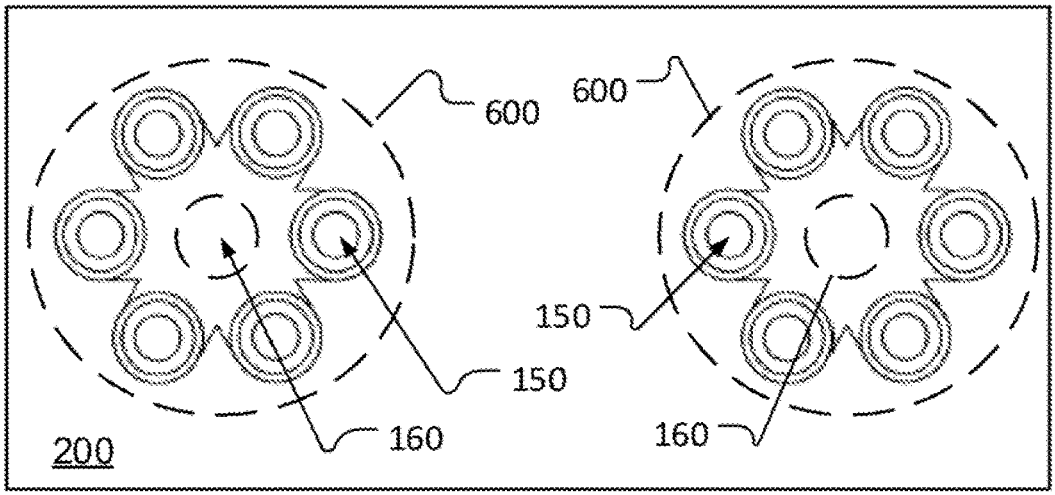
Figure 4E:
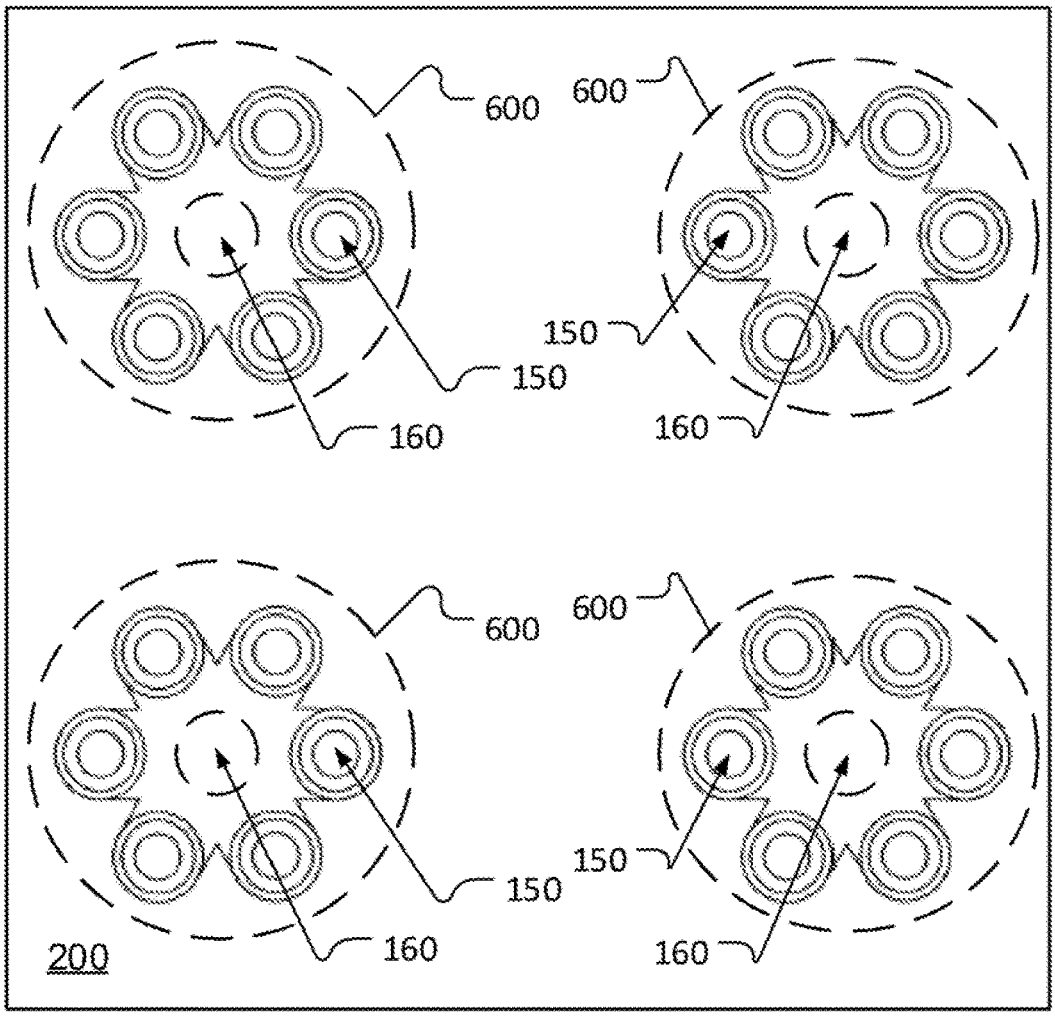
Figure 4F:
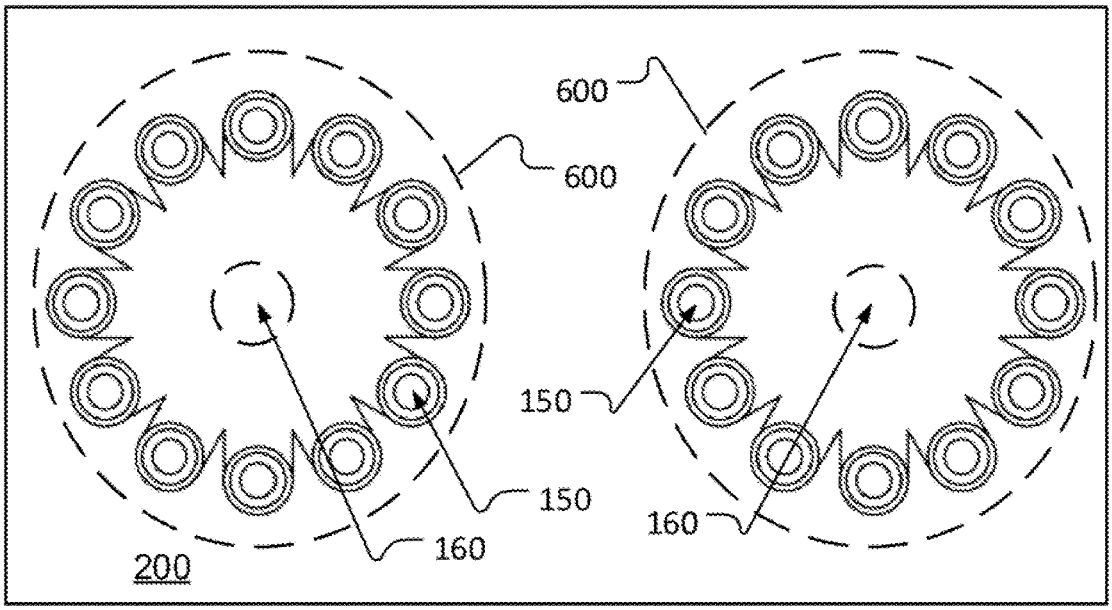
Figure 4G:
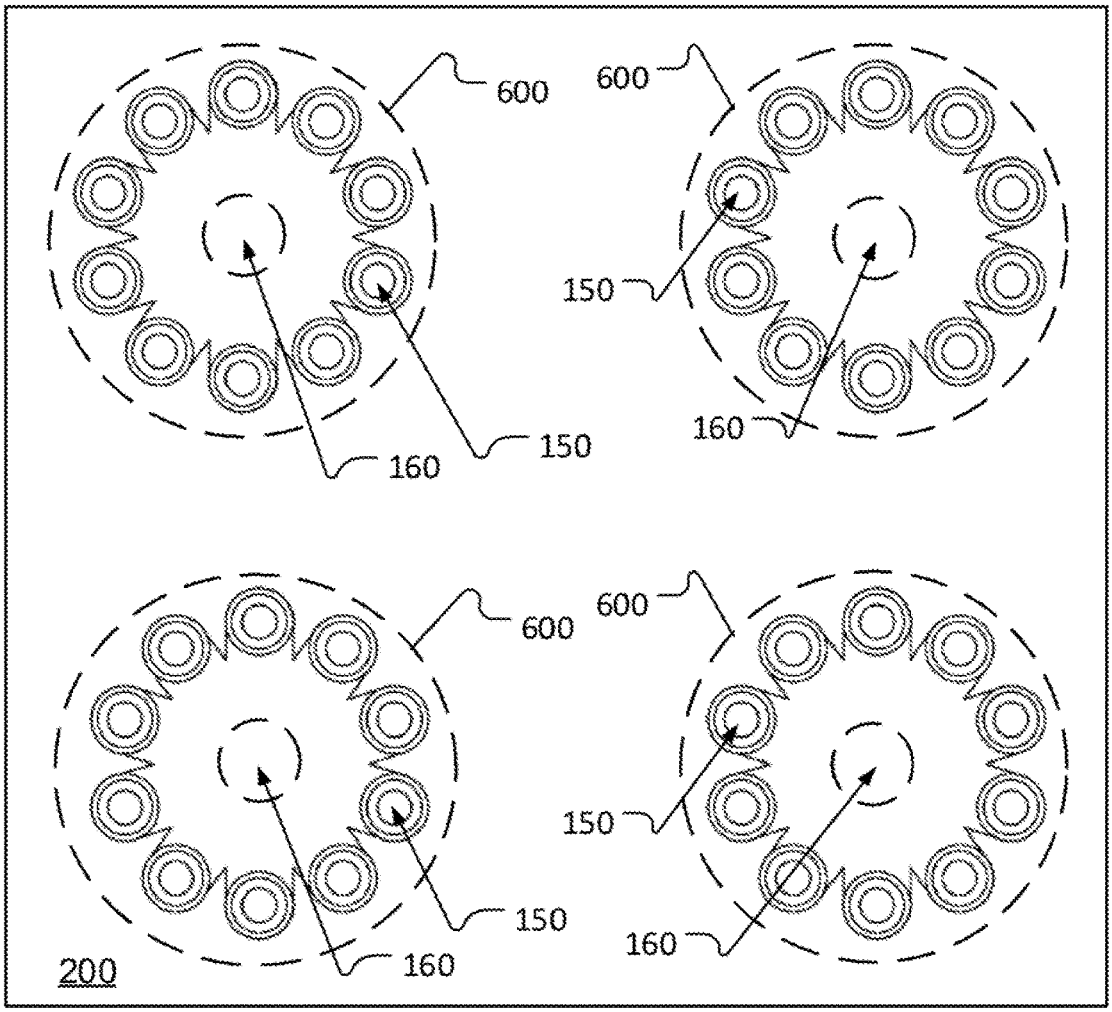
Figure 4H:
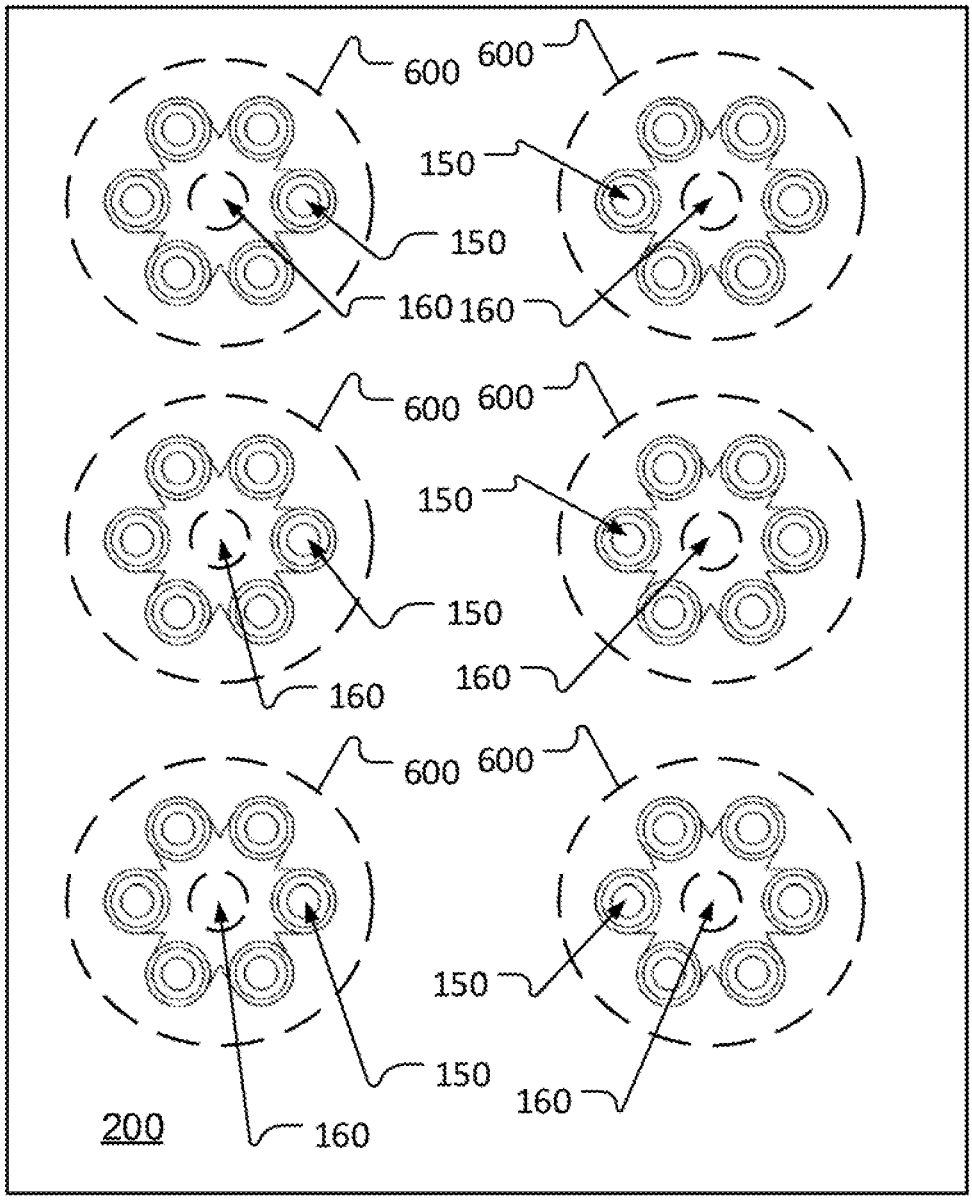
Figure 4I:
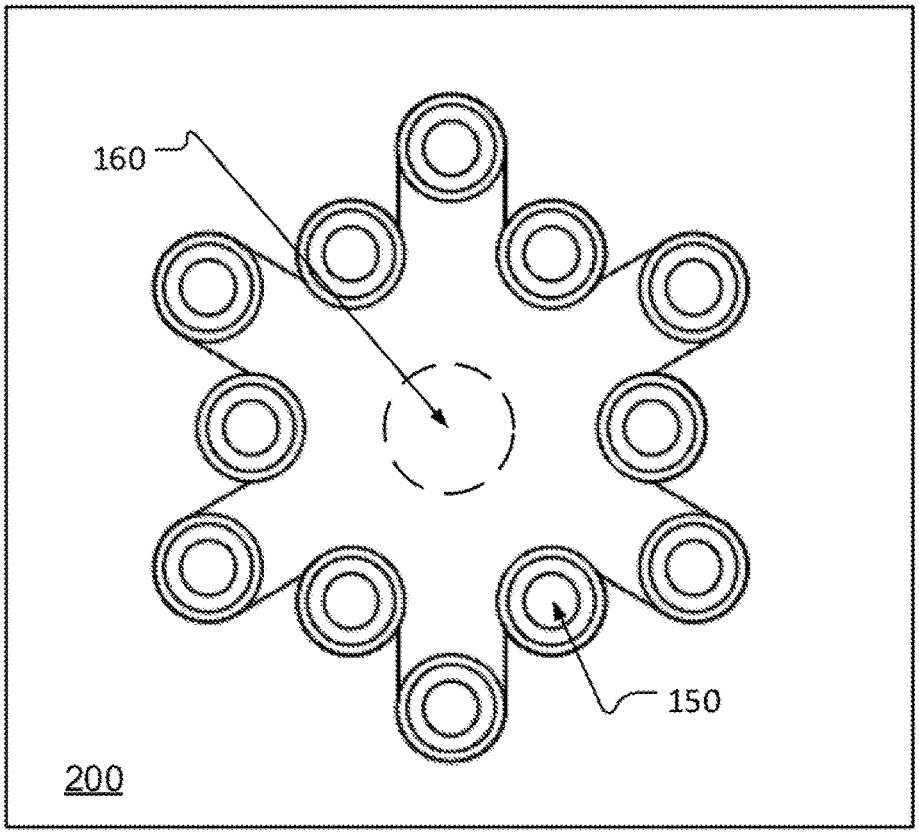
Figure 4J:
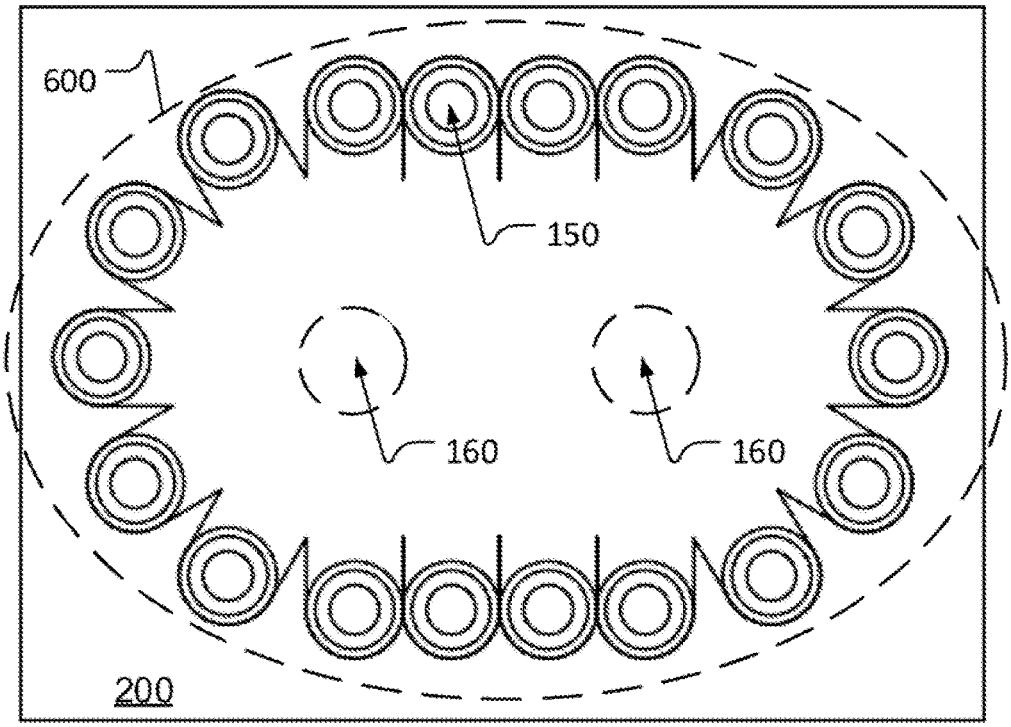
Figure 4K:
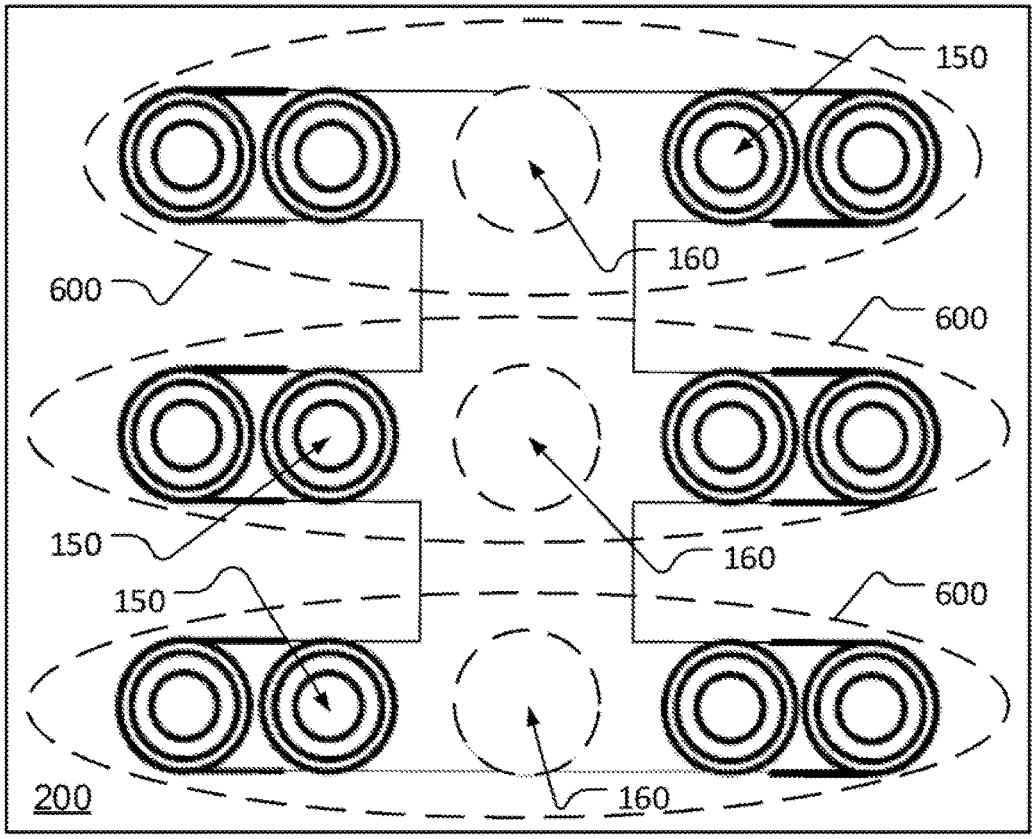
Figure 4L:
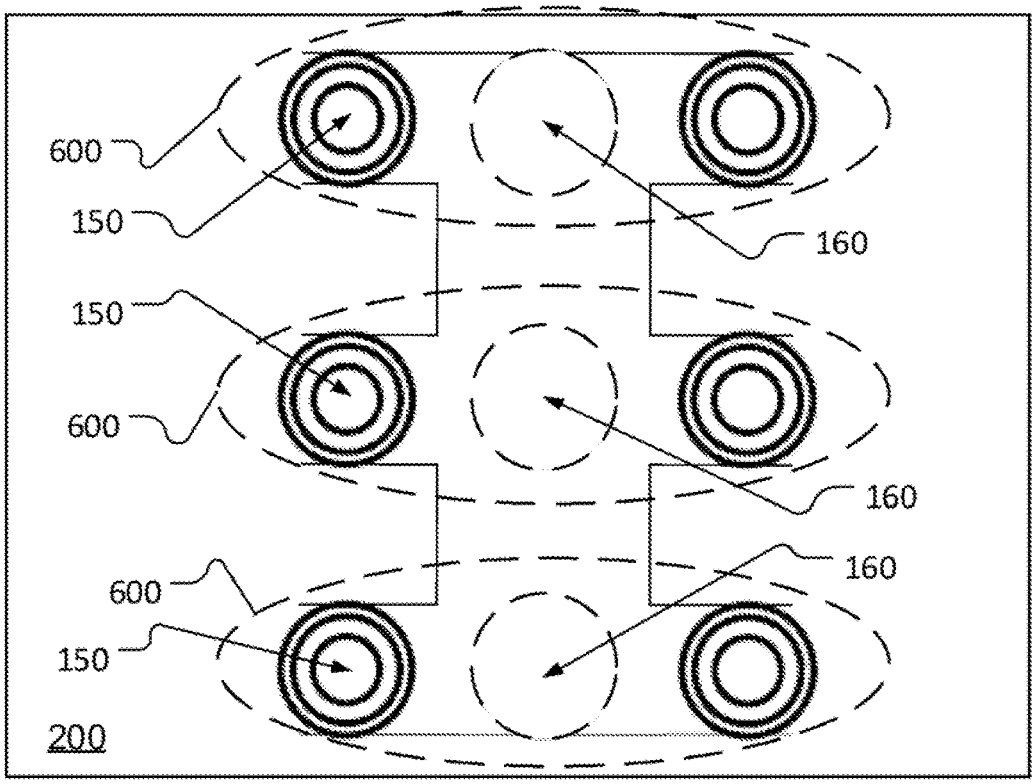
Figure 4M:
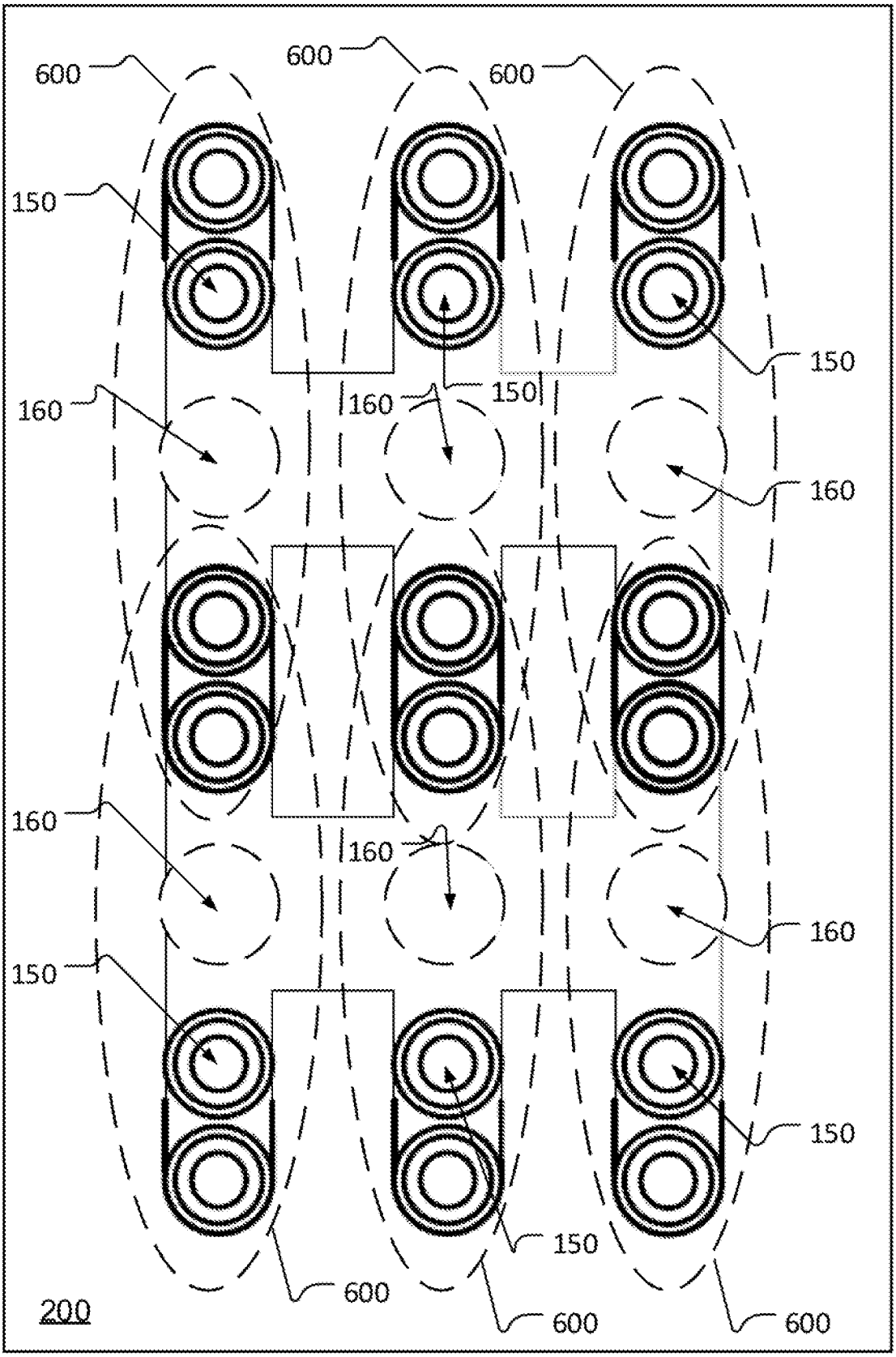

In some embodiments, the first positions 150 (e.g. of a cluster; see below) may be arranged differently, e.g. in an oval pattern as shown in FIG. 4*j*, in lines as shown in FIGS. 4*k*-4*m*, or in any other suitable pattern for a given design and/or need.

In some embodiments, the conductors may e.g. be arranged in one or more clusters, e.g. as shown in connection with FIGS. 4*d*-4*m*, where a cluster of conductors e.g. may be associated with at least one shared second position of the upper ends.

In some embodiments, the arrangement of first and second positions 150, 160 may e.g. comprise two (or more) shared second positions 160, e.g. as shown in FIGS. 4*d*-4*h* and 4*j*-4*m*.

Shown in FIG. 4*b* is an arrangement corresponding to the embodiment of FIG. 4*a* with the exception that it comprises eight first positions 150 instead of ten.

This particular arrangement also provides increased flexibility as it may support a greater number of conductors than e.g. the arrangement shown in FIG. 2 due to a greater number of first positions 150.

Shown in FIG. 4*c* is an arrangement corresponding to the embodiment of FIG. 4*a* with the exception that it comprises twelve first positions 150 instead of ten.

In this way, increased flexibility is provided as explained.

Shown in FIG. 4*d* is an arrangement corresponding to the embodiment of FIG. 2 but where the first and second positions 150, 160 of the upper ends of the conductors in the cluster generally are arranged or organized in two clusters 600 where each cluster 600 is represented schematically by a dashed circle.

In this particular embodiment, each of the two clusters 600 comprises an arrangement corresponding to the arrangement of FIG. 2, i.e. each cluster 600 comprises one centrally located shared second position 160 of the cluster with six first positions 150 being located around the central shared second position 160 (of the particular cluster) in a substantially circular pattern.

In this arrangement, each of two well processing stations or drilling stations (not shown; see e.g. 410 in FIGS. 3 and 8) may perform well processing tasks via a conductor located at the shared second position 160. In this particular and corresponding embodiments, one second position 160 of a cluster 600 may be associated with a particular well processing station.

This enables parallel, overlapping, and/or concurrent processing of two wells or conductors at a time further increasing efficiency and/or flexibility in relation to well operations.

In some embodiments, one or more clusters 600 may each have two (or more) shared second positions 160, e.g. as shown in FIG. 4*j*.

In some other embodiments, the first and second positions 150, 160 of the upper ends of the conductors in the cluster may be arranged in more than two clusters 600, each cluster 600 having at least one second position, e.g. as shown in FIGS. 4*k* and 4*l* with three clusters 600, in FIGS. 4*e* and 4*g* with four clusters 600, in FIGS. 4*h* and 4*m* with six clusters 600, etc.

In some embodiments, two (or more) clusters 600 may be connected in such a way that at least one conductor (and thereby well) may be moved between a number of clusters 600. Examples of such embodiments are shown in FIGS. 4*k*-4*m* but such connected clusters could equally be for other arrangements e.g. connecting the two clusters in FIG. 4*d*, connecting two or more of the four clusters of FIG. 4*e*, and so on.

It is to be understood that in other embodiments, a cluster 600 could be arranged differently e.g. as shown in FIGS. 4*a*-4*c* and 4*i*-4*m* and variations falling within the scope of the appended claims.

It is also to be understood that for embodiments comprising a plurality of clusters 600, the relative arrangement of first and second positions of the upper ends 150, 160 does not need to be the same for each cluster 600, e.g. the number of and/or the layout of the first and/or second positions 150, 160 may be different.

Shown in FIG. 4*e* is an arrangement corresponding to the embodiment shown and described in connection with FIG. 4*d* but where the arrangement comprises four clusters 600 instead of two. The applicable variations mentioned in connection with FIG. 4*d* and elsewhere are equally applicable for the embodiments of FIG. 4*e*.

This further increases efficiency and/or flexibility e.g. by enabling parallel, overlapping, and/or concurrent processing of several wells or conductors at a time (e.g. still two at a time but possibly more). Additionally, an increased number of wells to be supported are provided.

Shown in FIG. 4*f* is an arrangement corresponding to the embodiment shown and described in connection with FIG. 4*d* but where each cluster 600 comprises an arrangement according to FIG. 4*c* instead of FIG. 2.

Shown in FIG. 4*g* is an arrangement corresponding to the embodiment shown and described in connection with FIG. 4*e* but where each cluster 600 comprises an arrangement according to FIG. 4*a* instead of FIG. 2.

Shown in FIG. 4*h* is an arrangement corresponding to the embodiment shown and described in connection with FIG. 4*d* or 4*e* but where the arrangement comprises six clusters 600 instead of two or four.

Shown in FIG. 4*i* is an arrangement corresponding except as otherwise noted to the embodiment of FIG. 4*a* that comprises one centrally located shared second position 160 with a number, here twelve, first positions 150 being located around the central shared second position 160. A difference to the embodiment of FIG. 4*a*—apart from comprising a different number of first positions—is that the center-to-center distances from the second position 160 to each of the first positions 150 in the plane are not the same.

Rather, one part of the first positions 160 have a same distance to the central second position 160 while the remaining part of the first positions 160 have a another (but still same for that part) distance to the second position 160 where the first positions 160 are arranged so that the distance is alternating (i.e. a first position has a distance to the second position that is different from the distance of its immediate neighbors) giving of a 'star-like' arrangement.

This provides a more compact arrangement for a given number of first positions 160.

In some embodiments, the level of the conductors (and thereby the production trees eventually installed at the top of the conductors) will vary or alternate e.g. between two different levels. This provides more room for maneuvering the conductors between the first and second positions in the compact arrangement.

Shown in FIG. 4*j* is an arrangement corresponding except as otherwise noted to the embodiment of FIG. 2 that provides a number, here two, of centrally located shared second positions 160 and a number, here eighteen, first positions 150 being located around both central shared second positions 160 in a substantially oval pattern.

In the particular shown embodiment, a center-to-center distance from a (closest) second position of the upper end 160 to a first position of the upper end 150 is not the same for all first positions, even though some of the first positions have a substantially equal distance to the (closest) shared second position.

This arrangement, and corresponding ones, provides flexibility in that a conductor at any first position may be brought to one of the second positions. Furthermore, a relative compact arrangement is also provided.

Shown in FIG. 4*k* is an arrangement somewhat different from the earlier ones. The first and second positions still correspond to the first and second positions explained elsewhere. This particular arrangement provides a number, here three, clusters 600 where each cluster 600 provides a centrally located shared second position 160 of the upper ends of the conductors in the cluster and a number, here four, of first positions 160 arranged at a (side-)'line' on opposing sides of the central shared second position 160 so that a conductor from a first position at one end or side-line can be moved to a first position at the other end or side-line by moving past the shared second position.

Furthermore, the three clusters 600 in this arrangement is connected—specifically by a line comprising the three shared second positions—so that a conductor may be moved from a first position in any cluster to a first position in all the other clusters.

This and corresponding arrangements facilitate sort of a 'factory line' or serial well processing procedure. As an example, well processing equipment may be aligned with the shared second positions, e.g. one well processing equipment at each second position, and be rigged to carry out different well processing task and in particular different well processing sub-tasks where one sub-task should be carried out after another, i.e. there is a progression of sub-tasks.

According to the shown and corresponding arrangements, a conductor at a first position near the upper shared second position may be moved to the 'upper' shared second position where a first (one or more) task and/or sub-task is carried after. After this, the conductor may be moved to the 'middle' shared second position where different one or more tasks and/or sub-tasks is/are carried out and so on until another one or more last tasks and/or sub-tasks has/have been carried out at the 'lower' or final shared second position where the conductor then may be moved to a first position e.g. for well-intervention, or production, etc. Such an arranged may increase efficiency in relation to well processing of a number of wells.

It is to be understood that an arrangement corresponding to the one in FIG. 4*k* may provide another number of shared second positions and/or first positions and the specific arrangement could also be varied according to a given need, e.g. as shown In FIGS. 4*l* and 4*m*. The number of first positions on a side could e.g. be smaller or larger. The number of first and/or shared second positions does not need to be the same for each group. Furthermore, the number of first positions at one side of a cluster does not need to be the same as the number of first positions at the other side of the cluster. Additional and applicable variations as explained elsewhere are also possible.

Shown in FIG. 4*l* is an arrangement corresponding except as otherwise noted to the embodiment of FIG. 4*k* with a difference that each cluster 600 only comprises one first position on each side of the shared second position instead of two as in FIG. 4*k*.

Shown in FIG. 4*m* is an arrangement corresponding more or less and except as otherwise noted to the embodiments of FIGS. 4*k* and 4*l*. The shown arrangement provides a number, here six, clusters 600, comprising a second and four first position, where each cluster 600 corresponds to a cluster of FIG. 4*k*.

The clusters 600 are arranged like two arrangements of FIG. 4*k* side by side. This could e.g. be referred to as two line arrangements where line refers to a line of shared second positions. In addition, the clusters 600 also share first positions 150 with one neighboring cluster 600. In the shown example, first positions 150 are shared with the neighboring cluster 600 on the other line arrangement. So not only may a conductor be moved from shared second position to shared second position (in a given line arrangement) but it may also be moved to another/the other line arrangement.

This increases flexibility in relation to well operations possibilities.

Figure 5:
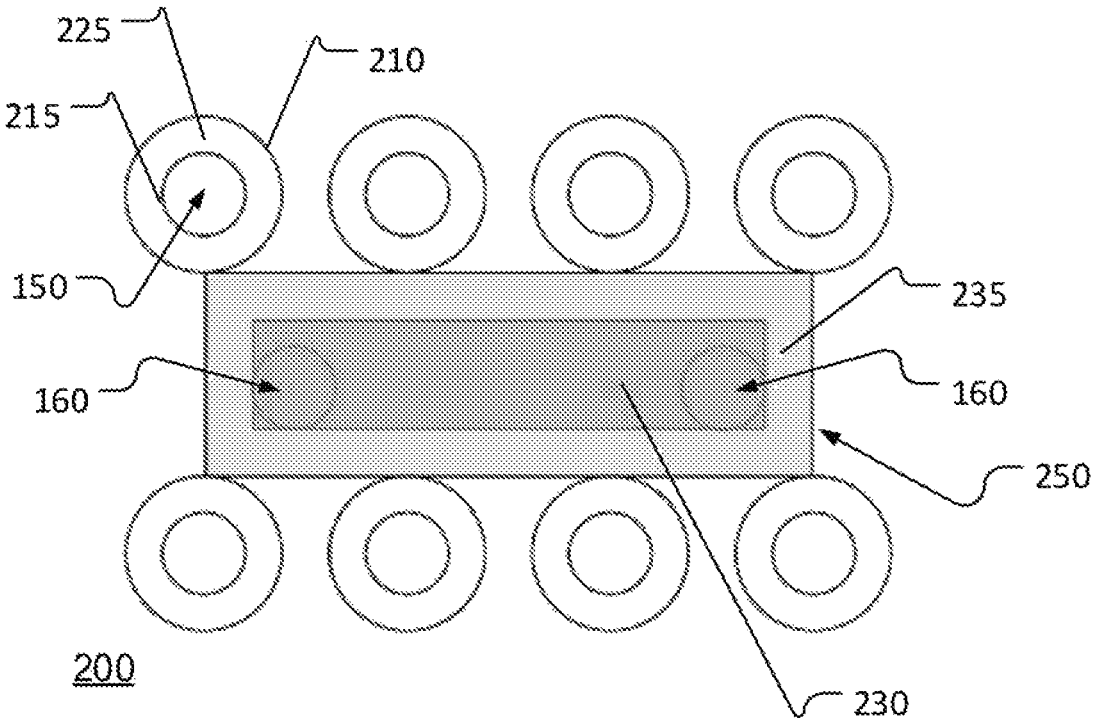
FIG. 5 schematically illustrates at least a part of a configurable support structure together with an appropriate working center zone.

FIG. 5 schematically illustrates at least a part of a configurable support structure together with an appropriate working center zone.

Shown is at least a part of a configurable support structure 200 providing a number of first positions 150 and a number of shared second positions 160 where the structure corresponds to configurable support structures as described elsewhere. This particular exemplary configurable support structure 200 comprises two shared second positions 160 and eight first positions arranged in a given arrangement.

One or more of the first positions comprises a conductor 210 comprising at least one conduit 215, e.g. a 20" conduit, and having a clearance gap 225 between the outer part of the conductor 210 and the conduit 215.

Indicated is a working center zone 250 projected or superimposed on to the plane shown, e.g. projected or superimposed on a wellhead deck of the offshore wellhead platform. The offset zone 230 is to be positioned under the well processing station(s) of an offshore well processing system (see e.g. 410 and 400 in FIGS. 3 and 8). The working center zone 250 comprises an offset zone 230 or the like to accommodate for tolerances when positioning the offshore well processing system to perform one or more well processing tasks on the wells of the configurable support structure 200. In some embodiments, the working center zone 250 further comprises an additional zone 235 to safely accommodate effects of weather on equipment during performing well processing tasks.

In some embodiments, the working center zone 250 (and in particular the offset zone) will have a generally elongated shape (that does not need to be square; it could e.g. be oval or other). This is advantageous for offshore well processing systems having its well processing station(s) located on a cantilever system or the like.

Larger tolerance, and thereby size of the working center zone 250, is generally advantageous in the transverse direction (left/right in FIG. 5) of the primary movement direction of the cantilever system and less in the primary movement direction (up/down in FIG. 5).

The working center zone 250 should be designed to not be too large, as this will take up valuable working space on the wellhead platform.

In some embodiments, the working center zone 250 has dimensions selected from about 0.25×0.25 meters to about 10×25 meters. In some embodiments, the working center zone 250 has dimensions being about 5×15 meters. In some embodiments, the working center zone 250 has dimensions being about 3×10 meters. In some embodiments, the working center zone 250 has dimensions being about 2×7.5 meters. In some embodiments, the working center zone 250 has dimensions being about 1.5×5 meters. In some embodiments, the working center zone 250 has dimensions being about 1.3×4 meters.

Figure 6A:
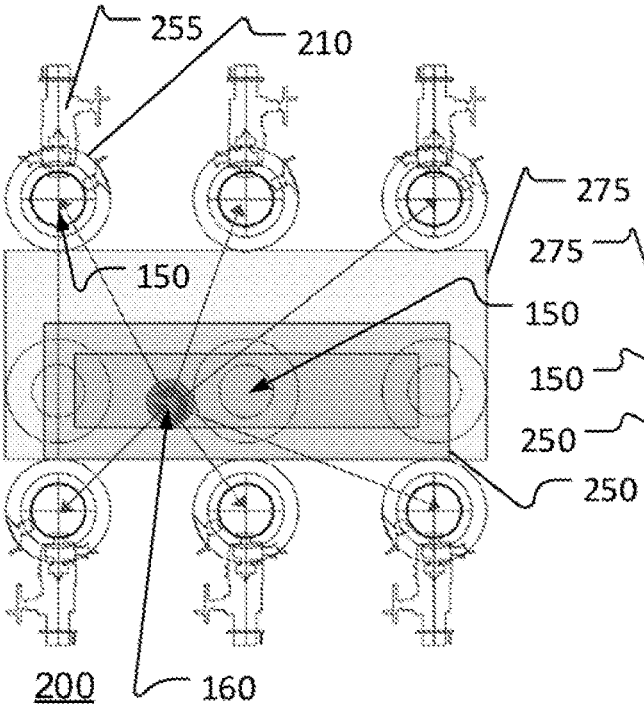
FIGS. 6*a* and 6*b* schematically illustrate at least a part of a configurable support structure after conductors have been installed at first positions located in a working center zone and after installation of x-mas trees on these conductors, respectively.
Figure 6B:
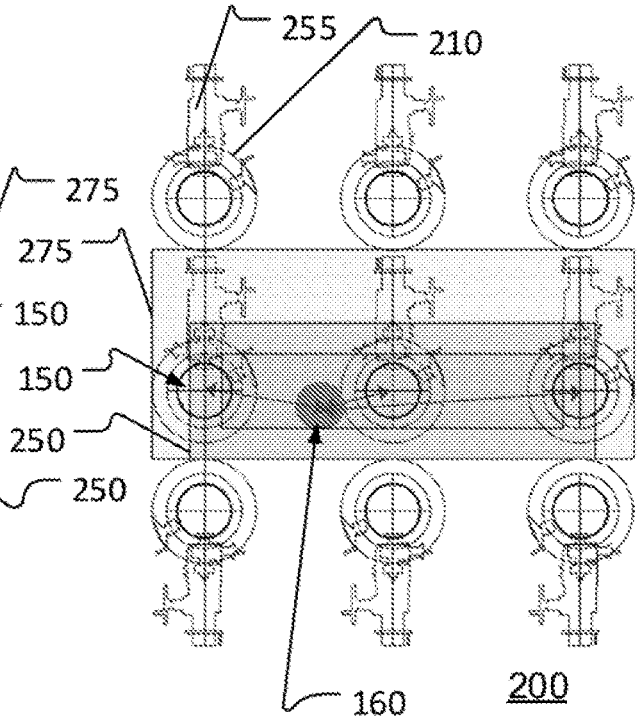

FIGS. 6*a* and 6*b* schematically illustrate at least a part of a configurable support structure before and after conductors have been installed at first positions located in a working center zone.

Shown in FIG. 6*a* is at least a part of a configurable support structure 200 providing a number of, here as an example one, shared second positions 160 and a number of, here as an example nine, first positions 150. Further illustrated is a working center zone 250, a transit zone 275, and a number of conductors 210.

The transit zone 275 is a zone defining the space needed for moving an upper part of the conductors 210 between relevant first and second position(s) 150, 160. According to one convention, the transit zone 275 will not comprise the (regular) first positions 150 (except for the additional wells completed subsequently according to some embodiments—as explained below) in the working center zone 250. It should be noted that physically, the configurable support structure 200 will generally comprise an opening (at least)

being of about the size of the transit zone 275 and the (regular) first positions 150, e.g. including further space if preferred. According to this convention, the transit zone 275 may be seen as an upper physical opening of the configurable support structure 200 minus the space needed for the (regular) first positions.

As can be seen, wells have been completed at the topmost and bottom-most lines as indicated by conductors 210 comprising a valve assembly or production tree e.g. also referred to as Christmas tree, x-mas tree, etc. being mounted on the wellhead.

In FIG. 6*a*, wells at first positions 150 in the working center zone 250 have not been completed while wells at one or more (in the FIG. 6*a* it is all) of the regular first positions—outside the working center zone 250—have been completed.

FIG. 6*b* corresponds to FIG. 6*a* with the exception that here the wells in the first positions 150 (then e.g. denoted additional first positions) in the working center zone 250 have now been completed.

This illustrates that after wells have been completed outside the working center zone 250 (i.e. the 'regular' first positions), the area of the working center zone 250 itself may be used to prepare an additional number of wells after the other 'regular' wells have been prepared since this space is no longer required for bringing the conductors of the 'regular' first positions 150 to the shared second position 160 (at least not for well construction). In this way, even the area of the working center zone 250 becomes productive after being used for the wells of the 'regular' first positions.

The double arrows illustrate the movement of the upper ends (not necessarily the actual path) of conductors between first and second positions 150, 160 as explained already.

Figure 7:
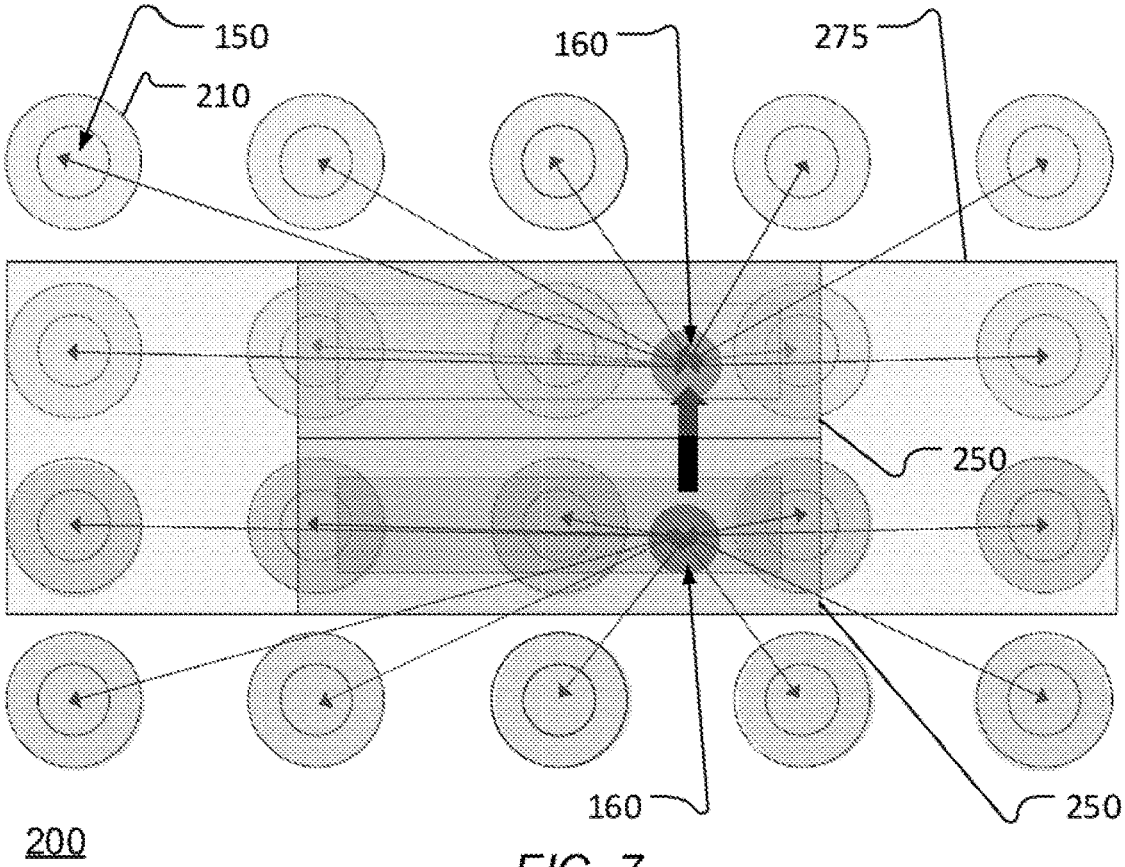
FIG. 7 schematically illustrates at least a part of a configurable support structure with a working center position at two different positions.

FIG. 7 schematically illustrates at least a part of a configurable support structure with a working center position at two different positions.

Shown is at least a part of a configurable support structure 200 providing a number, here as an example two, shared second positions 160 and a number, here as an example twenty, first positions 150 each eventually comprising a conductor 210. Further illustrated is a working center zone 250 and a transit zone 275.

During exemplary operation, the working center zone 250 is first at a lower position with the lower shared second position 160 where ten (or less) wells may be completed at the bottom ten first positions 150. After the bottom ten or less wells have been completed, the working center zone 250 is moved (e.g. by moving a cantilever system and the well center as explained elsewhere) from the indicated position to the upper shared second position 160 where the upper ten (or fewer) wells then may be completed. This process could in principle be continued.

The transit zone 275 is generally not moved.

The double arrows illustrate the movement of the upper ends or the upper parts shown in the plane (not necessarily the actual path) of conductors between first and second positions 150, 160 as explained already.

As noted above FIG. 3 illustrates a front view of an exemplary embodiment of an offshore wellhead platform and an offshore well processing system.

Shown is a wellhead platform 100 comprising a configurable support structure 200 such as the ones shown and explained in connection with FIGS. 1 and 2 and throughout the present description. The wellhead platform 100 may e.g. comprise a wellhead deck, cellar deck 101 or similar The well processing system 400, here as an example in the form of a jack-up drilling unit comprising at least one (such as two, three or more) well processing station 410 such as at least one drilling station. In some embodiments, the offshore well processing system 400 comprises at least two well processing stations or drilling stations 410.

Further shown is a main structure 510 for supporting an upper deck structure of the wellhead platform 100.

Shown are a number of conductors 210 as described earlier after well completion where a production tree 420 or the like is located on a wellhead of the well.

The offshore well processing system 400 will typically comprise a drill floor defining a well center through which one or more well processing tasks may be performed. When performing one or more well processing tasks, the well center will be located above the shared second position(s) and a riser or the like 430 will extend from the well processing station 410 to the well at a shared second position being worked upon on the wellhead platform 100.

The drill floor and well center may be positioned on a cantilever system 405 that can be extended horizontally outwards relative to the hull of the offshore well processing system 400, thus allowing the well center to be positioned outside the periphery of the unit as defined by the hull of the unit.

Figure 11B:
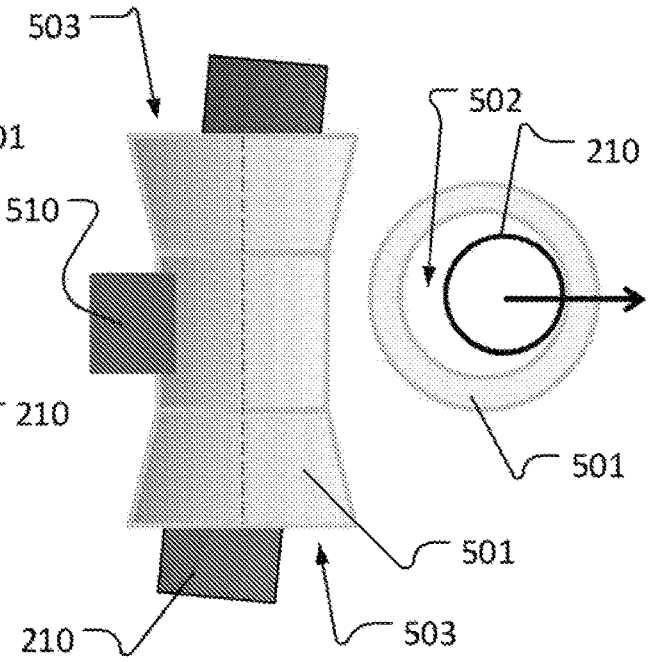
Figure 22:
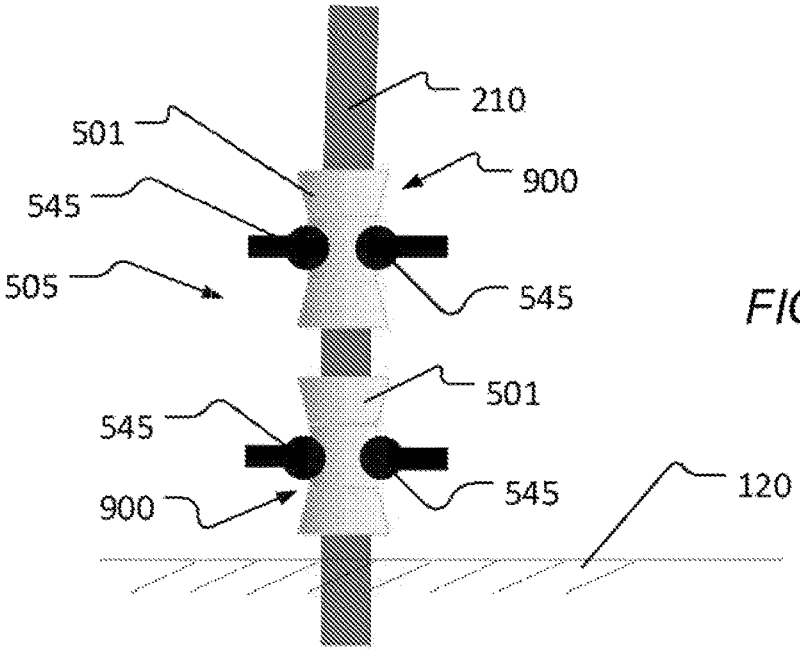
FIG. 22 schematically illustrates an exemplary double-conductor guide according to one aspect of the present invention particularly suited for a seabed well template.

The main structure 510 of the wellhead platform may also comprise a seabed well template comprising a number of conductor guides 501 e.g. as shown in FIGS. 11*a* and 11*b* and/or a number of double-conductor guides 505 e.g. as shown in FIG. 22.

In some embodiments, the main structure 510 and/or the wellhead platform 100 may e.g. support and/or guide conductors as described in connection with FIG. 21.

At least one suitable mechanism is provided on the offshore wellhead platform 100 and/or on the offshore well processing system 400 for moving an upper part of a conductor 210 between a first position and a second position as already explained.

Figure 8A:
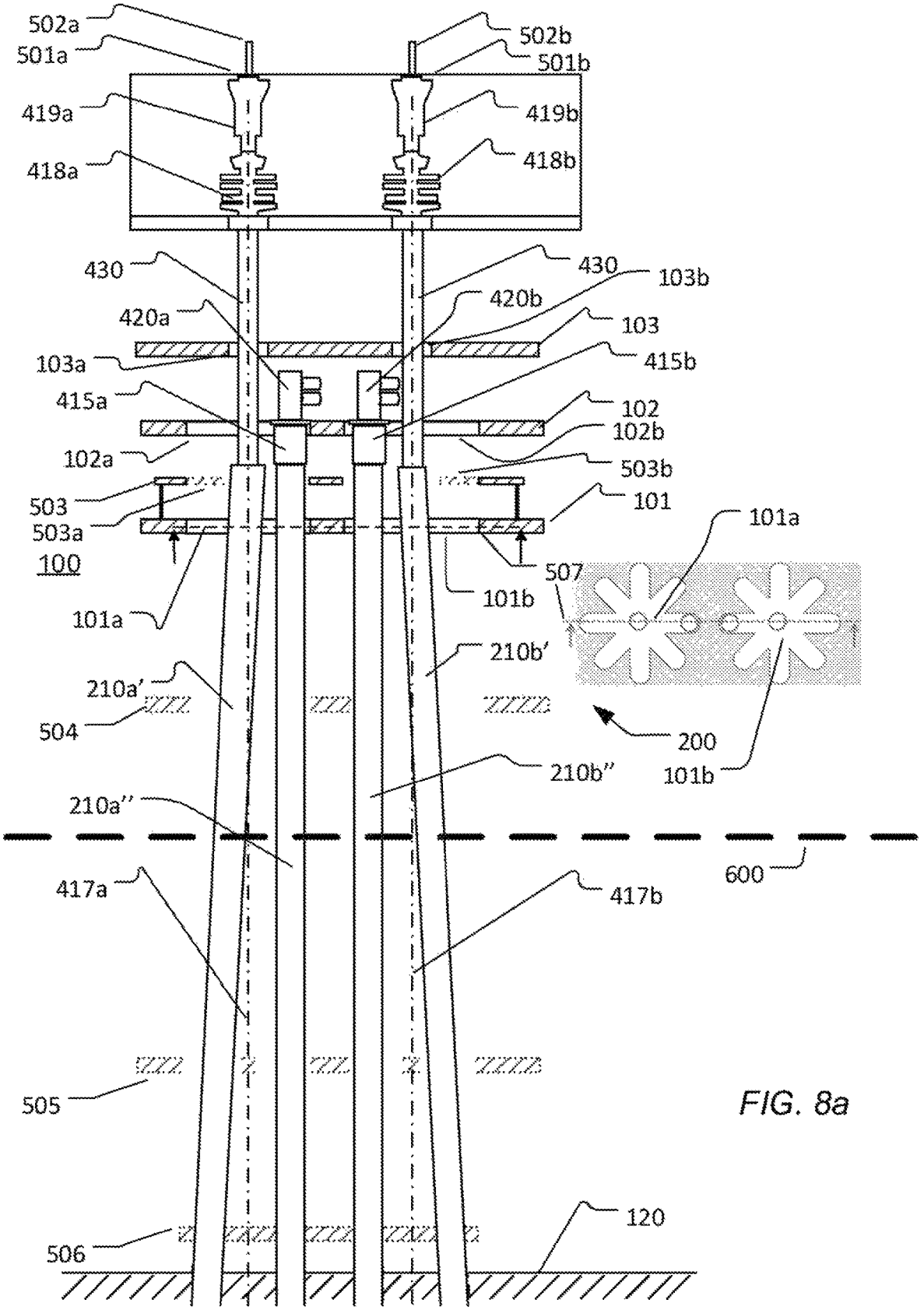
FIG. 8*a* schematically illustrates a front view of the offshore wellhead platform and an offshore well processing system.

FIG. 8*a* schematically illustrates a front view of an offshore wellhead platform and an offshore well processing system, such as those of FIG. 3, but shows only conductors, deck, and some of the configurable support structure.

Shown is a wellhead platform 100 comprising a configurable support structure 200. The wellhead platform 100 comprises a wellhead deck 101 that also constitutes the cellar deck, a x-mas tree access deck 102 and a main deck or weather deck 103. The cellar deck comprises two large openings 101*a/b*, which are part of the configurable support structure and allow movement of the upper part of the conductors 210. Corresponding openings 102*a/b* are also provided in the x-mas tree access deck 102. Further openings 103*a/b* are provided in the main deck. The opening 101*a* allows the conductors 210*a*' and 210*a*" to move their upper parts into alignment with work center position of the wellhead platform indicated by the dashed line 417*a*. Similarly, the opening 101*b* allows the conductors 210*b*' and 210*b*" to move their upper parts into alignment with work center position of the wellhead platform indicated by the dashed line 417*b*. Accordingly, the conductors 210*a*' and 210*a*" are arranged in one cluster and conductors 210*b*' and 210*b*" are arranged in a second cluster with the shared second positions of the upper ends aligned respectively with the working center 417*a* and 417*b*.

The wells of the conductors 210*a*"/b" have been completed, X-mas trees 420*a/b* and wellheads 415*a/b* have been installed and that have been placed in their respective first positions. The conductors 210*a*"/b" are shown as straight in the first positions but a as discussed the conductors may be straight in other positions of the upper end e.g. in a position between the first and second positions. The conductors 210*a*' and 210*b*' are placed in their respective second positions and connected to the well processing system 400 (in the form of a jack-up drilling unit (partially shown)) via a high-pressure riser 430. Shown is a cross section of a single cantilever 405 of the drilling unit with two drilling stations (only the drill floor and below is indicated) with diverter systems 419*a/b* located underneath the drill floor 501*a/b* and drill pipe 502*a/b* entering the upper end of the diverter through indicating the well centers of the drilling stations. The well centers are aligned with working centers 417*a/b* of the two clusters defined by the openings 101*a/b*. An exemplary top view of the layout of the configurable support structure the deck 101 is provided along the dashed line 507 in the insert. Here the conductors are seen as open circles.

An optional mezzanine wellhead access deck 503 is provided comprising openings for allowing the movement of the conductors partially installed with deck inserts, e.g. gratings, (indicated by the dotted lines around the deck section) for allowing a safe work platform. Such deck inserts may be installed in any of the openings of the other decks e.g. to provide work platforms.

Horizontal frames 504/505 for providing support elements and transferring any loads to the wellhead platform are further provided at lower levels above and below water, respectively. The conductor 210*a*' and 210*b*' are shown schematically as bend in a straight line from seabed 120 to upper end. However, generally the conductor may bend in other shapes and the support elements may be movable or fixed and above water 504 and below water 505. The support elements at lower levels may be arranged so that in the second position they are not aligned with the working center position 417 as illustrated for 505. The frame 506 provides fixed support elements for the conductors.

As discussed through the description, the configurable support structure typically comprises support elements (not shown) at least for engaging with the conductors 210 at least in the first position but preferably moving with the conductor as it is moved between the first and second positions. Here such support elements are placed in or at the cellar deck 101 and in the guide frames 504 and 505.

Figure 8B:
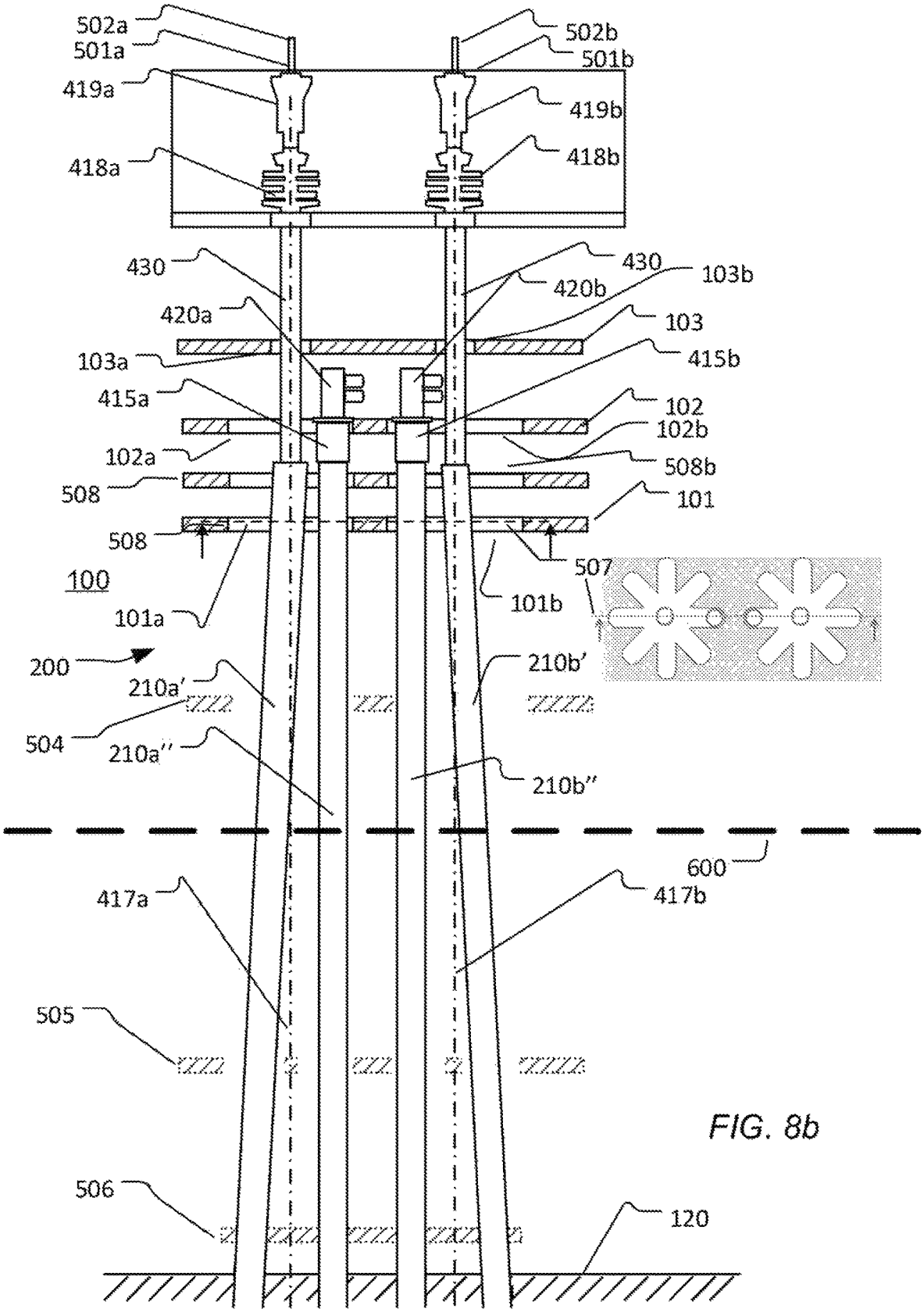
FIG. 8*b* schematically illustrates a front view of the offshore wellhead platform and an offshore well processing system.

FIG. 8*b* shows and embodiment to similar to that of FIG. 8*a* and schematically illustrates a front view of an offshore wellhead platform and an offshore well processing system. In this case the mezzanine wellhead access deck 503 is replaced by a full deck 508 now acting as a wellhead deck and preferably comprising support elements (not shown) such as guides to support the conductors at least in the first position but preferably as movable support elements that can support the conductors in their first and second positions. The cellar deck 101 is now separate from the wellhead deck 508.

For FIGS. 8*a* and 8*b*, all movement mechanisms (not shown) may be located on the cellar and/or the wellhead deck 508 and/or the horizontal frame 504. The 505 may also be used but it is most likely preferable to keep the movement mechanism in the dry zone.

Generally, and in particular for movable support elements it may be preferably to provide them with position sensors and/or load sensors—particularly if they are hard to access such as under water.

Figure 9:
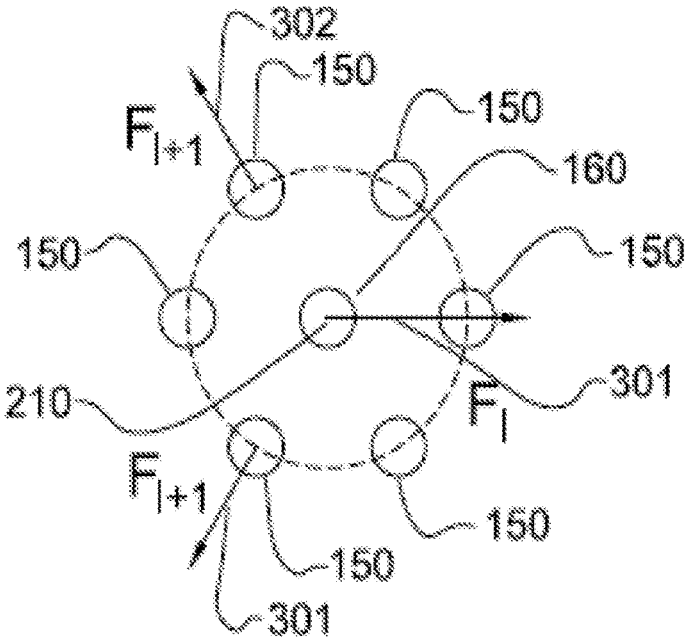
FIG. 9 schematically illustrates side force compensation according to one aspect of the present invention.

FIG. 9 schematically illustrates side force compensation according to one aspect of the present invention.

Illustrated is a configurable support structure 200 (only the relevant horizontal section is shown) providing a number (here six as an example) of first positions 150 and a number (here one as an example) of second positions 160 shared by the respective upper parts of the conductors. The first positions 150 are here located substantially equidistantly around a central second position 160.

An upper part of a conductor 210 has been moved from a first position (shown as the leftmost one in the Figure, i.e. the non-filled circle) to the central second position 160.

When the upper part of the conductor 210 is moved from its (current) first position to the second position 160 by at least one suitable conductor moving mechanism, the conductor moving mechanism will generally apply a force on the conductor in the direction of movement as indicated by the arrow denoted F_i (in the shown example going from left to right) and labelled 301. The conductor will in turn generate a force acting on the main structure of the wellhead platform in the opposite direction than the direction of movement as explained further below.

The suitable conductor moving mechanism may e.g. be any mechanism capable of moving (the upper part) of a conductor 210 e.g. by pulling, pushing, etc. e.g. such as mechanical or hydraulic push or pull, a rack and pinion drive, winch-wire, or any other suitable mechanisms for retaining, moving, shifting, etc. Examples of a suitable mechanism or system are e.g. given in FIGS. 17, 18, and 24 (see 550).

The force 301 will generally cause at least some bending stress in the conductor 210 and also generally cause stress on the main structure of the wellhead platform (not shown; see e.g. 510 in FIG. 3) via various support elements (such as supports, guides, securing elements, etc.) connecting the conductor 210 and the main structure of the wellhead platform. Depending on specific circumstances, stress may also be applied to a seabed well template through which the conductors run into the seabed. The force 301 may also be present from maintaining the upper part of the conductor 210 in the second position 160 (given the conductors minimum stress state is different from the second position 160).

According to one aspect, the stress to the main structure of the wellhead platform is relieved or alleviated at least to some extent by applying a counter force (from one or more sources) to one or more other conductors in one or more predetermined directions so that the applied counter force will negate or reduce the force 301 at least to an extent, and preferably below a predetermined minimum force tolerance level.

This will reduce the amount of stress that the main structure of the wellhead platform would otherwise be subjected to due to movement of a conductor as described.

As one example, two counter forces denoted F_i+1 and F_i−1 and labelled 302 are shown in FIG. 9.

In some embodiments, at least one support element is adapted to apply the one or more counter forces 302 that will reduce the impact of the movement force 301 on the main structure of the wellhead platform. In some embodiments, the at least one support element is the same mechanism that is used to move the upper part of the conductor 210 to the second position 160.

In some embodiments (with at least one central second position 160), the one or more predetermined directions of the counter forces 302 are directed away from the central second position 160 e.g. as shown.

In some embodiments, the counter forces 302 are applied to the two immediately neighboring or adjacent conductors (as signified by the notation i−1 and i+1).

The conductor(s) that the counter forces 302 are applied to will also in turn generate a force acting on the main structure of the wellhead platform in the opposite direction than the direction of movement of that or those conductors.

The counter forces 302 may e.g. be applied to other conductors instead or in addition. They may e.g. also be applied to only a single conductor (but then less optimally) or more than two conductors, e.g. four (preferably for embodiments with more than six first positions), etc.

The applied counter forces 302 may be selected, and preferably are, so that the sum of resulting forces acting on the conductors (the ones being moved) is substantially close to zero, or at least below a certain sufficient minimum level. I.e. the sum of (the vectors of) the force 301 and the counter forces 302 should be about close to zero or be less than the predetermined minimum force tolerance level.

The counter forces 302 should be applied when the upper part of the conductor 210 is moved to (and e.g. maintained in) the second position 160.

The conductors that counter forces 302 is applied to would need room for movement. This may e.g. be provided as shown in FIG. 10.

The aspect of applying counter forces as described above may be used regardless of a location of a natural minimum stress situation of the conductors 210.

Furthermore, the aspect of applying counter forces is not dependent on the specific layout of the conductors 210. It may even be used for conductors arranged in a grid or other patterns. When a conductor is moved in one certain direction, one or more conductors located beyond the starting point opposite the certain direction may contribute to reducing the force 301 at least to an extent, and preferably below a predetermined minimum force tolerance level.

Figure 10:
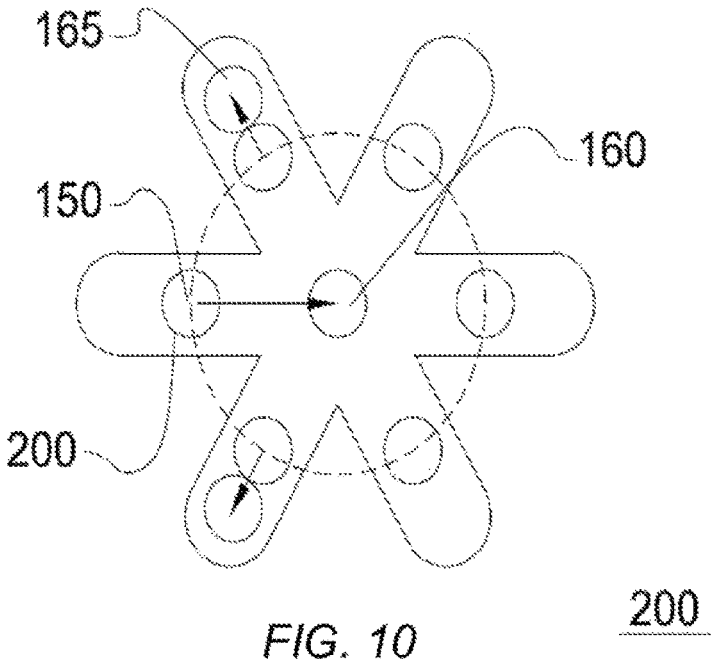
FIG. 10 schematically illustrates one exemplary embodiment of a configurable support structure facilitating side force compensation e.g.

FIG. 10 schematically illustrates one exemplary embodiment of a configurable support structure facilitating side force compensation e.g. as illustrated in FIG. 9.

Shown is at least part of a configurable support structure 200 corresponding to the one shown in FIG. 2 (and variations thereof) except as noted in the following.

The shown configurable support structure 200 (and corresponding embodiments) further provides a number of third compensation positions 165 for the conductors 210. In the shown example, the configurable support structure 200 comprises a single third compensation position 165 for each first position 150, even though it may be different, e.g. a third compensation position 165 for only one or some of the first positions 150.

The third compensation positions 165 are located more distantly from a central second position 160 than the first positions and the configurable support structure 200 further allows movement of an upper part of a conductor 210 between its first position 150 and its third compensation position 165.

In this way, it is possible to relieve or alleviate stress on the main structure of the wellhead platform—e.g. as shown and described in connection with FIG. 9—by moving the upper part of at least one, preferably an even plurality, of other conductor(s) 210 to its or their third compensation position(s) 165 when an upper part of a conductor 210 is moved to its second position 160 as represented by the three large arrows in the figure.

It should be noted, that movement of an upper part of a conductor directly from a second position to a third compensation position is not excluded and may depend on actual design of the configurable support structure 200.

In some embodiments, the upper part of conductor(s) being moved to its or their third compensation position(s) 165 are an upper part of conductors (210) being, e.g. most closely neighboring or adjacent conductors to the conductor having its upper part moved from its first position 150 to a second position 160.

It should be noted, that well processing tasks, such as drilling, completion, etc., may e.g. also be carried out through a conductor 210 when it is located at a third compensation position 165.

FIGS. 11*a* and 11*b* schematically illustrate side and top (or bottom) views of an exemplary conductor guide according to one aspect of the present invention.

Shown in FIG. 11*a* is a side view and a top (or bottom) view of one support element in the form of a conductor guide 501 for being secured to a main structure of the wellhead platform where the conductor guide 501 is—in this and corresponding embodiments—substantially cylindrical and comprises a central through-going cavity 502 adapted to receive a part of a conductor 210. The conductor 210 is shown in a vertical position. The size of the cavity should allow for some space between a received conductor 210 and an inner wall of the conductor guide 501. This space will allow for some movement of a received conductor 210 due to movement of its upper part.

In some embodiments, and as shown, the conductor guide 501 is generally elongated and comprises two opposing ends 503 where each end 503 comprises a funnel shape with the funnel expanding outwards from a center/central point of the conductor guide 501.

Shown in FIG. 11*b* is a side view and a top view of the same conductor guide 501 as shown in FIG. 11*a* but where it is shown as being secured to a securing part or element (such as a support beam or other) of the main structure 510 of the wellhead structure to support a conductor 210. Furthermore, the conductor 210 is shown in a moved position as will generally happen when the upper part of the conductor is moved between a first and second (or third) position as described elsewhere.

As can be seen the funnel shape at both ends 503 of the conductor guide 501 readily accommodate the movement of the conductor even if the conductor guide 501 would be placed at lower levels underwater closer to the seabed than the offshore wellhead platform.

This particular conductor guide 501 and corresponding embodiments thereof are a so-called passive guide, which is advantageous to use sub-sea, as it is simpler and generally would require less or no maintenance. Such conductor guides 501 may e.g. be installed (sub-sea) for as much as up to about 20 years or even longer.

Such a conductor guide 501 may also assist in securing and/or guiding a conductor during installation when the conductor is being secured into the seabed.

As mentioned, such a conductor guide 501 may also allow a tilt movement to some degree thereby accommodating a (tilting) movement of the conductor 210 when its upper part is moved.

In some embodiments, the conductor guide 501 is also lockable. Preferably only in the horizontal plane and not in the vertical plan as this would transfer forces (like the weight of the well, etc.) to the main structure 510 of the wellhead platform.

Figure 12A:
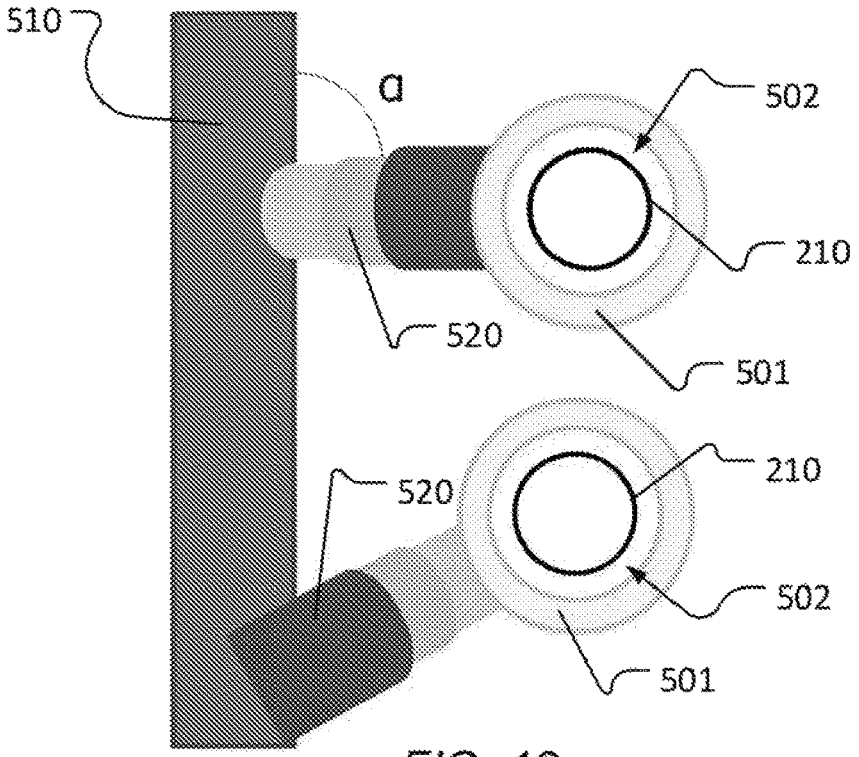
FIGS. 12*a* and 12*b* schematically illustrate a number of conductor guides, such as the ones shown in FIGS. 11*a* and 11*b*, and a number of restriction elements according to some embodiments.
Figure 12B:
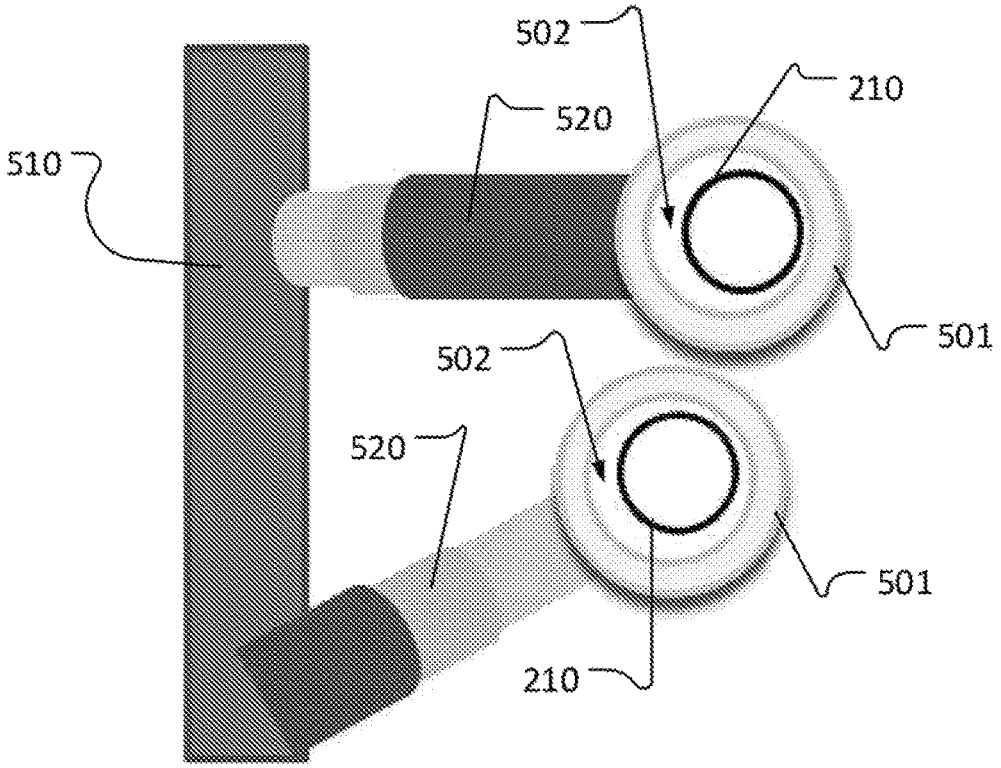

FIGS. 12*a* and 12*b* schematically illustrate a number of conductor guides, such as the ones shown in FIGS. 11*a* and 11*b*, and a number of restriction elements according to some embodiments.

Shown in FIG. 12*a* is a top (or bottom) view of two conductor guides 501 e.g. corresponding to the one shown in FIGS. 11*a* and 11*b*. Alternatively, the conductor guide 501 may be of another type. The conductor guides 501 are each connected to a securing part or element (such as a support beam or other) 510 of the main structure of the wellhead platform by a restriction element 520 that restricts movement of a conductor guide 501 to be possible only along one direction, i.e. with one degree of freedom, but back and forth. In some embodiments, the restriction element 520 is a (passive) telescopic element, like shown in the figure. Alternatively, the restriction element 520 is or comprises a resilient element or other.

A restriction element 520 is secured to the main structure 510 of the wellhead platform at an appropriate angle 'a' that defines the possible movement direction (back and forth). The angle may be the same or different for various restriction elements 520.

In this way, controlled movement of a conductor 210 along a particular direction is facilitated while generally supporting the conductor 210 (while still allowing it to move), which increases the structural stability when moving conductors between various positions.

The particular direction as allowed by the restriction element 520 (both the shown one and variations thereof as well as restriction elements and variations thereof as shown in other Figures, e.g. FIGS. 13*a*-13*c* and 14) will generally be between first and second (and/or third) positions.

It is noted, that the travel length of conductors 210 and conductor guides 501 at different levels (water depths) will generally not need to be the same. The movement distance is largest at or near the configurable support structure/upper part of the wellhead platform, and smallest at or near the seabed well template.

Shown in FIG. 12*b* is a top view of the same conductor guides 501 as shown in FIG. 12*a* but where the conductors 210 now have been moved.

Figure 13A:
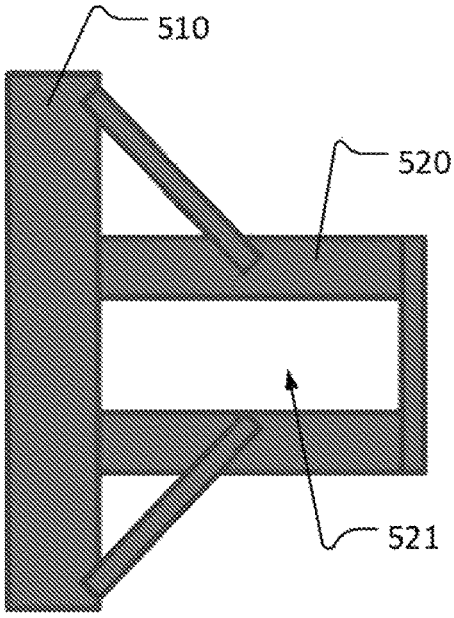
FIGS. 13*a*-13*c* schematically illustrates a conductor guide, such as the ones shown in FIGS. 11*a* and 11*b*, and a restriction element according to some alternative embodiments.
Figure 13B:
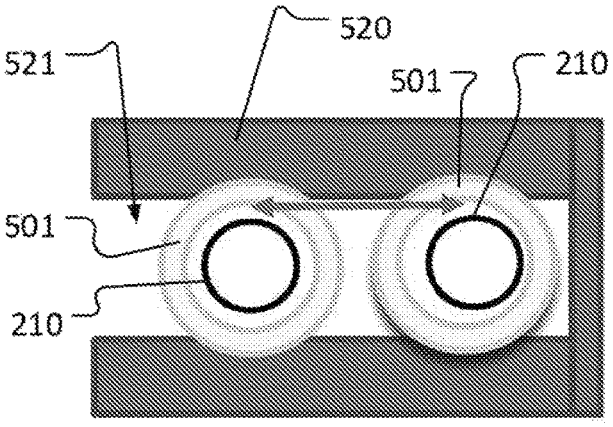
Figure 13C:
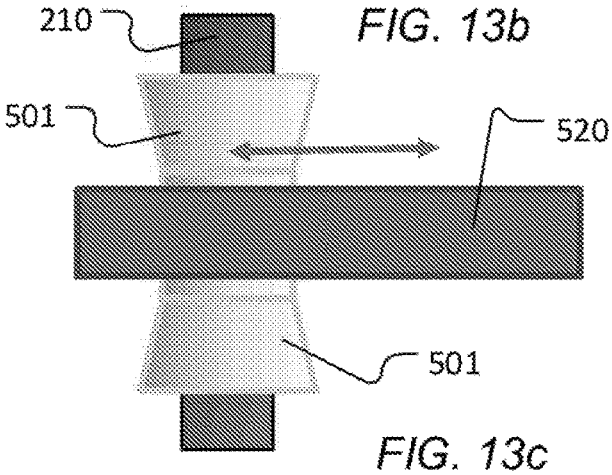

FIGS. 13*a*-13*c* schematically illustrates a conductor guide, such as the ones shown in FIGS. 11*a* and 11*b*, and a restriction element according to some alternative embodiments.

Shown in FIG. 13*a* is a top view of a restriction element 520 secured to a securing part or element (such as a support beam or other) of the main structure 510 of a wellhead platform in order to support a conductor 210.

This and similar embodiments of a restriction element 520 also only provide one degree of freedom for moving a contained conductor 210. More specifically, the restriction element 520 comprises a through-going slot, slit, or the like 521 into which a conductor guide 501 is located as shown in FIGS. 13*b* and 13*c*.

In this way, controlled movement of a conductor 210 along a particular direction (in both directions as indicated by the double arrows) is facilitated while generally supporting the conductor 210 (while still allowing it to move). This increases the structural stability when moving conductors between various positions.

The restriction element 520 function particularly well with a conductor guide 501 as shown e.g. in FIGS. 11*a* and 11 *b*.

Shown in FIG. 13*b* is a top view of the restriction element 520 but now including a conductor guide 501 as shown e.g. in FIGS. 11*a* and 11*b*. One conductor guide 501 comprising a part of a conductor 210 is shown in two positions while a double arrow indicates possible movement. Shown in FIG. 13*c* is a side view of the restriction element 520 including the conductor guide 501.

As can be seen, the restriction element 520 is in this and corresponding embodiments adapted to engage a contained conductor guide 501 at a middle or central part between its two funnel shaped ends. The through-going slot, slit, or the like 521 will together with the funnel shapes effectively prevent (too much) upwards or downwards movement of the conductor guide 501 while still allowing it to slide or move in both directions along the through-going slot, slit, etc. This increases the structural stability when moving conductors between positions.

Figure 14:
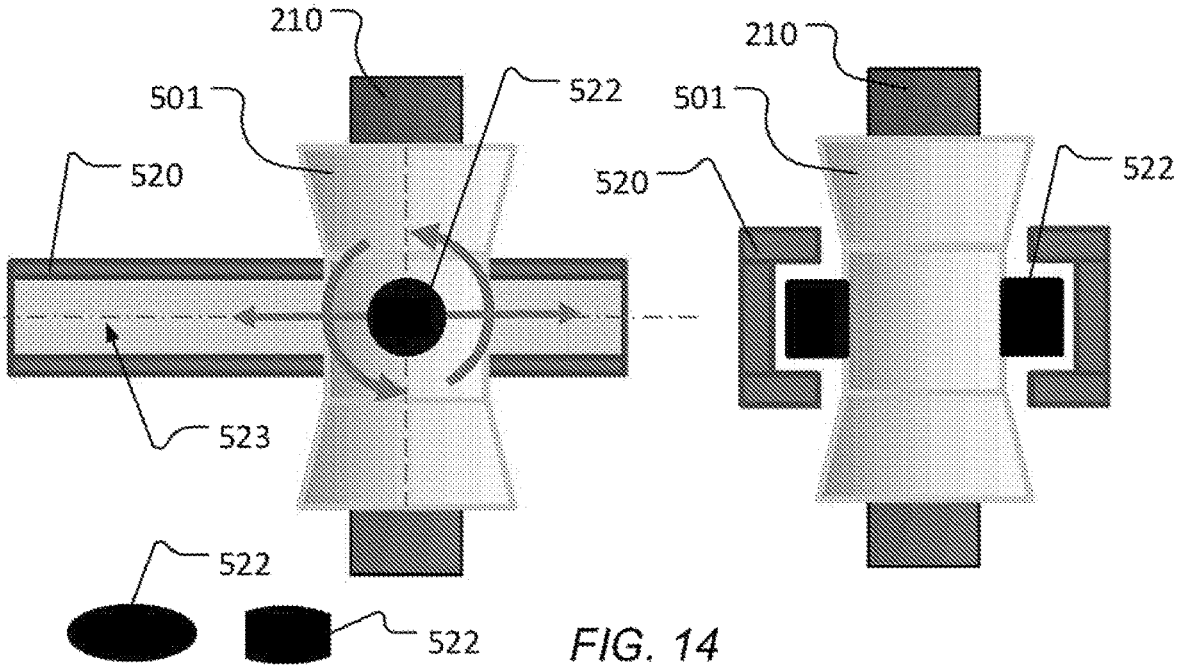
FIG. 14 schematically illustrates a conductor guide, such as the ones shown in FIGS. 11*a* and 11*b*, and a restriction element according to yet other alternative embodiments.

FIG. 14 schematically illustrates a conductor guide, such as the ones shown in FIGS. 11*a* and 11*b*, and a restriction element according to yet other alternative embodiments.

Shown in FIG. 14 is a side cross-sectional view and end or side view along a possible movement direction of another type of restriction element 520 also only providing one degree of freedom for moving a contained conductor guide 501 comprising a conductor 210.

The restriction element 520 according to these embodiments also comprises a through-going slot, slit, or the like for receiving the conductor guide 501. In addition, the restriction element 520 comprises a groove 523 along the direction of possible movement for engaging with a head or other 522 located substantially centrally and on opposite sides of the conductor guide 501. This prevents (too much) upwards and downwards movement of the conductor guide 501 while still allowing it to slide along the slot, slit, etc. Furthermore, the engaging head or other 522 may have a substantially circular outer surface fitting into the groove 523, which will allow the conductor guide 501 to tilt thereby accommodating a (tilting) movement (if any) of the conductor 210 when its upper part is moved.

The shape of the surface of the head or other 522 engaging with the groove 523 may be different than circular. As other examples are e.g. oval, partly oval, as also illustrated in FIG. 14, or other suitable shapes.

In this way, controlled movement of a conductor 210 along a particular direction is facilitated while generally supporting the conductor 210 (while allowing it to move). This increases the structural stability when moving conductors between various positions.

Figure 15:
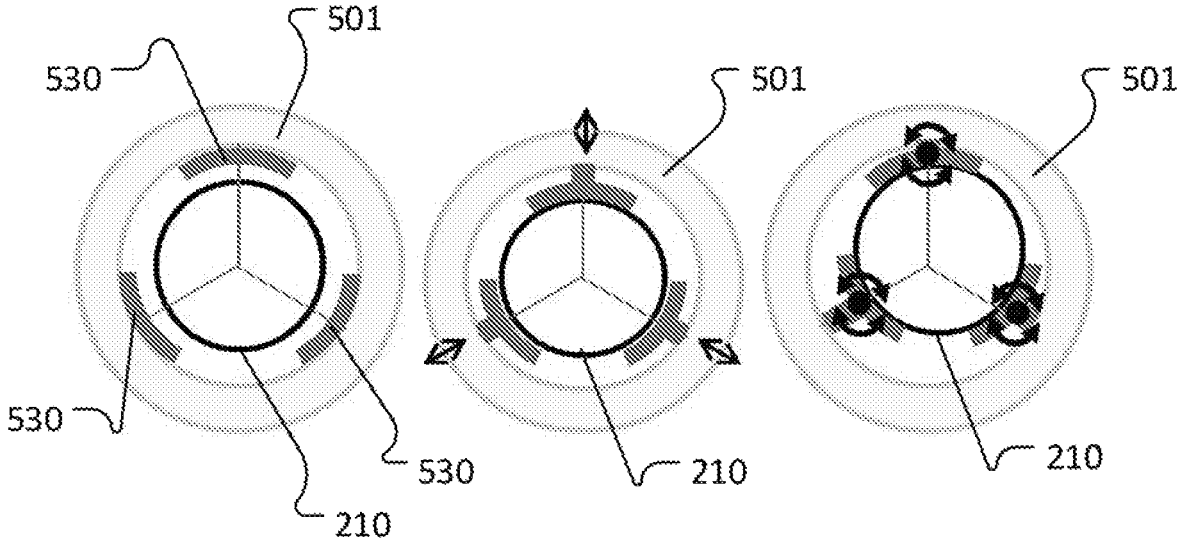
FIG. 15 schematically illustrates a conductor guide, such as the ones shown in FIGS. 11*a* and 11*b*, and conductor positioning elements according to some embodiments.

FIG. 15 schematically illustrates a conductor guide, such as the ones shown in FIGS. 11*a* and 11*b*, and conductor positioning elements according to some embodiments.

Shown is three states of a conductor guide 501, e.g. like the ones shown in FIGS. 11*a* and 11*b*, with the addition that it comprises at least one internal positioning element 530 adapted to actively position or alternatively passively follow a conductor 210 contained within the conductor guide 501. The conductor 210 may be supported at the same time.

In the shown and in corresponding embodiments, the internal positioning element 530 comprises at least three piston elements or similar secured internally to the conductor guide 501 where each piston element further comprises a (partially) rotating (passive) abutment element or the like at the end facing a conductor 210 when received by the first conductor guide 501.

If the at least one internal positioning element 530 is/are passive it will merely follow and/or impose a passively induces force (and support) the conductor 210.

However, if the at least one internal positioning element 530 is/are active it may be possible to control the x-y position (not up/down or z) of the conductor 210 within the conductor guide 501 well.

Shown to the left, is a state where the internal positioning element 530 is not active and does not engage the conductor 210 in the conductor guide 501. Shown in the middle, is a state where the conductor 210 has been centered by controlling the pistons' respective central movement as indicated by the three straight double arrows. Shown to the right, is a state where the conductor 210 has been 'offset' to a desired position.

An active internal positioning element 530 allows for 'fine-tuning' of the position of a conductor 210 (within the conductor guide 501) with two degrees of freedom.

This may e.g. be beneficial if a well processing station such as a drilling station of a drilling unit (see e.g. 400 and 410 in FIGS. 3 and 8) is not fully or sufficiently aligned with a second position or working zone, if movement of the conductor guide 501 itself is not flexible enough for a particular situation, etc.

Furthermore, centered position (middle state) may e.g. be beneficial for conductors having upper parts at their first or second position. Additionally, the inner diameter of a conductor guide can be adjusted (e.g. increased) for certain situations.

Figure 16:
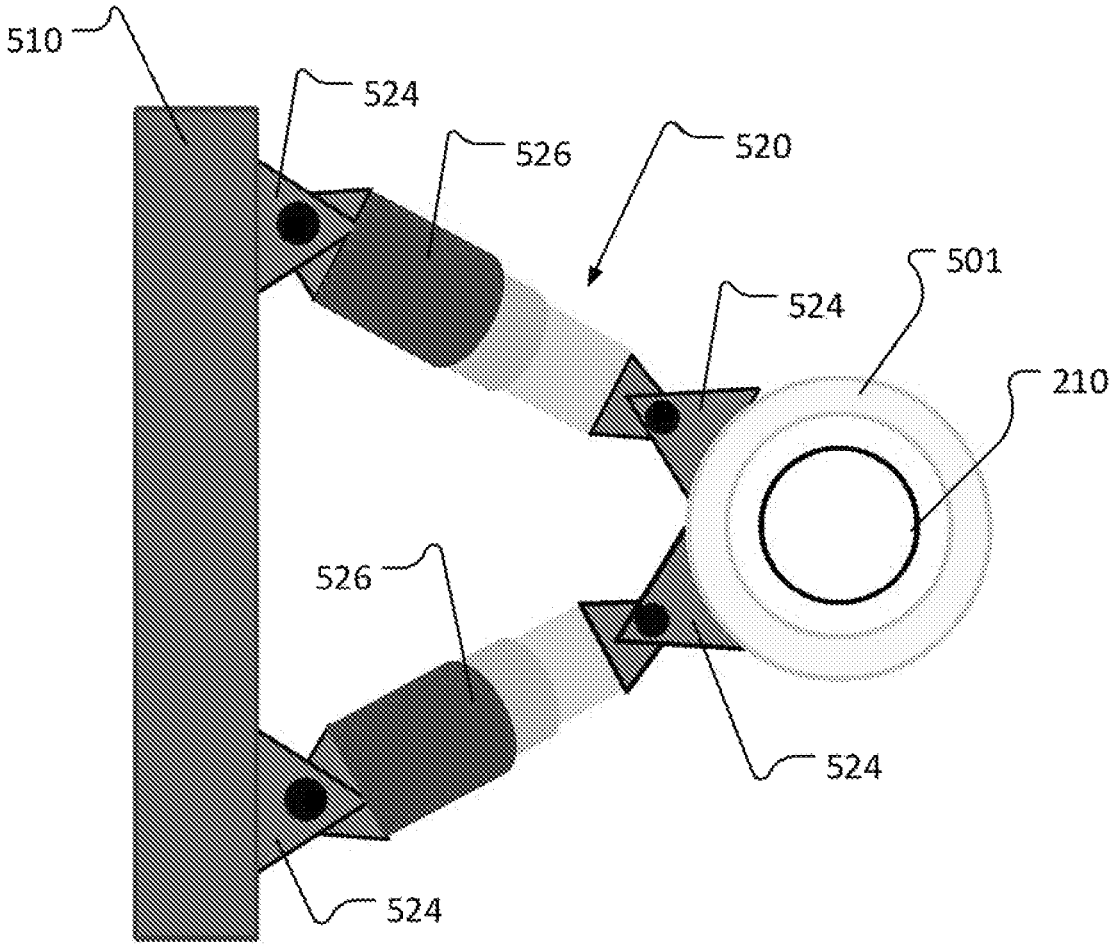
FIG. 16 schematically illustrates a conductor guide, such as the ones shown in FIGS. 11*a* and 11*b*, and conductor positioning elements according to some alternatives embodiments.

FIG. 16 schematically illustrates a conductor guide, such as the ones shown in FIGS. 11*a* and 11*b*, and conductor positioning elements according to some alternatives embodiments. Shown is a restriction element 520 being movably attached to the main structure 510 of a wellhead platform where the restriction element 520 is adapted to allow movement of a secured conductor guide 501 only in a predetermined two-dimensional (x,y) plane.

The restriction element 520 may e.g. be comprised by at least one support element.

More specifically in this and corresponding embodiments, the restriction element 520 comprises two piston elements 526 or the like, each being connected to the main structure 510 of the wellhead platform and the secured conductor guide 501 via rotating connectors 524.

The piston elements 526 may e.g. be telescopic as shown or another element providing movement in both directions along a predetermined direction.

By actively controlling the piston element or the like 526, the position of the conductor guide 501 and thereby a contained conductor 210 may be controlled with precision.

Figure 17:
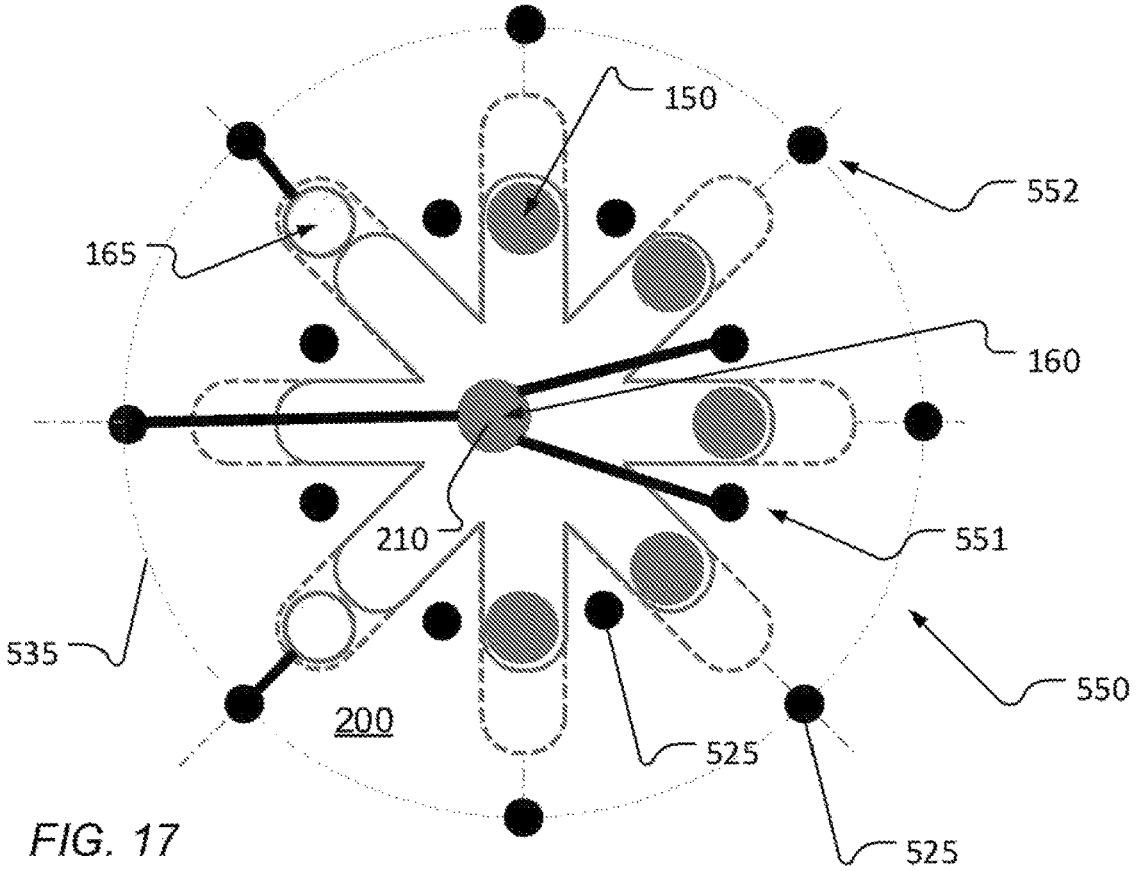
FIG. 17 schematically illustrates a configurable support structure and an arrangement for moving a conductor.

FIG. 17 schematically illustrates a configurable support structure and an arrangement for moving a conductor.

The shown configurable support structure 200 correspond to the one shown in FIG. 8 but could also be configurable support structure in another configuration, e.g. like shown in FIGS. 2 and 5 or otherwise described herein.

Shown is a conductor moving system 550 here in the form of a cable anchoring system or similar for selective movement of (an upper part of) a conductor 210 that may form part of at least one support element.

The cable anchoring system 550 comprises a plurality of anchor points 525 (here sixteen) where an upper part of a conductor 210 (presently in the Figure near or at a central second position 165) is secured to the cable anchoring system 550 by a number of (e.g. tensioned) cables to at least three of the anchor points 525.

Alternatively, the conductor 210 may e.g. be secured to at least five anchor points 525 or any other suitable, e.g. odd, number. Conductors 210 received by the configurable support structure 200 may e.g. comprise one or more lifting eyes or similar secured, e.g. welded, to the conductors 210 for attaching a cable.

The three or more (used/active) anchor points 525 are generally arranged at a first side and at a generally opposing second side.

The cable anchoring system 550 is adapted to selectively move (an upper part of) a received conductor 210 by controllably dragging or pulling one or more cables at the first side and controllably extending one or more cables at the second side thereby providing controlled movement of the conductor 210 in a predetermined movement plane. It is noted, that the sides are generally not static, i.e. they depend on what conductor 210 is to have its upper part moved and what directions/what anchor points are pulling and extending a cable.

In some embodiments (and as shown), the plurality of anchor points 525 is divided into a first group 551 and a second group 552 (the groups are not be confused with the first and second sides above) where the first and the second group 551, 552 is arranged in a first and a second substantially oval or circular ring-like pattern, respectively, where the first pattern has a lesser diameter than the second pattern and is located inside the second pattern. Other patterns may also be used depending on specific design.

In some embodiments, anchor points of a group are used to apply force in the same direction. E.g. the anchor points in the (outer) second group 552 may be used to drag or pull a cable while the anchor points in the (inner) first group 551 may be used to extend a cable.

In some embodiments, the anchor points of one group are shifted or offset in relation to the anchor points of the other group. In this way, anchor points used in one group are less obstructed by anchor points of the other group.

In some embodiments, the anchor points are distributed at different height levels. As an example, the anchor points in the first (inner) group 551 may e.g. be located lower than the anchor points in the second (outer) group 552 or whatever is suitable.

In some embodiments, the cable anchoring system 550 is adapted to move conductors 210 to their respective third compensation position 165, e.g. at the same or overlapping time when an upper part of a conductor is moved to a second position 150, as explained in connection with FIGS. 9 and 10, to compensate for side forces and stress. This may e.g. be done by securing cables between suitable anchor points 525 and the upper parts of the conductors to be moved to third positions 165 where the suitable anchor points are located behind the third positions 165, respectively and simply dragging or pulling the cable so the upper part of the conductor is pulled into the third position 165.

In some embodiments, the anchor points of the second (outer) group 552 is located on a circular (or oval, etc.) beam, rail, guide or the like 535 comprising a number of travelling wenches or other suitable equipment. In this way, the anchor points may be moved more or less freely around the central second position 160 and be brought into a desired position. This may also reduce the number of anchor points needed. Only one (outer) anchor point or pulling point is generally needed or three if two conductors are to be moved to their third compensation positions 165.

The cable anchoring system 550 may be located above—or preferably below—the configurable support structure 200.

Figure 18:
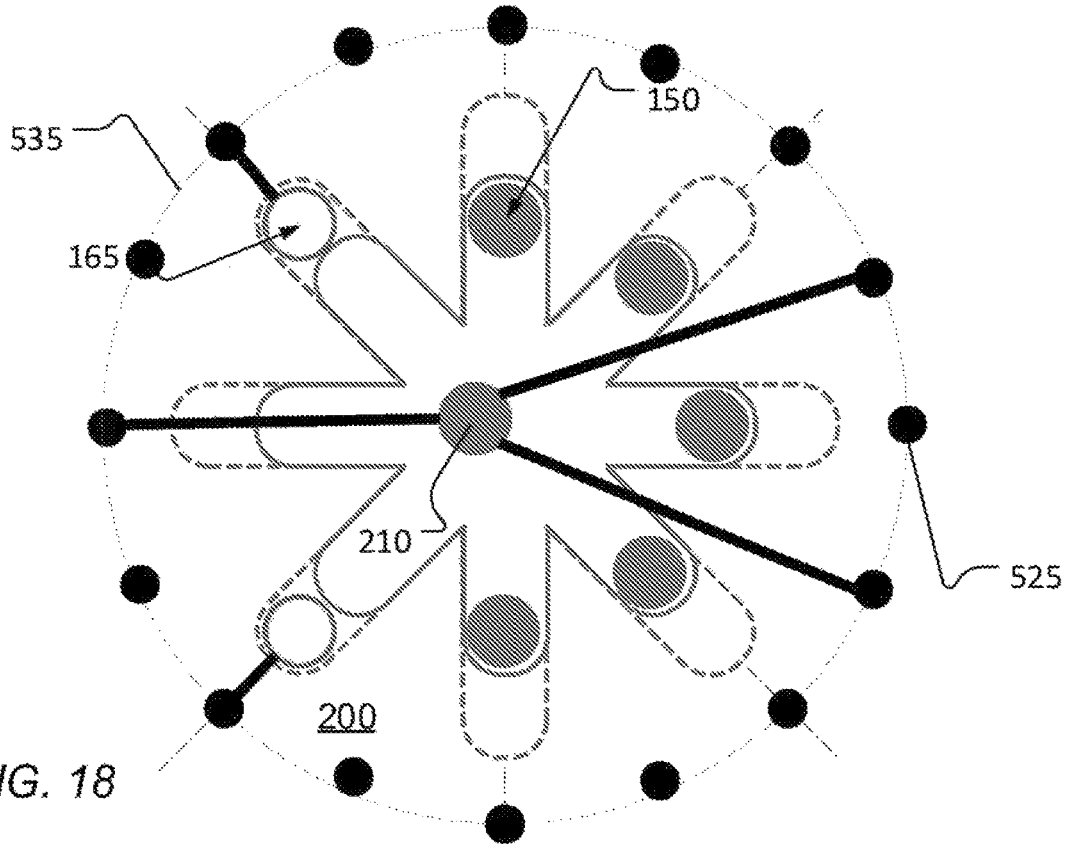
FIG. 18 schematically illustrates a configurable support structure and an alternative arrangement for moving a conductor.

FIG. 18 schematically illustrates a configurable support structure, e.g. corresponding to the one shown in FIG. 10, and an alternative arrangement for moving a conductor.

The shown configurable support structure 200 correspond to the one shown in FIG. 10 but could also be configurable support structure in another configuration, e.g. like shown in FIG. 2 or 5 or as otherwise described herein.

Shown is conductor moving system 550 here in the form of a cable anchoring system that corresponds to the embodiments shown and explained in connection with FIG. 17 except as noted in the following.

In this alternative cable anchoring system 550, the anchor points 525 are arranged as a single group in a substantially oval or circular ring-like pattern more or less located at a similar position as the second group 552 of FIG. 17. So all anchor points may be used to pull or release (at different times).

The cable anchoring system 550 of FIG. 18 is simpler to implement than that of FIG. 17.

Figure 19:
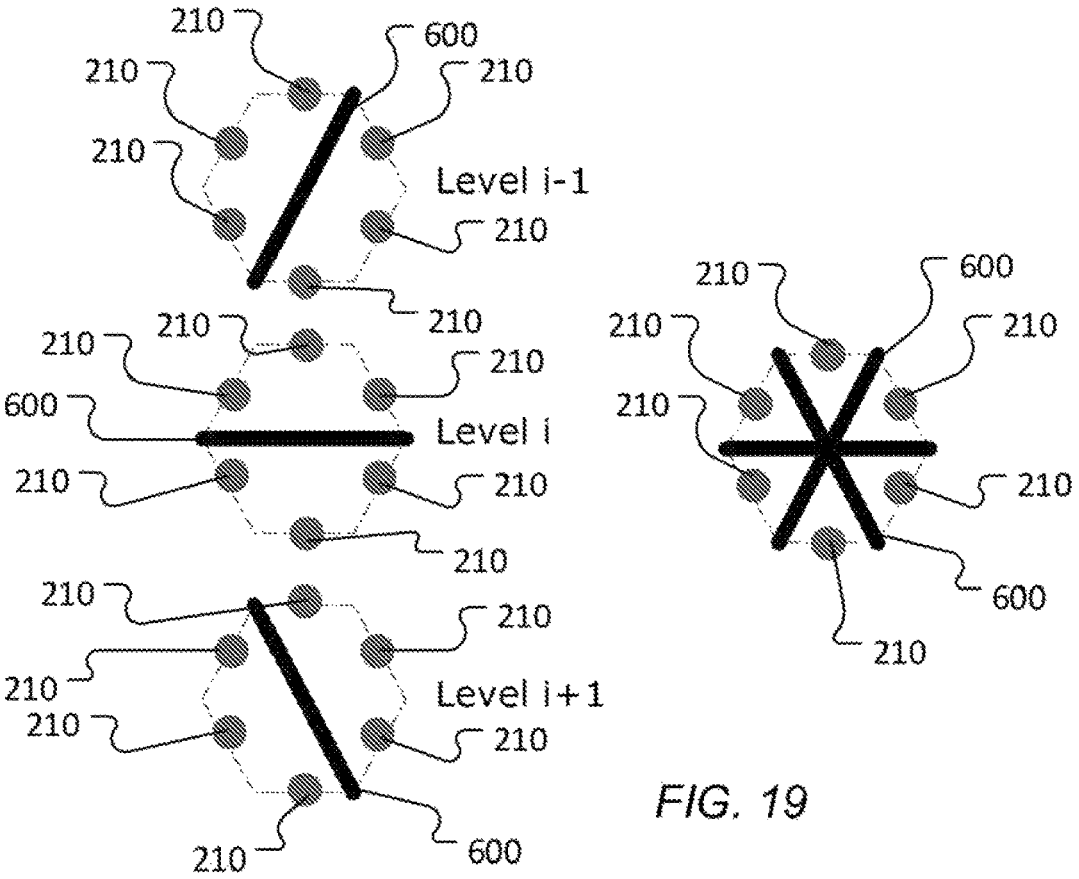
FIG. 19 schematically illustrates a number of conductor separation elements.

FIG. 19 schematically illustrates a number of conductor separation elements.

Illustrated to the left are a number of conductors 210 (at respective first positions) at different levels (i, i−1, and i+1) being arranged in a circular configuration as an example. Further shown are three conductor separation elements 600, one at each level. A conductor separation element 600 separates or compartmentalizes a number of conductors 210 from others.

The conductor separation elements 600 are rotated in a horizontal plane in relation to each other, e.g. by about 60°. As can be seen from the top view on the right, this effectively separates the conductors from each other. This avoids or at least reduces the risk of the conductors coming into contact with each other, becoming entangled, etc. when the upper parts of the conductors are moved in a simple way.

It is to be understood that another number (more or fewer) of conductor separation elements 600 than three may be used. Furthermore, more than one conductor may be present in one 'compartment'.

A conductor separation element 600 may e.g. be beam or sheet secured or welded to the main structure of the wellhead platform.

Figure 20:
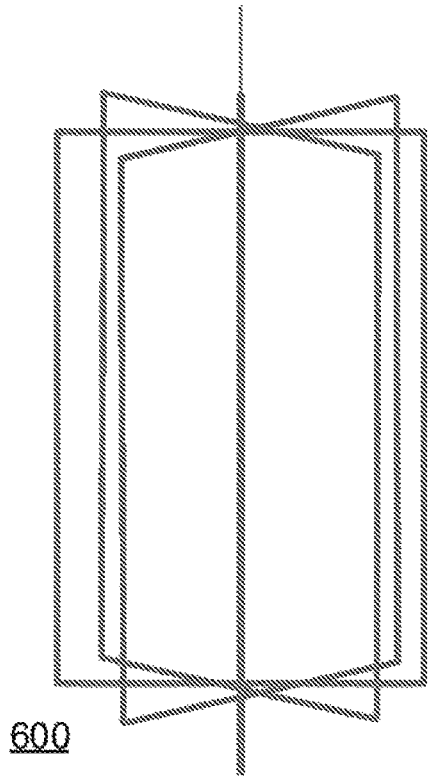
FIG. 20 schematically illustrates one alternative conductor separation element.

FIG. 20 schematically illustrates one alternative conductor separation element.

Shown is a conductor separation element 600. This provides a same effect as the separate conductor separation elements of FIG. 19 but is present at one level.

The conductor separation element 600 may e.g. be made of sheets of metal or other and be secured or welded to the main structure of the wellhead platform.

This may advantageously be placed near the well template located on the seabed or at relatively lower levels.

For a particular use, the respective conductor separation elements 600 of FIGS. 19 and 20 may be used together (e.g. at different levels).

Figure 21:
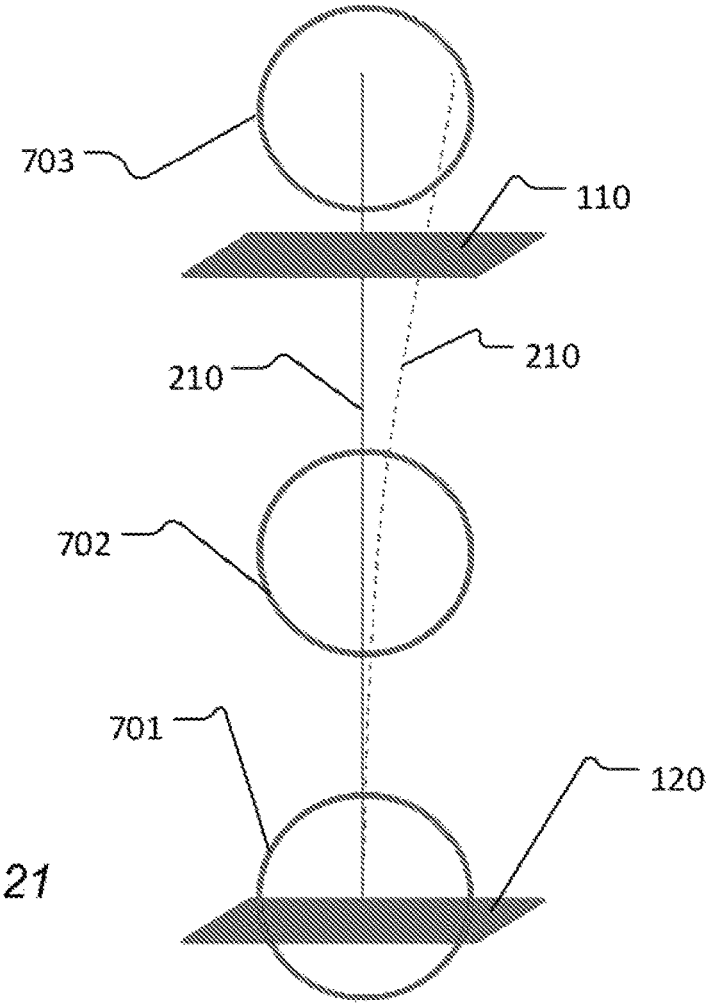
FIG. 21 schematically illustrates a conductor running from the seabed to above the sea-level together with indications of locations of various support elements.

FIG. 21 schematically illustrates a conductor running from the seabed to above the sea-level together with indications of locations of various support elements.

Shown schematically is a seabed 120 and a water level 110 where a conductor 210 is run from (below) the seabed 120 to above the water level 110 to a configurable support structure of an offshore wellhead platform (not shown; see e.g. 200 and 100 in other figures) e.g. as has been disclosed elsewhere.

The conductor 210 is shown in two positions. One indicated with a full line and one indicated with a broken line. The upper part of the conductor is moved, as explained elsewhere, between these two positions (either way) (and potentially between other positions) where one position may be a second position and the other may be a first (or third compensation) position.

Only a single conductor 210 is shown for clarity (more will generally be present) and the extent of movement of the upper part of the conductor is exaggerated.

Further indicated is a lower circle 701 near or at a seabed well template, an upper circle 703 near the wellhead deck or other deck, and a middle circle 702 in between the two other circles. Please note the circles are approximate positions, e.g. the middle circle 702 may e.g. cover everything in between the lower and upper circles 701, 703.

The circles represent expedient areas to have one or more of the various support elements as disclosed elsewhere in place.

At the lower circle 701, one or more support elements as shown in FIG. 22, one or more (preferably passive or fixed) of the conductor guides 501 and restriction elements 520 as shown in FIGS. 11*a*, 11*b*, 12*a*, 12*b*, 13*a*-13*c*, 14, 16 may be used to effect.

At the middle circle 702, one or more support elements like one or more (preferably passive or fixed) of the conductor guides 501 and restriction elements 520 as shown in FIGS. 11*a*, 11*b*, 12*a*, 12*b*, 13*a*-13*c*, 14, 16 may be used to effect.

Figure 23:
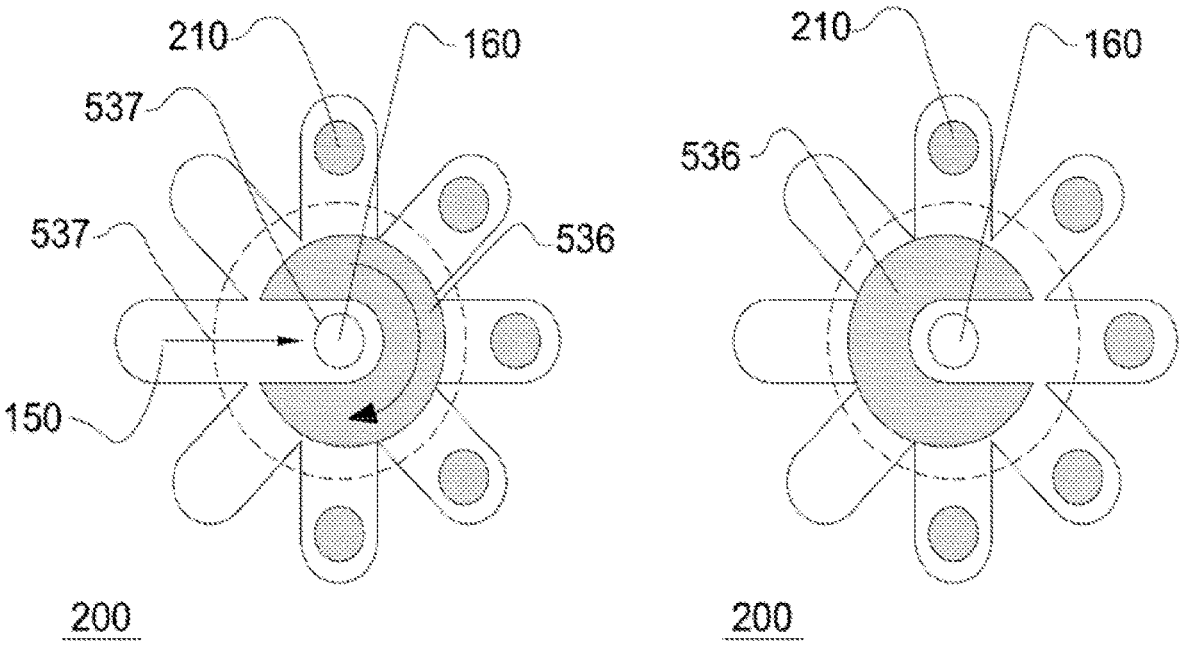
FIG. 23 schematically illustrates another embodiment of a suitable mechanism for moving an upper part of a conductor between its first position and its second position and a locking mechanism for securing an upper part of a conductor at is second position.

At the upper circle 703, one or more support elements like one or more (passive and/or active) of the conductor guides 501 and restriction elements 520 as shown in FIGS. 11*a*, 11*b*, 12*a*, 12*b*, 13*a*-13*c*, 14-16, one or more of the cable anchoring system 550 or similar as shown in FIGS. 17-18, and the mechanism for moving a conductor and a locking mechanism as shown in FIG. 23 may be used to effect.

In particular, a conductor guide with conductor positioning elements (e.g. as shown in FIGS. 15 and 16), the mechanism for moving a conductor and a locking mechanism as shown in FIG. 23, and a cable anchoring system (e.g. as shown in FIGS. 17 and 18) may be used to effect.

FIG. 22 schematically illustrates an exemplary double-conductor guide according to some embodiments of the present invention that may be particularly suited for a seabed well template. As discussed elsewhere it is often advantagous that the conductor is substantially fixed at or near the seabed. Applied at our near the seabed the configuration shown in FIG. 22 may be used as an alternative.

Shown is a double-conductor guide 505 e.g. comprising two conductor guides 501 e.g. as shown in FIGS. 11*a* and 11 *b* with the following differences. Each individual conductor guide 501 comprises two (one on each generally opposing side) rotatable joint-and-socket elements 545 or similar secured to the main structure of the wellhead platform. The two conductor guides 501 together forming the double-conductor guide 505 are located in relation to each other with one being substantially above the other (as shown).

This provides the advantage that when a conductor 210 is moved in a particular direction as already explained, the resulting stress is distributed generally or mainly at two areas—one area at one conductor guide and another area at the other conductor guide—in two generally opposite directions. As an example if the conductor is moved to the left (left in the drawing), the stress will generally or mainly be distributed at the two areas designated 900. In this way, it is ensured that the resulting stress or force is distributed and not being limited to one point or a single area.

The rotatable joint-and-socket elements 545 or similar enable a respective conductor guide 501 to tilt to some extent. Additionally, the joint-and-socket elements 545 or similar will also generally restrict movement to along one direction—providing guidance—but allowing for some tilting in a general direction orthogonal to the general allowed direction.

Such double-conductor guides 505 are particularly suited for a seabed well template that e.g. could comprise a plurality of double-conductor guides 505 (see e.g. 505 in FIGS. 3 and 8).

Corresponding triple-conductor guides, and so on for certain designs and/or uses could also be contemplated.

FIG. 23 schematically illustrates another embodiment of a suitable mechanism for moving an upper part of a conductor between its first position and its second position and a locking mechanism for securing an upper part of a conductor at its second position.

Shown is a configurable support structure 200 (only the relevant horizontal section is shown) as described elsewhere comprising a number (here eight as an example) of first and a number (here one as an example) of second positions 150, 160, a number of conductors 210, a mechanism (as represented by arrow 537) for moving an upper part of a conductor between its first position and its second position, and a locking mechanism 536 for securing and retaining an upper part of a conductor 210 at is second position 160.

The left figure illustrates a conductor 210 having its upper part moved from its first position 150 to a central second position 160 and being secured while the right figure illustrates the upper part of the conductor 210 after the move and when being in a secured state.

In some embodiments, the suitable mechanism for moving a conductor pushes the upper part of the conductor and in some alternative embodiments the suitable mechanism for moving a conductor pulls the upper part of the conductor, and/or a combination thereof.

In some embodiments, the locking mechanism 536 is rotatable or movable around the central second position 160 and comprises a central cavity for receiving an upper part of a conductor (e.g. including some extra space) where the central cavity is accessible by a slot or similar only from one general direction (at least big enough to allow passage of an upper part of a conductor plus some additional space) and closed at other directions. In some embodiments, the locking mechanism 536 has a shape generally being a C- or U-shape. This readily enables locking simply by turning the locking mechanism 536 once the conductor is in the central cavity.

In some embodiments, the suitable mechanism for moving an upper part of a conductor is rotatable or movable around the central second position 160 whereby only a single mechanism is required for moving upper parts of conductors from all first positions (when placed around a central second position).

When the upper part of the conductor is to be moved from the second position to a first position, the locking mechanism 536 is simply rotated or moved so the slot or similar faces the direction towards the first position the conductor is to be moved to (same or different first position than the one it came from) and the suitable mechanism for moving may apply a push or pull force in the appropriate direction.

Figure 24:
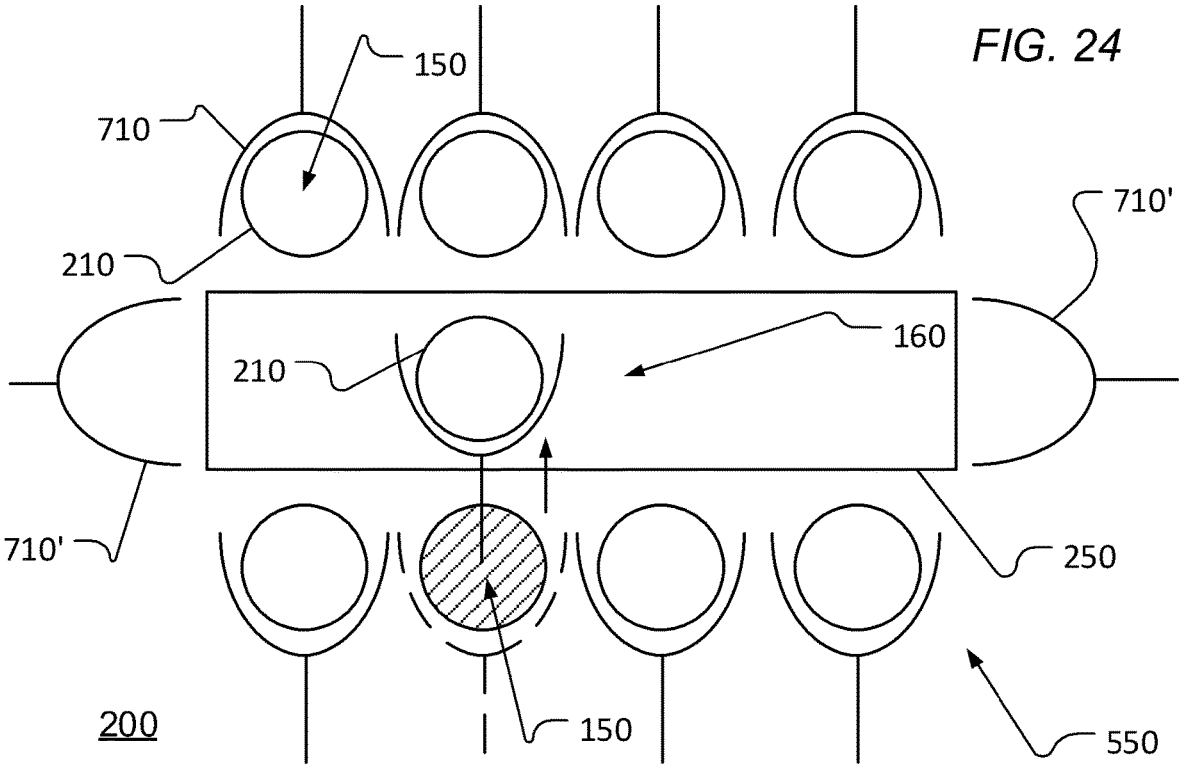
FIG. 24 schematically illustrates a configurable support structure and an alternative arrangement for moving a conductor.

FIG. 24 schematically illustrates a configurable support structure and an alternative arrangement for moving a conductor.

Illustrated is at least a part of a configurable support structure 200, e.g. corresponding to the one shown in FIG. 5 or similar, and a conductor moving system 550 for selective movement of an upper part of a conductor 210 between first and second positions 150, 160 where the conductor moving system 550 may form part of at least one support element.

Further shown are a number of conductors 210, a number of first positions 150, and a number of shared second positions 160 where the configurable support structure 200 corresponds—at least in function—to configurable support structures as described elsewhere. This particular exemplary configurable support structure 200 provides eight first positions 150 located outside a working center zone 250 wherein one shared second position 160 is arranged according to a specific arrangement. The exemplary shape of the working center zone 250 is rectangular with two shorter sides.

The illustrated conductor moving system 550 comprises a number of individual conductor movement mechanisms 710, 710'. In the illustrated and corresponding embodiments, the conductor moving system 550 comprises ten conductor movement mechanisms 710, 710' being, as an example, of two types; eight of a first type and two of a second type.

The mechanisms of the first type 710 are arranged so that each first position 150 has one particular first type mechanism 710 associated with it. The mechanisms of the first type 710 are each responsible for moving an upper part of one conductor from a first position 150 into the working center zone 250 and moving the upper part of the conductor back again from the working center zone 250 to its or a first position 150. Accordingly, the mechanisms of the first type 710, in some embodiments, need only to be able to move an upper part of a conductor only along one direction, i.e. with one degree of freedom, but back and forth.

A conductor moving mechanism of the first type 710 may be any mechanism that can push and pull the upper part of a conductor along one direction. Such mechanisms can be fairly simple. As a specific example, the conductor moving mechanism of the first type 710 may e.g. be of the piston type. The conductor moving mechanism of the first type 710 can alternatively be more complex and capable, and e.g. be capable of moving an upper part of a conductor in one or more desired directions.

The mechanisms of the second type 710' are responsible for moving an upper part of a conductor located somewhere in the working center zone 250 to the shared second position 160 (or to one or more if several shared second positions are arranged in the working center zone 250).

In some embodiments, the mechanisms of the second type 710' are capable of moving the upper part of a conductor 210 with two degrees of freedom (X-Y) as this allows for precise placement of the upper part of a conductor at a (shared) second position 160.

A conductor moving mechanism of the second type 710' may be any mechanism that can push and pull the upper part of a conductor with two degrees of freedom (X-Y). As a specific example, the conductor moving mechanism of the second type 710' may e.g. also be of the piston type, but will generally be more complex than the conductor moving mechanism of the first type 710.

In the shown exemplary embodiment, the conductor moving mechanisms of the second type 710' are located at the shorter sides of the rectangular working center zone 710.

The moving mechanisms (of both types) are e.g. each adapted to secure an upper part of a conductor to it during movement. They may e.g. be circular (instead of fork-shaped as shown) with an opening for receiving an upper part.

Illustrated in FIG. 24 is a conductor moving mechanism of the first type 710 moving an upper part of a conductor 210 into the working center zone 250 as indicated by the arrow. The originating first position is shown as a hatched circle and the starting position of the conductor moving mechanisms of the first type 710 responsible for moving the upper part of the conductor 210 is shown as a dashed conductor moving mechanism. Now only remains, for a conductor moving mechanisms of the second type 710' to position the upper part of the conductor 210 at the (shared) second position 160.

This readily allows for precise and controlled movement of an upper part of a conductor 210 between first and second positions 150, 160 in a working center zone 250.

In some embodiments, the first and second types of moving mechanism 710, 710' are working at different height levels as this reduces the risk of collision.

In some embodiments, only one mechanism of the second type 710' is used instead of two, then e.g. located at either of the shown locations. In some further embodiments, a single mechanism of the second type 710' is able to be moved e.g. between the two sides of the working center zone 250 as shown to have a mechanism of the second type 710'.

Figure 25A:
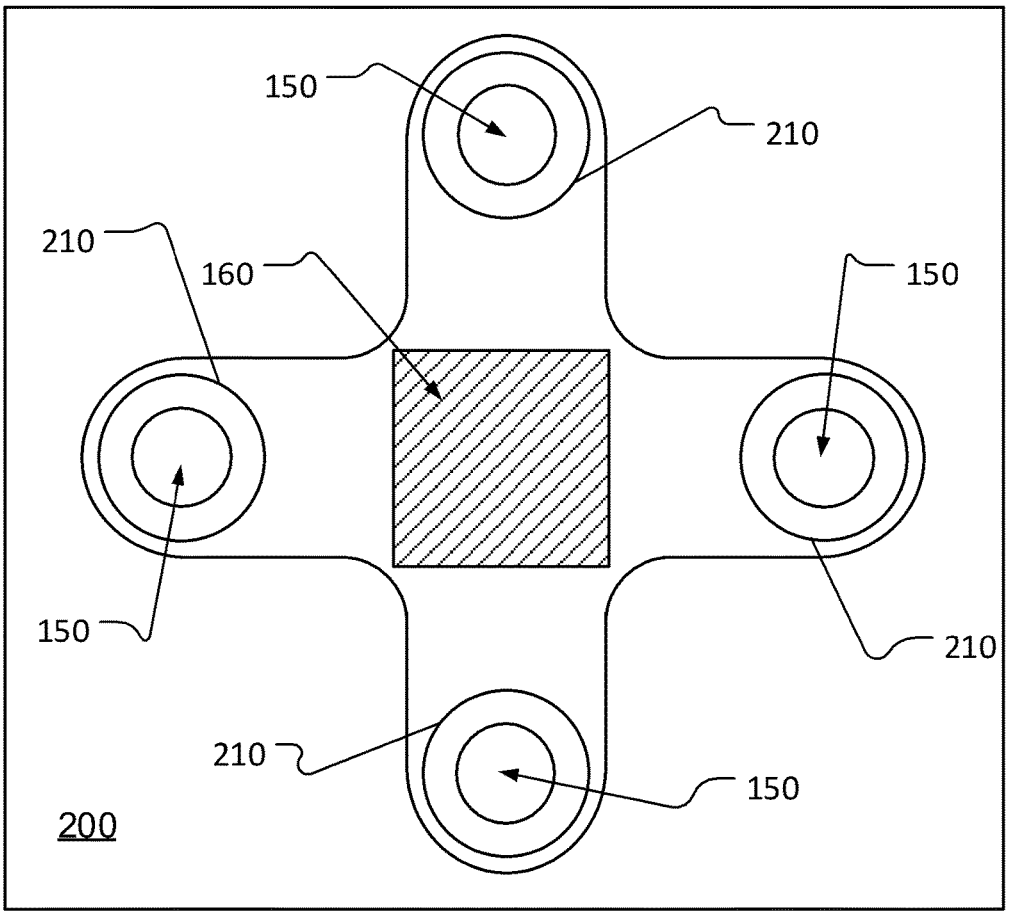
FIGS. 25*a* and 25*b* schematically illustrates another embodiment of a configurable support structure.
Figure 25B:
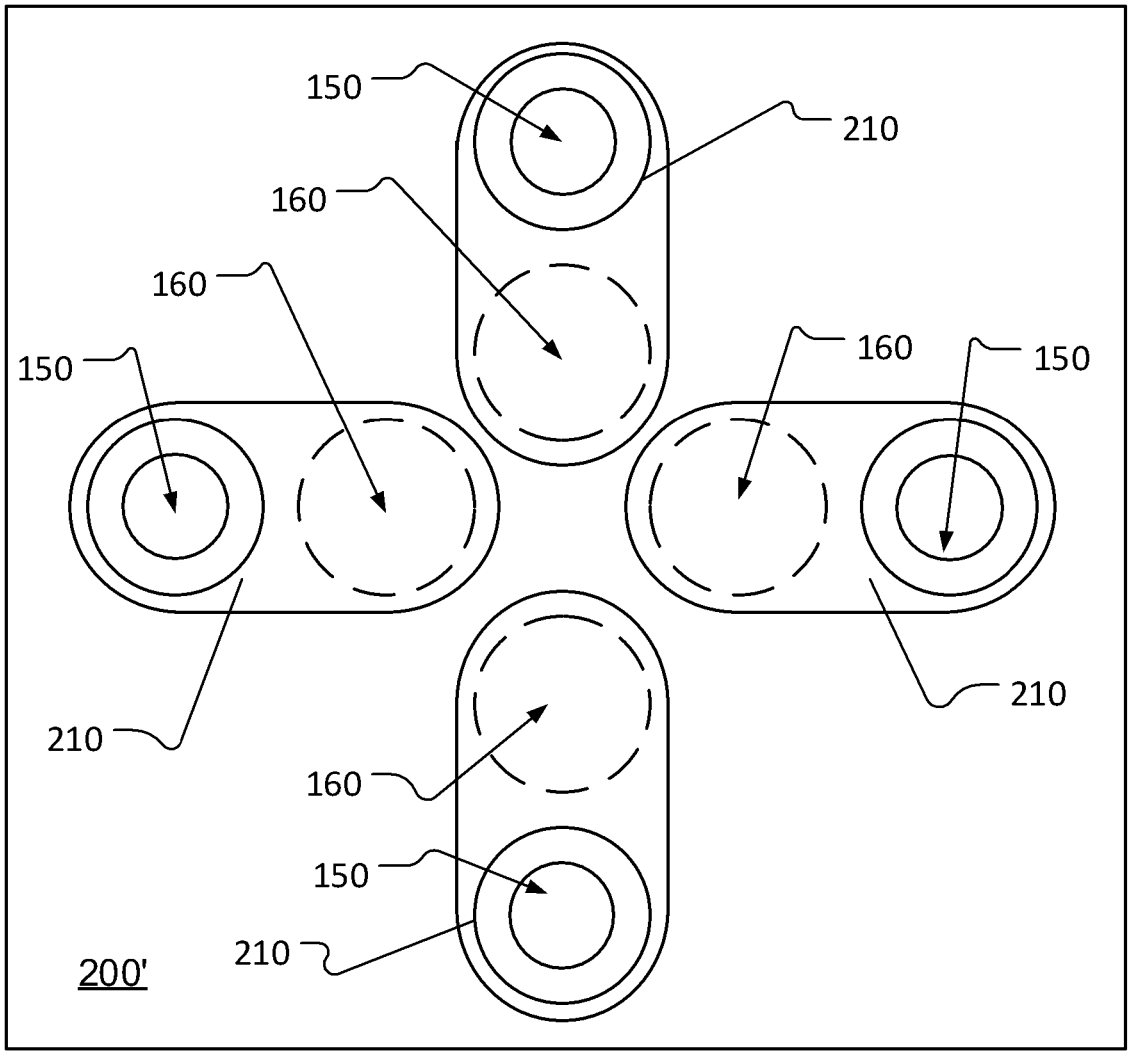

FIGS. 25*a* and 25*b* schematically illustrates another embodiment of a configurable support structure.

Illustrated in FIG. 25*a* is at least a part of a configurable support structure 200 providing a number of first positions 150 and a number of shared second positions 160 where the configurable support structure corresponds to configurable support structures as described elsewhere. This particular exemplary configurable support structure 200 comprises one shared second position 160 and four first positions 150 arranged according to a particular arrangement where four conductors 210 are shown in the first positions 150 passing through the configurable support structure 200. The configurable support structure 200 corresponds—at least in function—to configurable support structures as described elsewhere.

Apart from the number of first positions and the particular layout it corresponds to e.g. the configurable support structure of FIG. 2.

The configurable support structure 200 may e.g. be part of or comprised by a suitable deck, e.g a wellhead deck as shown as 101 in FIGS. 3 and 8*a-b* or any other suitable deck or structure located at a plane being in proximity of the upper parts of conductors once supported or engaged by the wellhead platform.

In addition to such a configurable support structure 200, the wellhead platform may e.g. comprise one or more additional structures located closer towards the seabed, e.g as shown in FIG. 25*b*. This structure may be seen as a (distinct or separate) part of the configurable support structure 200, as another configurable support structure, or as a configurable support structure-like structure.

The shown exemplary structure 200' of FIG. 25*b* also provides a number of first positions (equal to the number of first positions of the configurable support structure 200 of FIG. 25*a*) and a number of second positions 160 (here four instead of one as in FIG. 25*a*). The second positions 160 here are not shared or coinciding.

As can be appreciated, the respective conductors 210 (at this level) will be in the respective second positions (not coinciding) when the upper part of the respective conductors 210 are at the shared second position at the level of the configurable support structure 200 of FIG. 25*a*. This is due to i) the different levels of the two structures 200 200', ii) that the conductors are fixed at least near the seabed (or potentially higher up but lower than the level of this structure 200'), iii) that the conductors are fixed into the seabed with distance between them, and iv) coincide at the shared second position defined by the upper level of the configurable support structure 200 of FIG. 25*a*.

The structure 200' allows movement of the conductors 210 at its particular level when the respective upper parts of the conductors 210 are moved between their first and second positions.

The structure 200' may e.g. be combined with one or more certain conductor support element(s) as mentioned elsewhere.

It should be understood that certain embodiments or aspects of the different figures may be combined to effect while certain embodiments or aspects also may be used independently of other.

In some embodiments throughout the specification, the at least one support element comprises at least one locking element or mechanism adapted to selectively fixate a movable conductor guide in a horizontal plane and in relation to the main structure of the wellhead platform where the movable conductor guide is adapted to receive a part of a conductor. This/these may be used together with all other applicable mentioned embodiments.

Figure 26A:
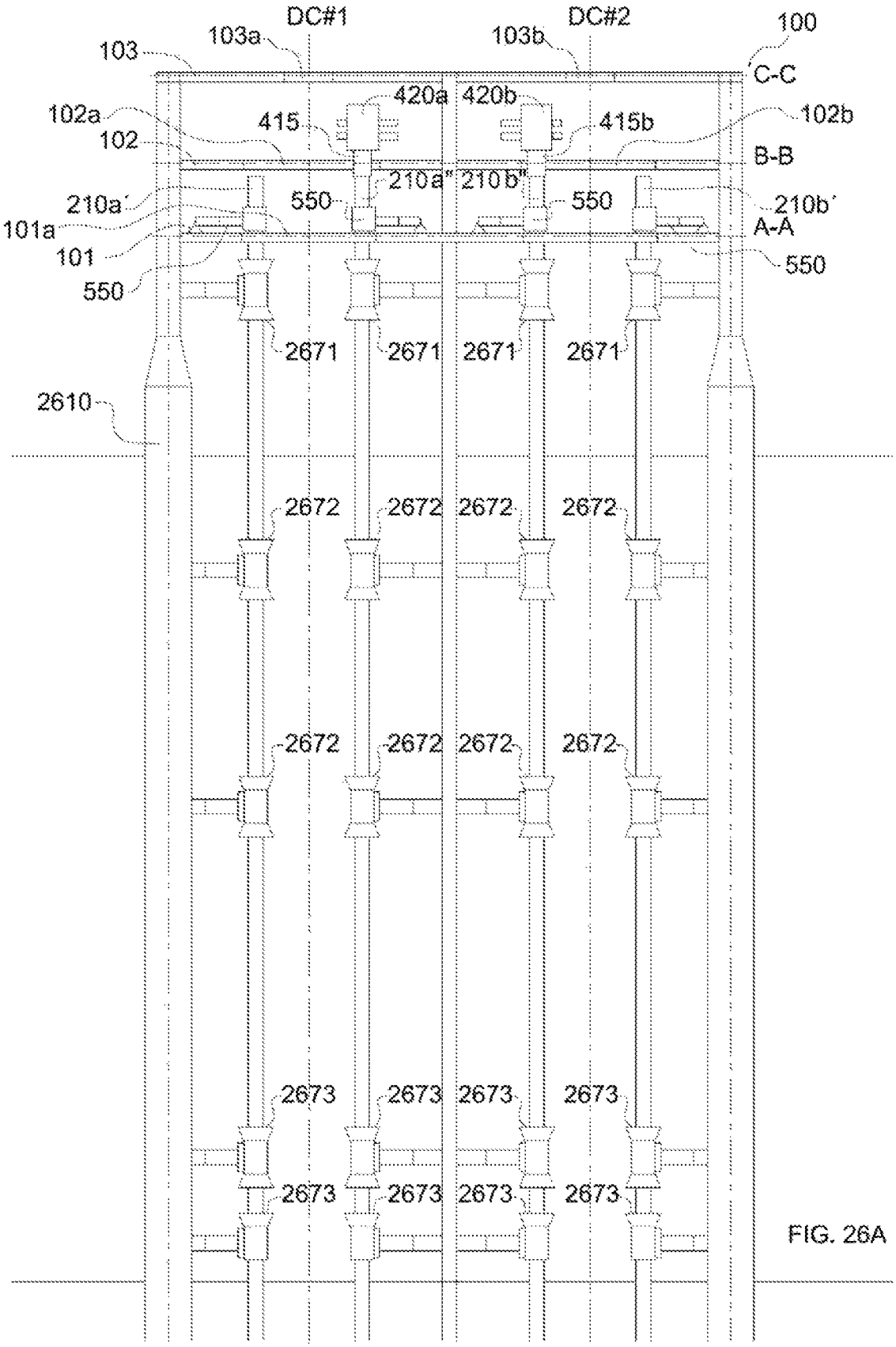
FIGS. 26*a*-*d* schematically illustrates another embodiment of an offshore wellhead platform with conductors in their respective first positions.
Figure 26B:
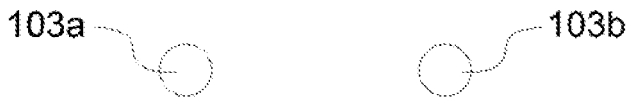
Figure 26C:
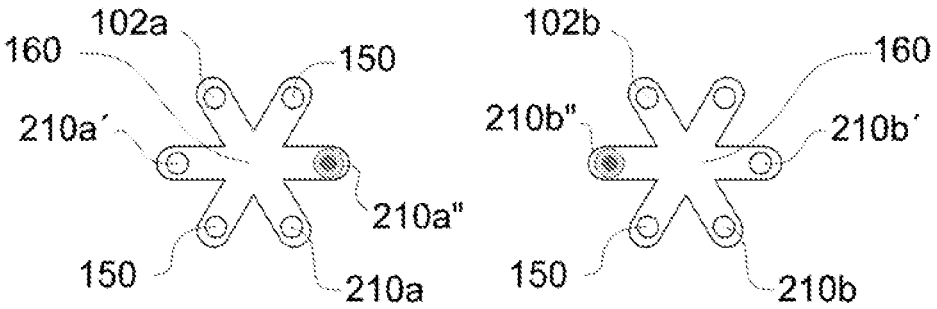
Figure 26D:
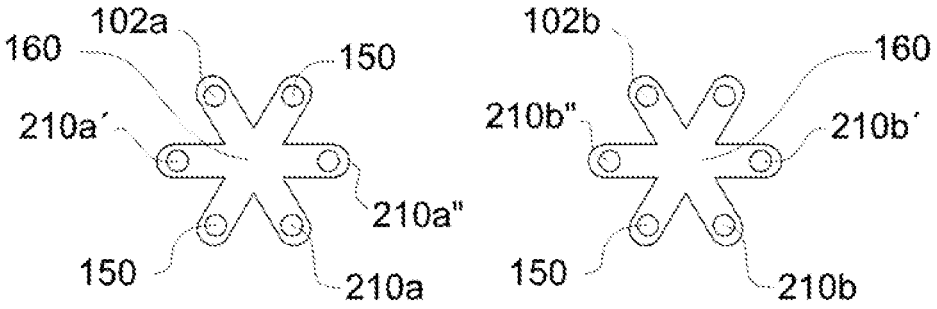
Figure 27A:
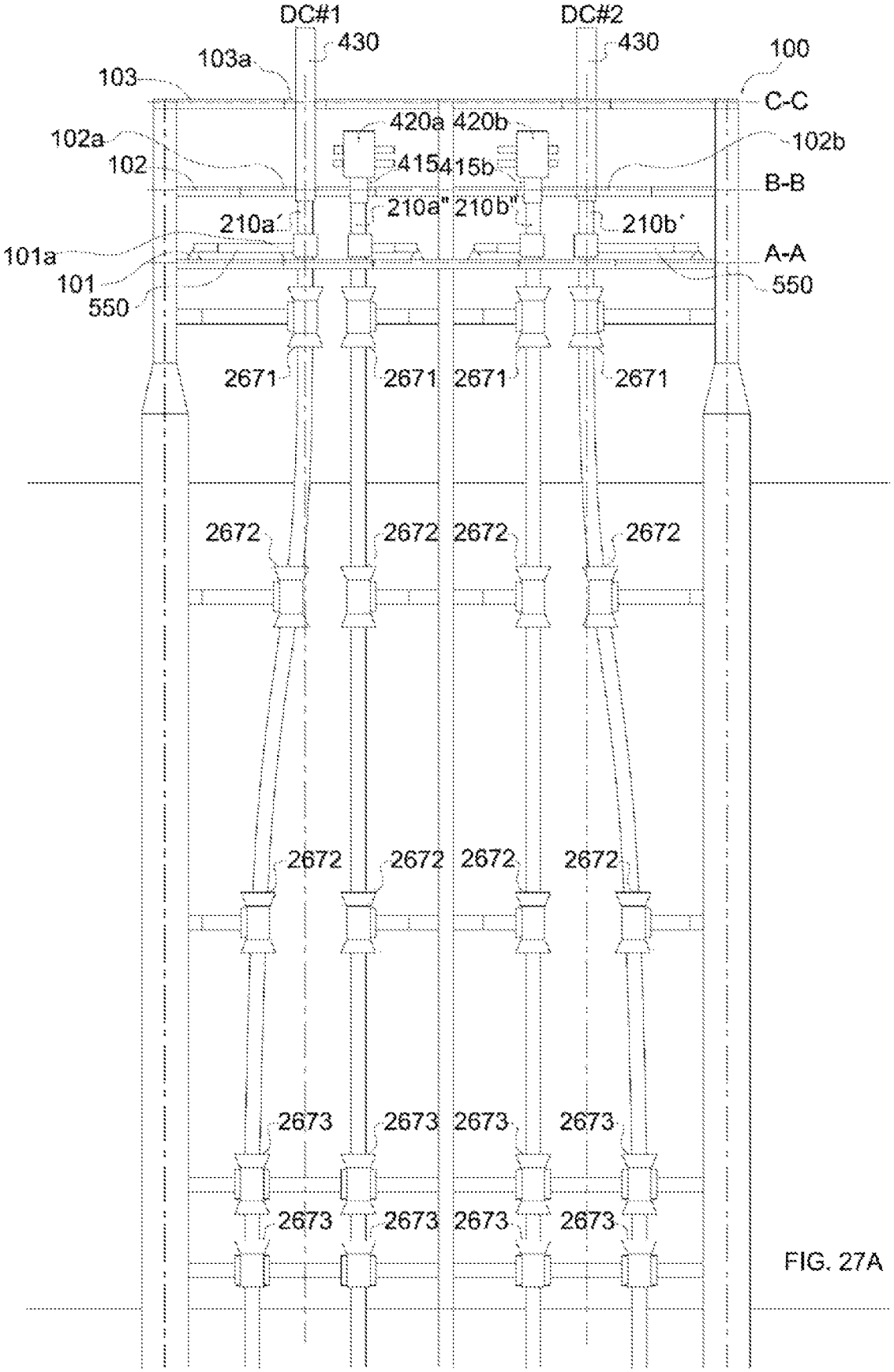
FIGS. 27*a*-*d* schematically illustrates the embodiment of an offshore wellhead platform of FIGS. 26*a*-*d* but with two conductors in their respective second positions and FIG. 27*e* illustrates these two conductors reverted to the first positions of the upper ends.
Figure 27B:
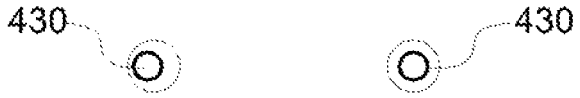
Figure 27C:
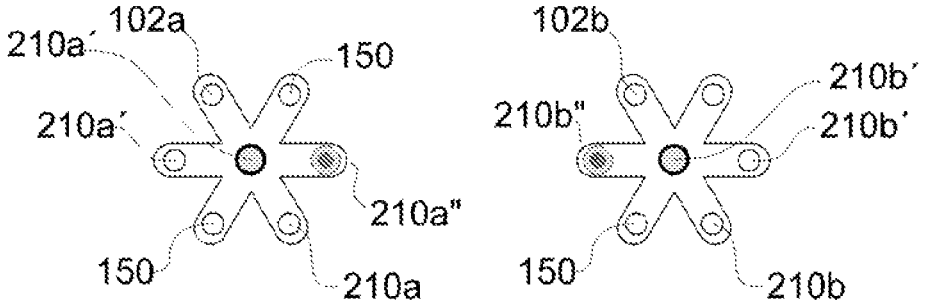
Figure 27D:
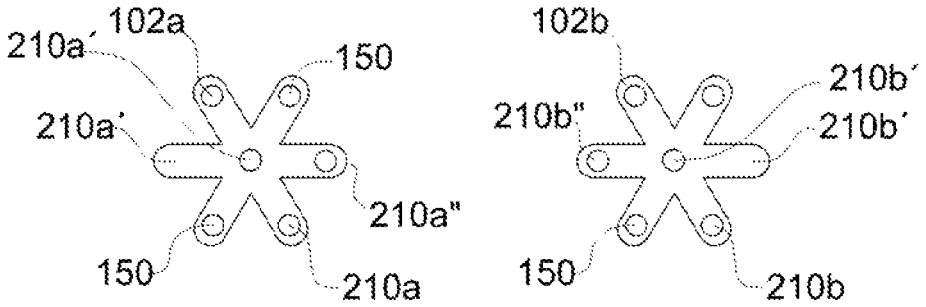

FIGS. 26*a-d* schematically illustrate another embodiment of an offshore wellhead platform with conductors in their respective first positions. In particular, FIG. 26*a* shows a front view of the platform while FIGS. 26*b-d* show cross sections along lines C-C, B-B and A-A in FIG. 26*a*, respectively. Similarly, FIG. 27*a* shows a front view of the platform while FIGS. 27*b-d* show cross sections along lines C-C, B-B and A-A in FIG. 27*a*, respectively The wellhead platform 100 comprises a configurable support structure including a number of support elements at different heights above the seabed 120, as will be described in more detail below.

The wellhead platform 100 comprises a wellhead deck 101 (also referred to as cellar deck) an x-mas tree access deck 102 (also referred to as a production deck), and a main deck 103 (also referred to as weather deck). FIGS. 26*b-d* show cross sections at the weather deck level, the production deck level and the wellhead deck level, respectively.

Each deck comprises two openings such that the openings of all decks define two sets of openings where the openings of each set are vertically aligned with each other so as to form a first and a second drilling center DC#1 and DC#2, respectively. This allows a dual activity rig having two working centers to efficiently cooperate with the wellhead platform 100.

In particular, as can best be seen in FIG. 26*a*, the weather deck comprises two openings 103*a/b* sized and shaped to allow tubulars of a desired diameter to extend through each opening.

As can best be seen in FIG. 26*c*, the wellhead deck comprises two larger openings 101*a/b* each defining a centrally located hole 160 and where the periphery of the opening includes radially outward extending slots 150 distributed along the periphery of the opening. The slots 150 of each opening define respective first positions for the upper ends of respective conductors while the central hole 160 of each opening defines a shared second position, shared by conductors positioned in the respective first positions of the corresponding opening such that the upper ends of the conductors are movable between any of the first positions and the shared second position of the corresponding opening. The two openings thus define two clusters, each cluster having a plurality of first positions and a shared second position, e.g. similar to the configuration described in connection with FIG. 4*d*.

As can best be seen in FIG. 26*d*, the x-mas tree access deck comprises two larger openings 102*a/b* similar to the openings of the wellhead deck, i.e. each defining a centrally located hole defining a shared second position 160. The periphery of each opening includes radially outward extending slots defining respective first positions 150 distributed along the periphery of the opening. Generally, parts of the openings in the decks may be covered when not in use and/or fenced to ensure safe working conditions for people working on the deck and reduce the risk of dropped objects between decks. Covers may be in the form of hatches, grating and/or deck pieces inserted into the respective opening.

The openings 101*a/b* and 102*a/b* are part of the configurable support structure and allow movement of the upper parts of the conductors 210*a/b*, 210*a*'/b', 210*a*"/b". This is illustrated in FIGS. 27*a-d* which show the same wellhead platform as in FIGS. 26*a-d* but where two conductors 210*a*'/b' have been moved from their respective first positions to the corresponding shared second position.

Figure 27E:
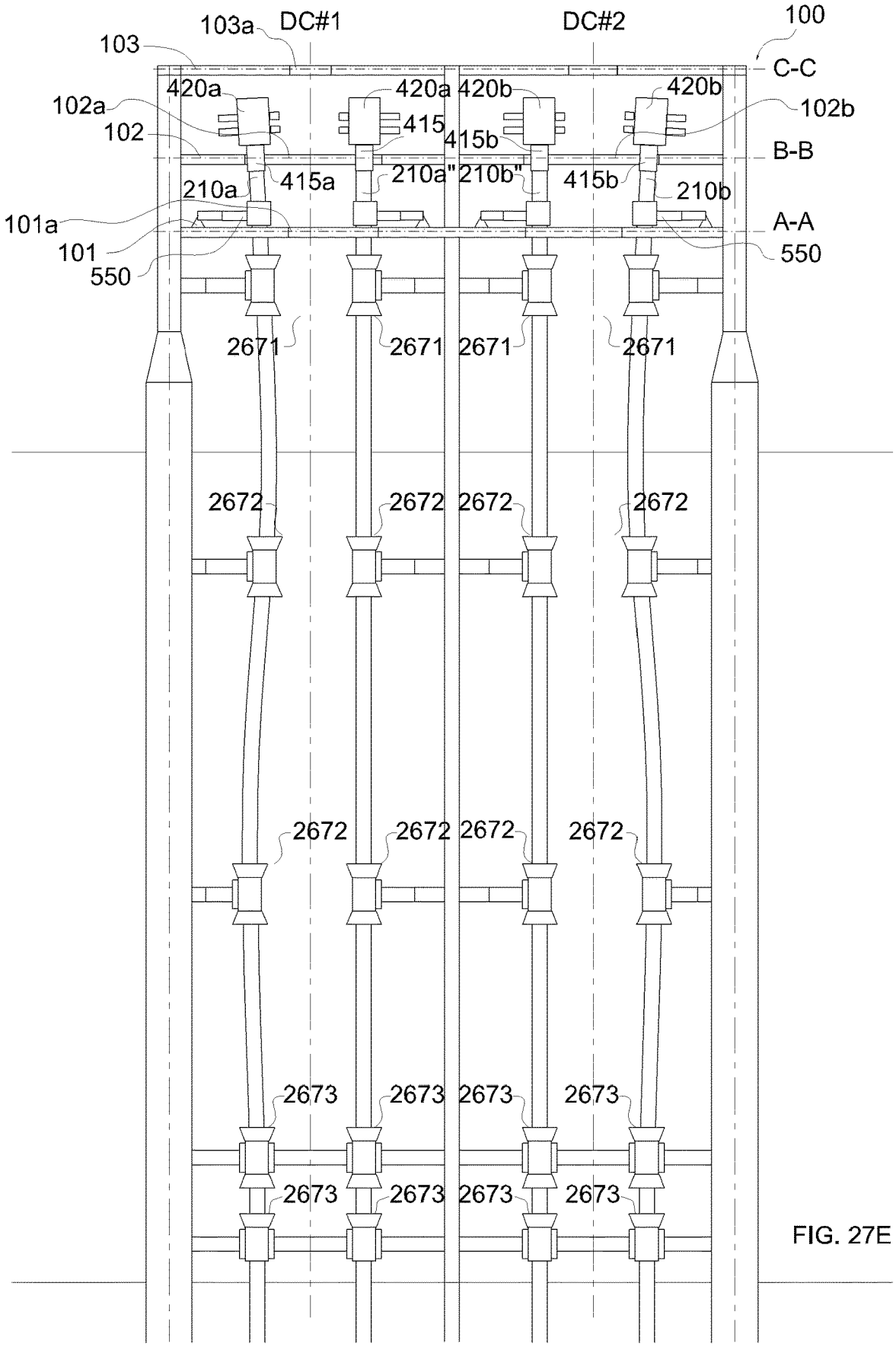

In particular, in the example of FIG. 26*a-d*, all first positions of both openings 101*a/b* (and accordingly of openings 102*a/b*) are occupied by respective conductors 210*a/b*, 210*a*'/b', 210*a*"/b". Conductors 210*a*" and 210*b*" are shown as completed with x-mas trees 420*a* and 420*b* installed. Conductors 210*a*" and 210*b*" are shown as substantially straight in this position. By comparison conductors 210*a* and 210*b* are installed in an S-shape when completed with their upper end in their respective first positions as shown in FIG. 27*e*. In the example of FIGS. 27*a-d*, one conductor 210*a*" has been moved from its first position in opening 101*a* to the central shared second position 160 of opening 101*a* (and correspondingly for opening 102*a*). Hence, the upper end of the conductor 210*a*" is now aligned with the hole 103*a* in the weather deck and with the drilling center DC#1 such that a drilling station aligned with drilling center DC#1 can engage the conductor and perform well processing tasks in the corresponding well, e.g. via respective high-pressure risers 430. Similarly, in the example of FIGS. 27*a-d*, one conductor 21013' has been moved from its first position in opening 101*b* to the central shared position of opening 101*b* (and correspondingly for opening 102*b*) such that the upper end of the conductor 210*b*' is aligned with opening 103*b* in the weather deck and drilling center DC#2 such that a drilling station aligned with drilling center DC#2 can engage the conductor 210*b*' and perform well processing tasks in the corresponding well, e.g. via respective high-pressure risers 430.

Accordingly, the conductors 210*a*, 210*a*', 210*a*" are arranged in a first cluster associated with openings 101*a*, 102*a* and 103*a* and the conductors 210*b*, 210*b*', 210*b*" are arranged in another cluster associated with openings 101*b*, 102*b* and 103*b*.

In the example of FIGS. 26*a-d* and 27*a-d*, the wells of the conductors 210*a*" and 210*b*" have been completed and X-mas trees 420*a/b* and wellheads 415*a/b* have been installed and the conductors have been placed in their respective first positions.

The decks 101, 102 and 103 of the well head platform are supported by legs 2610 or another platform support structure. The platform support structure is also referred to as main structure of the wellhead platform.

As will now be described in greater detail, the configurable support structure supporting the conductors further comprise various conductor guides or other forms of support elements as well as a moving mechanism for moving the upper part of the conductors. For the purpose of illustration guides will be used as examplary support elements but other types of support elements may be applied instead:

In particular, the configurable support structure comprises conductor moving mechanisms 550. In the present example, the mechanism is arranged on the wellhead deck and engages the upper part of the conductor near the well head. It will be appreciated that, in other embodiments, the moving mechanism may be provided below the wellhead deck or at a different position along the conductor. For example, by providing a longer uppermost portion of the conductor above the moving mechanism and above any conductor guide, at least when the conductor is in its second position, the uppermost portion may be allowed to bend/flex when connected to a drilling station, e.g. so as to allow for relative movements of the drilling station and the wellhead platform. The moving mechanism 550 may directly or indirectly be connected, e.g. hinged, to the main structure of the wellhead platform, e.g. to the wellhead deck, such that e.g. thermal expansions are decoupled. Examples of moving mechanisms are described in connection with FIGS. 17, 18, 24 and 28*a-c*. In some embodiments separate moving mechanisms may be provided for each conductor while, in other embodiments, fewer moving mechanisms may be provided that can selectively move different conductors.

The configurable support structure further comprises a number of conductor guides 2671, 2672, 2673. The conductor guides are attached directly or indirectly to the legs or to another part of the main structure of the wellhead platform.

In particular, the conductor guides include upper guides 2671 that are arranged below the wellhead deck and above the water level. The upper guides are movable and may comprise an actuator or other moving mechanism for moving the conductor. For example, the conductor guides 2671 may directly or indirectly be connected to the main structure via hydraulic cylinders that can be controlled to reposition the conductor guides relative to the legs. In particular, the upper guides 2671 and the moving mechanism may cooperate so as to maintain the upper part of the conductor substantially vertical even when the upper end of the conductor is moved to another position, e.g. when the conductor is positioned at the second position so as to facilitate proper engagement of the drilling station with the conductor. In this case this results in conductors 210*a*' and 210*b*' following an S-shape. It will be appreciated that, in other embodiments, the conductor guide 2671 may be positioned above the moving mechanism 550, e.g. by placing the conductor guide 2671 above the wellhead deck and the moving mechanism below the wellhead deck. For example, when the conductor guides 2671 are located above a lowest deck of the wellhead platform they may be easier to operate and maintain. A lower position may provide and increased flexibility for the x-mas tree. In such case a further guide may be used to support the conductors below the x-mas tree during the production phase.

Generally, in some embodiments, two cooperating guides that engage the upper part of the conductor and that can be positioned by a suitable drive mechanism (e.g. a motor, hydraulic cylinders or the like) may be operable to control the position and orientation of the upper part and/or upper end of the conductor. Accordingly in some embodiments the platform comprises two cooperating support elements arranged to apply opposite oriented, lateral forces at respective positions along the length of the first conductor. In some embodiments, one guide that is driven by a suitable drive mechanism and one lockable guide may be sufficient.

In some embodiments it may be desirable to reduce the relative motion between the conductor and the wellhead platform and between the conductor and the drilling station, as both impose forces on the well. Accordingly, the configurable control structure may comprise means for following the relative motions of the rig, e.g. dampening mechanism and/or a control system controlling the moving mechanism, e.g. based on measurements of the relative position(s) and implementing a suitable feedback loop.

The conductor guides further include lower conductor guides 2673 arranged at or at least near the seabed. The conductor guides 2673 are preferably horizontally fixed at a position above the position where the conductor projects into the seabed. The lower conductor guides 2673 are formed as two or more guides distributed along a lower portion of the conductor up to a suitable height above the seabed, so as to avoid bending stresses to be transferred to the part of the conductor that is submerged in the seabed when the upper part of the conductor is horizontally displaced. The lower guides serve to isolate the movement of the upper parts of the conductors from the parts of the conductors that extend into the seabed and so as to ensure integrity of the cement below the seabed. For example, the lower conductor guides may be formed as the guides shown in FIGS. 11*a-b* (in some instances without a lower funnel towards the seabed as the conductor may preferably be static here regardless of movements of the upper end), as a frame, grid or template, or another suitable support structure. In some embodiments, the lower conductor guides 2673 for each conductor may comprise or be formed as a single, elongated guide of a suitable length. As can best be seen in FIG. 27*a*, the lower conductor guides may cause the conductor to remain substantially straight along a lower portion immediately above the seabed. Suitable forms of lower conductor guides include a rigid tubular guide where the upper end is funnel-shaped with upwardly increasing diameter so as so avoid sharp edges as the conductor bends.

In many embodiments it may be desirable to minimize the horizontal spacing between the lower guides. In some embodiments, the lower guides are distributed (e.g. circularly arranged) around the projection of the second position. The lower guides may be arranged in a honeycomb grid or a square matrix. In some embodiments, a lower guide may also be positioned in alignement with the shared second position of the upper ends e.g. to support the last conductor to installed straight in the second position.

The conductor guides further include intermediate support elements in the form of conductor guides 2672 arranged at one or more intermediate heights between the lower and upper conductor guides. The intermediate support elements provide lateral support to the conductors and they decouple harmonic vibrations to reduce wave fatigue. They may assist maintaining the conductors in a suitable shape, e.g. to manage bending stresses, and they may help to reduce the risk of conductors colliding with each other or with other parts of the wellhead template. The intermediate support elements may fix the position of the conductor to a single position, e.g. by employing conductor guides of the type shown in FIGS. 11*a-b* or they may restrict horizontal movement of the conductor, e.g. to a certain horizontal distance and/or a certain direction, e.g. by employing conductor guides as shown in FIG. 13*a-c* or 14-16.

In some embodiments, no intermediate support elements may be necessary at all while other embodiments may use one or more different types of support elements, e.g.:

- "slot guides" i.e. a restricting movement to one direction e.g. between two beams, such as transverse to the general direction of the water current.
- passive restraints e.g. by means of springs, pistons or friction either directly imposed on the conductors or via a guide.
- locking elements such as a mounted so that it may e.g. move with the conductor but be locked at a position so as to impose a shape as the conductor is moved.
- active support element such as guides and a movement mechanism that actively push or pull the conductor, e.g. by means of hydraulics, a chain to the surface or by a local electrical/mechanical motor.

Intermediate conductor guides may be rotatable around one or more horizontal axes so as to reduce local loads imposed by the guide onto the conductor.

In the example of FIGS. 26*a-d* and 27*a-d*, all intermediate support elements are located below the water level. In alternative embodiments, further intermediate support elements may be desirable above the water level. In any event, when the intermediate support elements are located outside the splash zone, the risk of damage and increased wear is reduced.

In the embodiments of FIGS. 26*a-d* and 27*a-d* the x-mas trees are all positioned on the same deck. It will generally be appreciated that, in some embodiments some x-mas trees may be located on an upper deck while other x-mas trees may be positioned on a lower deck, e.g. in an alternating fashion, as this may allow the conductors to be moved closer together while, at the same time providing sufficient space for the x-mas trees. In some embodiments this means that the wellhead platform comprises an upper and lower production deck and/or an upper and lower wellhead deck. One or more of these decks may be structural decks or mezzanine decks.

Figure 28A:
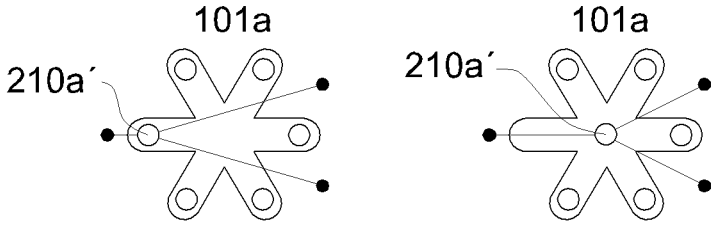
FIGS. 28*a*-*c* schematically illustrate different embodiments of moving mechanisms for use with the embodiment of FIGS. 26*a*-*d* and 27*a*-*d;*
Figure 28B:
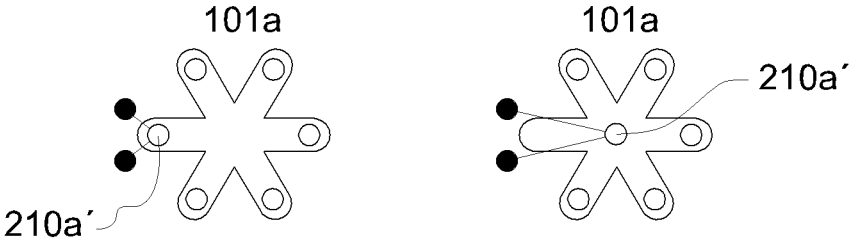
Figure 28C:
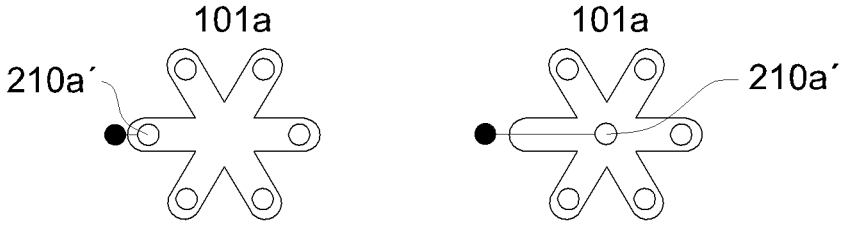

FIGS. 28*a-c* schematically illustrate different embodiments of moving mechanisms for use with the embodiment of FIGS. 26*a-d* and 27*a-d*. In particular, in each of the figures, the left part of the drawing shows opening 101*a* in the situation of FIGS. 26*a-d*, i.e. in a situation where all conductors are in their first positions while the right part of each drawing illustrates opening 101*a* in the situation of FIGS. 27*a-d*, i.e. in a situation where one conductor 210*a*' has been moved to the central shared position. FIG. 28*a* shows how this movement may be implemented with a moving mechanism as described in FIGS. 17 and 18 using a cable anchoring system with e.g. three anchor points. FIG. 28*b* shows how this movement may be implemented with a moving mechanism as described in FIG. 16 using two hydraulic cylinders. FIG. 28*c* shows how this movement may be implemented with a moving mechanism as described in FIGS. 12*a-b* using a single hydraulic cylinder.

Figure 29A:
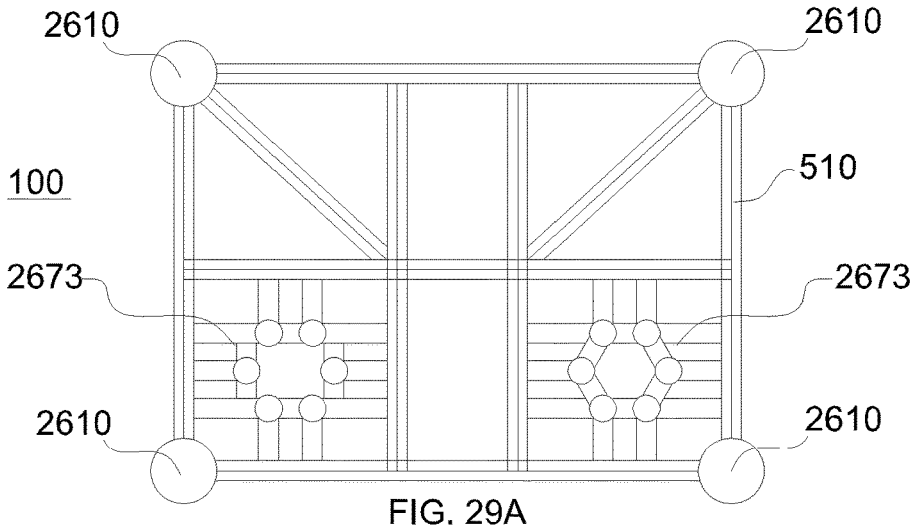
FIGS. 29*a*-*c* schematically illustrate embodiments of support elements of a configurable support structure.
Figure 29B:
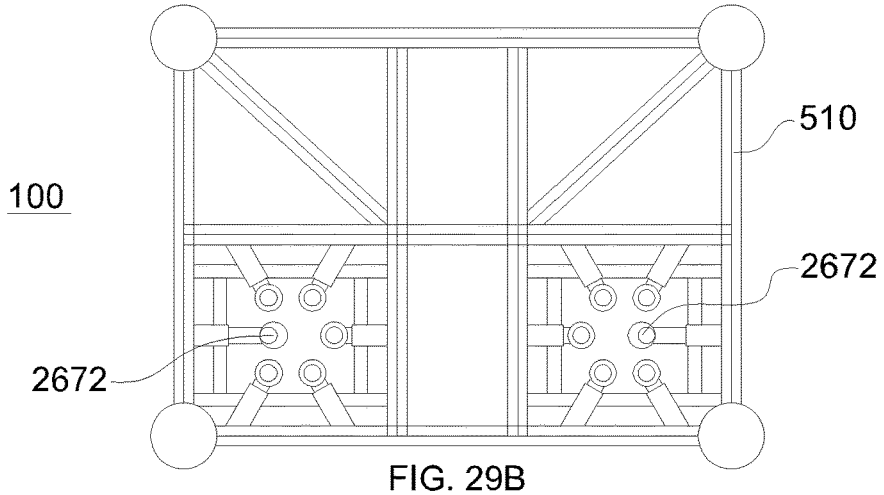
Figure 29C:
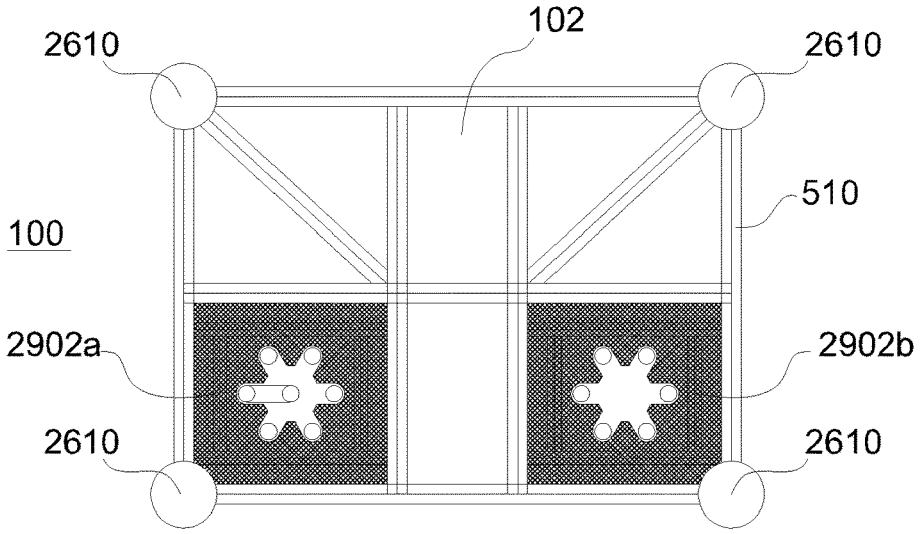

FIGS. 29*a-c* schematically illustrate embodiments of support elements of a configurable support structure. In particular FIGS. 29*a-c* show horizontal cross sections of a wellhead platform 100 similar to the wellhead platform of FIG. 26*a*. The wellhead platform comprises a main structure 510 including legs 2610. FIG. 29*a* shows a cross section through the wellhead deck 102. The deck has two deck sections 2902*a* and 2902*b* that each define an opening 102*a* and 102*b*, respectively, as described in connection with FIGS. 26*a-d*. FIG. 29*b* shows a cross section at a lower level where the configurable support structure comprises intermediate conductor guides 2672, e.g. of the type shown in FIGS. 11*a,b* or of another suitable type. Finally, FIG. 29*c* shows a cross section just above the seabed where the configurable support structure comprises templates 2673 for fixing the position of the lower ends of the part of the conductors that extend above the seabed.

FIG. 27*e* shows the wellhead platform and the conductors 210 of FIG. 26 where the upper ends of the conductors 210*a* and 210*b* have been returned to their respective first positions. As explained above, the conduits installed in the conductors (e.g. casing cemented in place) may introduce resistance to revert to the initial straight state. Accordingly, it may be optimal to allow the conductor to be curved as the upper end is positioned in the first position. Optimum may e.g. be in a minimum bending stress. The wells comprising the conductors 210*a*"/b" are shown completed with x-mas trees 420*a/b* with straight conductors above the seabed for comparison. In co-pending application UK1607182.1 describes modifications to the normal method of cementing casings inside the conductor such as omitting the cement above the seabed or the introduction of weak spots or zones in cement above the seabed improve flexibility of the well above the seabed or parts thereof and/or control of breaking. While shown here as straight for illustration purposes, inventions of UK1607182.1 may been employed to allow 210*a*"/b" to be straight or the configuration and/or function of these wells may allow some conductors to be straight subsequent to completetion whereas other should be allow to curve.

Figure 30:
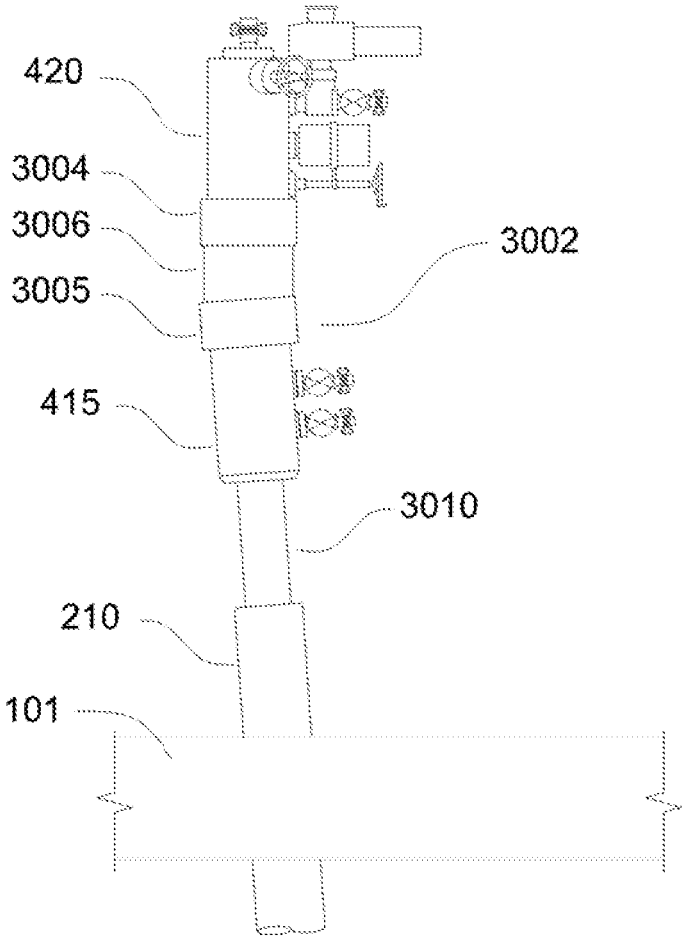
FIG. 30 schematically illustrates an embodiment of a coupling element for coupling a wellhead to an x-mas tree.
Figure 30:
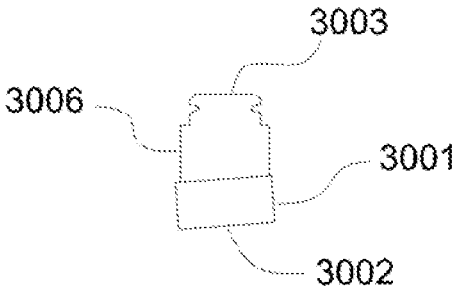

FIG. 30 schematically illustrates an embodiment of a coupling element for coupling a wellhead to a x-mas tree. In some embodiments of the wellhead platform, the upper part of the conductor may be inclined relative to the vertical axis when moved to the first or second position. However, it may be desirable to maintain the x-mas tree in an upright position. To this end, in some embodiments, the well head platform may employ multiple cooperating conductor guides and moving mechanism that together control not only the position of the upper end of the conductor but also the inclination of the upper part, e.g. as described in connection with FIGS. 26*a-d* and 27*a-d*. However, other embodiments may not have such cooperating guide members or a complete control of the inclination may not be possible or desirable, e.g. due to bending constraints. To this end an aspect of the present invention relates to a coupling element 3001 as illustrated in FIG. 30 may be employed. On the bottom of FIG. 30, an example of a coupling element 3001 is shown on its own and, on the top of the drawing, the coupling element is shown in use as part of a well. The coupling member 3001 is an angled tubular that has a first end connectable to the x-mas tree 3004 and a second end connectable to the top of the well head 3005. Accordingly the respective ends of the coupling element may comprise connectors 3002 and 3003 adapted for attachment to the wellhead 415 and the x-mass tree 420, respectively. This angle may for example be larger than 1 degree, such as larger than 2 degrees, such as larger than 3 degrees, such as larger than 4 degrees, such as larger than 5 degrees such as larger than 6 degrees, such as larger than 7 degrees, such as larger than 8 degree, such as larger than 9 degrees, such as larger than 10 degrees and in some embodiments the angle is less than 90 degrees, such as less than 45 degrees, such as less than 30 degrees, such as less than 20 degrees. The connectors may be a female and a male connector, respectively. The coupling element 3001 further comprises a curved or angled tubular portion 3006 configured such that the x-mas tree is oriented upright when connected via the coupling element 3001 to a wellhead 415 mounted on the upper end of a tubular 3010 that extends out of an inclined conductor 210. To this end the coupling element may be bent/curved by an angle matching the angle of inclination of the upper part of the conductor. For example, the coupling element may comprise a piece of pipe having at its one end (in use the top end) a connector similar to the top of the wellhead and, at its other end (in use the bottom end) a connector similar to the bottom the Xmas tree. The pipe section can merely be seen as an extension of any of the two components, and may be made of the same material grade as the other two items. In the example of FIG. 30, the conductor extends through a conductor guide 2671 in an opening of the wellhead deck 101 or cellar deck.

Some preferred embodiments have been shown in the foregoing, but it should be stressed that the invention is not limited to these, but may be embodied in other ways within the subject matter defined in the following claims.

Furthermore, the embodiments of the invention are further described in the enclosed set of items:

1. An offshore wellhead platform (100) comprising a configurable support structure (200) for supporting
   an upper part of one or more conductors (210) through which one or more well processing tasks can be performed, wherein
   the configurable support structure (200) provides a first position (150) and a second position (160) for the upper part of said one or more conductors (210), and
   the offshore wellhead platform (100) allows movement the upper part of the one or more conductors (210) between the first (150) and second position (160).

2. The offshore wellhead platform (100) according to item 1, wherein the second position (160) of at least some, e.g. all, of the plurality of conductors (210) are the same and wherein the first position (150) of at least some, e.g. all, of the plurality of conductors (210) are different at least for some of the plurality of conductors (210).

3. The offshore wellhead platform (100) according to any one of items 1-2, wherein the first position (150) of a conductor (210) is at least one member selected from the group of a parking, a storage, an injection, a well intervention, and/or a production position and the second position of the conductor (210) is a well processing and/or drilling position.

4. The offshore wellhead platform (100) according to any one of items 1-3, wherein the offshore wellhead platform (100) comprises at least one mechanism for moving or deflecting an upper part of a conductor (210) between its first position (150) and its second position (160).

5. The offshore wellhead platform (100) according to any one of items 1-4, wherein a substantially minimum bending stress state of a conductor (210) is at a predetermined position for the conductor (210) that is
   located between the first and the second position of the conductor (210),
   located substantially at the second position of the conductor (210), or
   located substantially at the first position of the conductor (210).

6. The offshore wellhead platform (100) according to any one of items 1-5, wherein the plurality of conductors (210) are arranged or organized in at least one cluster (600).

7. The offshore wellhead platform (100) according to any one of items 1-6, wherein the plurality of conductors (210) are arranged or organized in at least two clusters (600), wherein each cluster (600) provides at least one first position (150) and at least one second position (160) and wherein each cluster (600) is associated with its own at least one well processing station or drilling station (410) of an offshore well processing system (400).

8. The offshore wellhead platform (100) according to item 7, wherein two or more clusters (600) are connected to allow a conductor (210) to be moved between a number of clusters (600).

9. The offshore wellhead platform (100) according to any one of items 1-8, wherein at least some of the plurality of conductors (210) are arranged or organized in at least one cluster (600) comprising at least two second positions (160).

10. The offshore wellhead platform (100) according to any one of items 1-9, wherein a plurality of first (150) positions and one or more second positions (160) are arranged or organized in a predetermined pattern or arrangement where the second position(s) (160) is/are located substantially centrally and the first positions (150) are located around the second position(s) (160) in a substantially circular or oval pattern.

11. The offshore wellhead platform (100) according to any one of items 1-10, wherein the first positions (150) are located so that a first position (150) has a substantially same distance to its immediate neighbors if the plurality of conductors are arranged or organized in a single or no group or cluster, or the first positions (150) are located so that a first position (150) of a cluster (600) has a substantially same distance to its immediate neighbors of the cluster if the plurality of conductors are arranged or organized in two or more clusters (600).

12. The offshore wellhead platform (100) according to any one of items 1-9, wherein the plurality of conductors (210) are arranged or organized in at least one cluster (600) comprising a plurality of first positions (150) and at least one second position (160) wherein at least one second position (160) is located substantially centrally and at least one first position (150) is located at a first side of the second position (160) and at least one other first position (150) is located at a second side of the second position (160) being different from, e.g. opposing, the first side.

13. The offshore wellhead platform (100) according to any one of items 1-9, wherein the plurality of conductors (210) are arranged or organized in at least one cluster (600) comprising a plurality of first positions (150) and at least one second position (160) wherein at least one second position (160) is located substantially centrally and wherein a first part of the plurality of first positions (150) has a substantially same first distance to a second position (160) and wherein a second part of the plurality of first positions (150) has a substantially same second distance to the second position (160) where the first distance is different to the second distance.

14. The offshore wellhead platform (100) according to any one of items 11-13, wherein the offshore wellhead platform (100) provides a plurality of clusters (600) according to any one of items 11-13.

15. The offshore wellhead platform (100) according to any one of items 1-14, wherein the configurable support structure (200) comprises one second position (160) and four, six, eight, nine, ten, or twelve first positions (150).

16. The offshore wellhead platform (100) according to any one of items 1-15, wherein the offshore wellhead platform (100) further comprises one or more blow-out-preventer components or units to which one or more wells may be connected.

17. The offshore wellhead platform (100) according to any one of items 1-16, wherein the conductors (210) are steel pipes.

18. The offshore wellhead platform (100) according to any one of items 1-17, wherein at least a part of the upper part of one or more conductors (210) are flexible or comprises a part or segment made of a more flexible material.

19. The offshore wellhead platform (100) according to any one of items 1-18, wherein the offshore wellhead platform (100) comprises a working center zone (250) defining an opening of the offshore wellhead platform (100), where the working center zone (250) comprises an offset zone (230) to accommodate for tolerances when positioning an offshore well processing system to work on the wells of the configurable support structure (200), e.g. where the working center zone (250) is enlarged by an additional safety zone (235) to safely accommodate any effects of weather on equipment during well construction.

20. The offshore wellhead platform (100) according to any one of items 1-19, wherein the configurable support structure (200) provides a single first position (150) and a single second position (160).

21. The offshore wellhead platform (100) according to any one of items 1-20, wherein the configurable support structure (200) comprises one or more further conductors without a first and/or a second position (150, 160).

22. A method of constructing and/or processing one or more offshore surface-wells (300), the method comprising constructing and/or processing an offshore surface-well (300) from a working or drilling center position, said method comprising the steps of 1. at least partially constructing and/or processing one of the one or more surface-well (300) through a conductor (300) at the working or drilling center position (160),
2. moving an upper part of the conductor (300) to a first position (150), and
3. producing from or injecting into the surface-well (300) through the conductor (300) at the first position (150).

23. The method according to item 22, wherein the working or drilling center position is a second position (160) and wherein the second position (160) of at least some, e.g. all, of a plurality of conductors (210) of a plurality of surface-wells (300) is the same and wherein the first position (150) of at least some, e.g. all, of the plurality of conductors (210) of surface-well (300) are different at least for some of the plurality of conductors (210).

24. The method according to item 22 or 23, wherein the method comprises progressing a plurality of surface-wells (300) towards completion by moving an upper part of a conductor (210) from a first position (150) to a second position (160) and carrying out one or more well constructing and/or processing tasks to complete the surface-well (300) of the conductor (210), moving an upper part of the conductor (210) to a first position (150) after completion, and repeating these steps for one or more additional conductors (210).

25. The method according to any one of items 22-24, wherein the method comprises progressing a plurality of surface-wells (300) towards completion by moving an upper part of a conductor (210) from a first position (150) to a second position (160) and carrying out at least one well constructing and/or processing task and/or sub-task, moving an upper part of the conductor (210) from the second position (160) to a first position after completion of the at least one well constructing and/or processing task and/or sub-task, repeating these steps for a desired number of conductors (210), and when the at least one well constructing and/or processing task and/or sub-task have been completed for all the desired number of conductors (210) then repeating the steps again for at least one next well constructing and/or processing task and/or sub-task until all desired constructing and/or processing task and/or sub-task have been carried out for all desired conductors (210).

26. The method according to any one of items 22-25, wherein the method comprises performing concurrent or parallel drilling or well processing on at least two wells (300) located at separate second positions (160).

27. The method according to any one of items 22-26, wherein the method comprises performing constructing and/or processing on a well (300) located at a first second position (160), followed by moving an upper part of the well (300) to a second second position and performing drilling or well processing on the well (300) when located at the second second position (160).

28. The method according to any one of items 22-27, wherein the method comprises constructing and/or processing at least one well (300) through a working center zone (250) and then moving the working center zone (250) and then constructing and/or processing at least one well (300) through the moved working center zone (250).

29. The method according to any one of items 22-28, wherein the method comprises constructing and/or processing at least one well (300) at at least one second position (160) at a working center zone (250) and after a number of wells (300) have been completed and/or processed and moved to respective first positions (150) outside the working center zone (250) then constructing and/or processing at least one well (300) in the working center zone (250) at or near the at least one second position (160).

30. An offshore well processing system (400) for performing one or more well processing tasks on a plurality of surface-wells (300) of one or more off-shore reservoirs located below the seabed (120) wherein the offshore well processing system (400) comprises or works together with an offshore wellhead platform (100) according to any one of items 1-21 and comprises one or more drilling units or derricks (410).

31. The offshore well processing system (400) according to item 30, wherein the offshore well processing system (400) comprises at least one mechanism for moving an upper part of a conductor (210) between a first position (150) and a second position (160).

32. The offshore well processing system (400) according to item 30 or 31, wherein the offshore well processing system (400) is a jack-up unit.

33. The offshore well processing system (400) according to any one of items 30-32, wherein the offshore well processing system (400) further comprises one or more blow-out-preventer components or units to which one or more wells may be connected.

34. The offshore well processing system (400) according to any one of items 30-33 wherein the offshore well processing system (400) comprises at least two well processing stations or drilling stations (410), wherein the well processing stations or drilling stations (410) are capable of operating fully independently of each other.

35. The offshore well processing system (400) according to item 34, wherein each of the at least two well processing stations or drilling stations (410) comprises its own fluid system and well control system.

36. Use of the offshore wellhead platform (100) according to any one of items 1-21 to perform batch-drilling.

In some embodiments, the configurable support structure for supporting an upper part of a plurality of conductors may itself also be movable and/or rotatable.

It is to be noted that the number of first positions of a configurable support structure may be uneven even though only an even number of first positions are shown in the figures.

In the claims enumerating several features, some or all of these features may be embodied by one and the same element, component or item. The mere fact that certain measures are recited in mutually different dependent claims or described in different embodiments does not indicate that a combination of these measures cannot be used to advantage.

It should be emphasized that the term "comprises/comprising" when used in this description is taken to specify the presence of stated features, elements, steps or components but does not preclude the presence or addition of one or more other features, elements, steps, components or groups thereof. However, on the other hand the term "comprises/comprising" is intended to also include embodiments where the particular articles is formed entirely by the comprised features.

The invention claimed is:

1. An offshore bottom supported wellhead platform comprising:

a configurable support structure for supporting at least respective upper parts of two or more conductors, the upper part of each conductor comprising an upper end through which one or more well processing tasks can be performed, the configurable support structure including support structures extending to the seabed such that the wellhead platform is supported by the seabed, wherein the offshore bottom supported wellhead platform allows movement of the upper part of each of the two or more conductors between a first and a second position of each of the two or more conductors, the first and second positions of a conductor corresponding to first and second positions, respectively, of the upper end of said conductor, wherein the configurable support structure supports the two or more conductors at least at said first position, where the second positions of a plurality of said two or more conductors are a shared second position corresponding to a shared second position of the upper ends of the plurality of said two or more conductors, at which each of said plurality of conductors may be selectively placed, wherein the offshore bottom supported wellhead platform allows performance, by a well processing station, through a well center of said well processing station, without lateral displacement of the well processing station or its well center, of a well processing task through the upper end of a conductor of said plurality of said two or more conductors, when positioned at said shared second position, and a subsequent well processing task through the upper part of another conductor of said plurality of said two or more conductors, when subsequently positioned at said shared second position; and wherein, when one of said two or more conductors is the shared second position, the configurable support structure is adapted to apply one or more counter forces to one or more other conductors of said two or more conductors in a direction opposite the movement of the one of said two or more conductors between said first position and said second positions to relieve stress to the wellhead platform.

2. The offshore bottom supported wellhead platform according to claim 1, wherein said configurable support structure provides said first position and second position for each of the two or more conductors.

3. The offshore bottom supported wellhead platform according to claim 2, wherein said configurable support structure supports each conductor when in the shared second position, and supports each conductor when moving the upper part between said first and said shared second position of the conductor.

4. The offshore bottom supported wellhead platform according to claim 1, wherein the first positions of the two or more conductors are at least one member selected from the group consisting of a parking, a storage, an injection, a well intervention, and a production position.

5. The offshore bottom supported wellhead platform according to claim 1, wherein at least one of the offshore bottom supported wellhead platform comprises at least one mechanism for moving the upper part of a conductor between its first position and its second position; and the offshore bottom supported wellhead platform allows at least one external device to move an upper part of a conductor between its first position and its second position.

6. The offshore bottom supported wellhead platform according to claim 1, wherein said plurality of said two or more conductors having a shared second position form a first cluster and wherein the configurable support structure is further arranged to support a second plurality of said two or more conductors having another shared second position thereby forming a second cluster for which the offshore bottom supported wellhead platform allows moving an upper part of a conductor from each of a plurality of first positions of the upper ends of the second plurality of said two or more conductors of the second cluster to the another shared second position of respective upper ends.

7. The offshore bottom supported wellhead platform according to claim 1, wherein the first positions and the shared second position of the upper ends of the plurality of said two or more conductors are provided according to an arrangement wherein the shared second position of the upper ends is provided substantially centrally and at least one first position of the upper ends is provided at a first side of the shared second position of the upper ends and at least one other first position of the upper ends is provided at a second opposing side of the shared second position of the upper ends.

8. The offshore bottom supported wellhead platform according to claim 1, wherein the configurable support structure is configured such that the shared second position of the upper ends may be selectively chosen within a predetermined working center zone or at least within a predetermined offset zone within said working center zone.

9. The offshore bottom supported wellhead platform according to claim 1, comprising one or more support elements configured to maintain the conductors at fixed respective positions at or near the seabed.

10. The offshore bottom supported wellhead platform according to claim 1, comprising one or more support elements each configured to engage a conductor at a position along the length of the conductor above the seabed and to restrict lateral movement of the conductor relative to the support elements.

11. The offshore bottom supported wellhead platform according to claim 10, wherein at least of said one or more support elements is movably attached to a part of the wellhead platform.

12. The offshore bottom supported wellhead platform according to claim 11, comprising a mechanism for imparting movement on at least one of the movable support elements.

13. The offshore bottom supported wellhead platform according to claim 10, comprising two or more support elements configured to engage a first conductor at respective positions along the length of the first conductor and to restrict lateral movement of the conductor relative to the support elements, wherein the support elements operable to engage the first conductor comprise a lowermost support element at or near the seabed and an uppermost support element proximal to the upper end of the first conductor; wherein the lowermost support element is adapted to fix the position of the conductor relative to the seabed and/or relative to a main structure of the wellhead platform; and wherein the uppermost support element is a movable support element.

14. The offshore bottom supported wellhead platform according to claim 13, wherein the two or more support elements operable to engage the first conductor comprise two cooperating support elements arranged to apply oppositely oriented, lateral forces at respective positions along the length of the first conductor.

15. The offshore bottom supported wellhead platform according to claim 1, wherein the configurable support structure comprises one or more support elements operable to support each conductor at its first position; wherein the configurable support structure allows the upper part of each conductor to be moved at least from the shared second position to the first position for said conductor; and wherein the wellhead platform and the configuration of any other conductor supported by the wellhead platform as defined by a corresponding support configuration of the wellhead platform allow such movement at least during establishing of the wells.

16. The offshore bottom supported wellhead platform according to claim 1, wherein the configurable support structure comprises one or more support elements for engaging with the conductors and for transferring forces due to bending of the conductors at the first and/or second position to the wellhead platform and thereby locking the conductors in the respective position.

17. The offshore bottom supported wellhead platform according to claim 1, wherein the configurable support structure comprises support elements at two or more elevations operable to work in collaboration to control the curve of a conductor and the position of the upper end of the conductor.

18. The offshore bottom supported wellhead platform according to claim 1, wherein the configurable support structure is configured to provide a compensation position at least for some of the conductors.

19. The offshore bottom supported wellhead platform according to claim 18, wherein the configurable support structure allows movement of the upper end of at least some of the conductors to a compensation position different from the first and second positions.

20. The offshore bottom supported wellhead platform according to claim 1, wherein the wellhead platform comprises at least one support element adapted to at least partially relieve the wellhead platform of stress when a first conductor is moved from its first position to its second position by moving at least one other conductor to a compensation position when the first conductor is moved to its second position.

21. The offshore bottom supported wellhead platform according to claim 20, wherein the compensation position of the at least one other conductor is different from its first and second positions.

22. The offshore bottom supported wellhead platform as recited in claim 1, wherein the configurable support structure of the offshore wellhead platform is located above sea surface level.

23. A method of constructing and/or processing one or more offshore surface-wells, the method comprising constructing and/or processing an offshore surface-well through a well center of a well processing station, the surface-well comprising a conductor having an upper part including an upper end, and said method comprising the steps of:

providing a bottom supported configurable support structure for the well processing station, the configurable support structure including support structures extending to the seabed and supporting a wellhead platform with the configurable support structure;

constructing and/or processing a first surface-well through the upper end of the conductor at a second position, moving the upper part of the conductor to a first position of the conductor, producing from or injecting into the first surface-well through the upper end of the conductor at the first position; and the method further comprises applying one or more counter forces to one or more other conductors in a direction opposite the movement of the conductor between the first position and the second position by at least one support element when moving the conductor from the first position to the second position, the one or more counter forces reducing the impact of a movement force on a main structure supported by the configurable support structure, where the movement force is a force acting on the conductor due to the conductor being moved between the first and the second position.

24. The method according to claim 23, the method comprising applying one or more counter forces by moving at least one other conductor to one or more compensation positions when the conductor is moved to its second position.

25. A method of constructing and/or processing one or more offshore surface-wells, wherein the method comprises progressing a plurality of surface-wells towards completion by:

providing a bottom supported configurable support structure for a wellhead platform, the configurable support structure including support structures extending to the seabed and supporting a wellhead platform with the configurable support structure;

moving an upper part, of a selected one conductor of a surface-well, from a first position to a shared second position of the upper end and carrying out one or more well constructing and/or well processing tasks through the upper end of the selected one conductor to at least partly complete the surface-well of the selected one conductor, moving the upper part of the selected one conductor from the shared second position of the upper end to a first position of the upper end after at least partly completing the surface-well, and repeating these steps for one or more additional conductors, wherein the method further comprises applying one or more counter forces to one or more other conductors in a direction opposite the movement of the selected one conductor between the first position and the second position by at least one support element when moving the selected one conductor from the first position to the shared second position, the one or more counter forces reducing the impact of a movement force on a main structure supported by the configurable support structure, where the movement force is a force acting on the selected on conductor due to the selected one conductor being moved between the first and the second shared position.

26. The method according to claim 25, comprising at least one of:

installing a least a part of the conductors at the respective first positions; wherein installing comprises bringing the conductor into engagement with at least some support elements of the configurable support structure of the wellhead platform;

installing a least a part of the conductors at the second position; wherein installing comprises bringing the conductor into engagement with at least some support elements of the configurable support structure of a wellhead platform; and moving the installed part of the conductor to a first position; and pre-installing a lower part of the conductors at a wellhead platform, prior to positioning the wellhead platform at an offshore site; wherein installing comprises bringing the conductor into engagement with at least some support elements of the configurable support structure of the wellhead platform; and installing a remaining part of the conductors after at least a part of the wellhead platform is positioned at the offshore site.

27. The method according to claim 25, the method comprising applying one or more counter forces by moving at least one other conductor to one or more compensation positions when the selected one conductor is moved to its second shared position.

* * * * *